US012703992B2

(12) United States Patent
Barnes et al.

(10) Patent No.: US 12,703,992 B2
(45) Date of Patent: Aug. 11, 2026

(54) SUN SHADING SYSTEMS

(71) Applicant: Shibumi Shade, Inc., Raleigh, NC (US)

(72) Inventors: Dane Brooks Barnes, Raleigh, NC (US); Alexander Griffith Slater, Raleigh, NC (US); Scott Christian Barnes, Raleigh, NC (US); Alexei Tcherepanov, Fairfax, CA (US)

(73) Assignee: SHIBUMI SHADE, INC., Raleigh, NC (US)

( * ) Notice: Subject to any disclaimer, the term of this patent is extended or adjusted under 35 U.S.C. 154(b) by 211 days.

(21) Appl. No.: 17/968,995

(22) Filed: Oct. 19, 2022

(65) Prior Publication Data

US 2023/0126867 A1 Apr. 27, 2023

Related U.S. Application Data

(60) Provisional application No. 63/270,310, filed on Oct. 21, 2021.

(51) Int. Cl.
*E04H 15/20* (2006.01)
*E04H 15/00* (2006.01)

(52) U.S. Cl.
CPC ..... *E04H 15/20* (2013.01); *E04H 15/005* (2013.01); *E04H 2015/201* (2013.01)

(58) Field of Classification Search
CPC .. E04H 15/005; E04H 15/20; E04H 2015/201
See application file for complete search history.

(56) References Cited

U.S. PATENT DOCUMENTS 1,129,194 A 2/1915 Hanley
1,571,295 A 2/1926 Newman
(Continued)

FOREIGN PATENT DOCUMENTS

AU 200511300 9/2005
AU 2020100586 5/2020
(Continued)

OTHER PUBLICATIONS

YouTube video by Robert Marazzita: The Best Beach Cabana—Set Up and Tear Down, Jul. 9, 2015, [site visited Aug. 8, 2017], Available on the Internet URL: <https:www.youtube.com/watch?v=LfccH7yV6SE>.
(Continued)

*Primary Examiner* — Noah Chandler Hawk
(74) *Attorney, Agent, or Firm* — Womble Bond Dickinson (US) LLP

(57) ABSTRACT

A system for providing shade onto a surface is disclosed, where the system includes at least one frame that includes a plurality of sections configured for engagement in an end-to-end alignment to provide the frame in a supporting configuration; a canopy defining a length and a width, the canopy being supportable by the at least one frame in the supporting configuration such that the frame extends along the length of the canopy or along the width of the canopy; and a plurality of anchors engageable with one or both of the canopy and the frame, at least one of the plurality of anchors being engageable with a corner of the canopy, wherein, in the supporting configuration, the canopy is supported by the frame and the plurality of anchors and is at least partially supportable by wind for providing shade onto the surface.

20 Claims, 31 Drawing Sheets

(56) References Cited

U.S. PATENT DOCUMENTS 2,055,044 A 9/1936 Nelson
2,186,510 A 1/1940 Walter et al.
2,190,566 A 2/1940 Julian
2,193,469 A 3/1940 Ashton
2,554,688 A 5/1951 Vollweiler
2,963,031 A 12/1960 Carroll
3,042,053 A 7/1962 Gabriel
3,051,185 A 8/1962 Reynolds
3,052,249 A 9/1962 Seaman et al.
3,070,107 A 12/1962 Beatty
3,075,536 A 1/1963 Parker
3,165,110 A 1/1965 Brooks
3,190,300 A 6/1965 Wear'n
3,261,134 A 7/1966 Crist
3,286,962 A 11/1966 Warth
3,388,711 A 6/1968 Huddle
3,394,720 A 7/1968 Moss
3,970,096 A 7/1976 Nicolai
4,098,281 A 7/1978 Bonfilio
D256,829 S 9/1980 Qui et al.
4,312,371 A 1/1982 Koon
D263,984 S 4/1982 Moss
4,404,980 A 9/1983 Wade
4,534,089 A 8/1985 Swan
4,590,956 A 5/1986 Griesenbeck
4,612,948 A 9/1986 Simpson
D287,041 S 12/1986 Gitchel et al.
4,646,770 A 3/1987 Lobato
4,708,078 A * 11/1987 Legaignoux ..... B64D 17/025 244/145
4,739,784 A 4/1988 Fast
4,750,508 A 6/1988 Tatoian
4,829,694 A 5/1989 Oasheim
4,832,304 A 5/1989 Morgulis
4,915,120 A 4/1990 Ziolkowski
4,924,893 A 5/1990 Furey
4,930,534 A 6/1990 Hill
4,941,422 A 7/1990 Muller
5,046,699 A 9/1991 Perreault et al.
D321,924 S 11/1991 Bonner
5,080,123 A 1/1992 Stein
5,215,109 A 6/1993 Kent, Jr.
5,291,640 A 3/1994 Rise
5,299,590 A 4/1994 Deibert et al.
5,358,209 A 10/1994 Ward
D363,755 S 10/1995 Diederich
5,546,971 A 8/1996 Leonhardt
5,595,203 A 1/1997 Espinosa
5,678,704 A 10/1997 Deeds
5,690,134 A 11/1997 McCauley
D390,730 S 2/1998 Gerhart et al.
5,771,912 A 6/1998 Swetish
D397,401 S 8/1998 Diederich
D398,363 S 9/1998 LoBue
5,823,217 A 10/1998 Rice
D400,949 S 11/1998 Gale
5,927,311 A 7/1999 Jager
5,950,649 A 9/1999 Gerig
D420,751 S 2/2000 Powell et al.
6,026,613 A 2/2000 Quiring et al.
D421,532 S 3/2000 Koroncai
6,062,243 A 5/2000 Touch et al.
D438,589 S 3/2001 Brown
D438,929 S 3/2001 Middleton et al.
6,209,149 B1 4/2001 Song et al.
6,272,695 B1 8/2001 Brandner
6,276,382 B1 8/2001 Bindschatel et al.
6,286,531 B1 9/2001 Joo-Tai
6,321,861 B1 11/2001 Leichter
6,402,220 B2 6/2002 Allen
6,434,891 B1 8/2002 Cameron
6,964,277 B2 11/2005 Naber
7,021,866 B2 4/2006 Keefe
7,191,996 B2 3/2007 Patsalaridis
D544,062 S 6/2007 Baker
D555,748 S 11/2007 Gyr et al.
7,316,239 B2 1/2008 Yang
7,406,977 B1 8/2008 Shires
D577,092 S 9/2008 West
D593,315 S 6/2009 Zemel
D601,653 S 10/2009 Kirkham, Jr.
D605,308 S 12/2009 Combs
7,654,277 B1 2/2010 Brewer et al.
7,708,339 B2 5/2010 Zapater
7,721,361 B1 5/2010 Shubert
D624,623 S 9/2010 Viglione
7,789,097 B1 9/2010 Sotirkys et al.
D630,834 S 1/2011 Cohen
D638,954 S 5/2011 Nichols
D670,003 S 10/2012 Lovely, II
8,424,549 B1 4/2013 Goldsmith et al.
D681,762 S 5/2013 Kayser
D681,765 S 5/2013 Kayser
8,453,664 B2 6/2013 Parsons et al.
8,720,461 B2 5/2014 Nichols
8,899,251 B2 12/2014 Leung et al.
8,991,411 B1 3/2015 Neuman
9,051,755 B2 6/2015 Heining et al.
9,051,756 B1 6/2015 Jenkins
9,103,137 B2 8/2015 Williams
9,113,724 B1 8/2015 Heining et al.
D739,555 S 9/2015 McAlister
D741,437 S 10/2015 Zimmer et al.
9,187,924 B1 11/2015 Jackson et al.
9,371,641 B2 6/2016 Christensen et al.
D761,372 S 7/2016 Cihal
9,394,719 B2 7/2016 Choi
9,394,721 B2 7/2016 Hotes et al.
9,435,133 B2 9/2016 Bourland
9,447,599 B1 9/2016 Parent
9,506,268 B1 11/2016 Bright et al.
D788,319 S 5/2017 LeMoine et al.
9,903,134 B2 2/2018 Munnerlyn
D823,419 S 7/2018 Ceccaldi
10,066,417 B1 9/2018 Linyard et al.
D829,839 S 10/2018 Crimi
10,174,507 B1 1/2019 Henbid et al.
10,190,330 B2 1/2019 Barnes et al.
D843,200 S 3/2019 Tjerrild
D844,824 S 4/2019 LeMoine et al.
10,252,778 B1 4/2019 Greer
D859,808 S 9/2019 Goldszer
D877,486 S 3/2020 Chen
10,602,817 B2 3/2020 Price
D884,816 S 5/2020 Goldberg
D914,827 S 3/2021 Koehler
D920,461 S 5/2021 Yang
D928,899 S 8/2021 Zhu
11,156,012 B2 10/2021 Graham
11,219,286 B2 1/2022 Cox
D947,411 S 3/2022 Climent Bonet et al.
D947,975 S 4/2022 Lah
D948,653 S 4/2022 Lah
D960,277 S 8/2022 Lah
11,401,729 B2 * 8/2022 Cangemi ..... E04H 15/36
D973,572 S 12/2022 Min
D973,824 S 12/2022 Wu
11,634,924 B2 4/2023 Barnes et al.
D985,801 S 5/2023 Collins
D989,350 S 6/2023 Barnes et al.
D990,605 S 6/2023 Barnes et al.
11,686,120 B1 6/2023 Yates
D993,454 S 7/2023 McKenna et al.
D993,455 S 7/2023 McKenna et al.
2003/0066550 A1 4/2003 Al-Ghamdi
2003/0089390 A1 5/2003 Seo
2007/0079857 A1 4/2007 Tseng
2007/0221261 A1 9/2007 Bean
2007/0295380 A1 12/2007 Glaeser
2010/0212709 A1 8/2010 Sotirkys et al.
2012/0291830 A1 11/2012 Crimi
2013/0074894 A1 3/2013 Cook
2014/0014151 A1 * 1/2014 Wolfe ..... E04H 15/16 135/97

(56) References Cited

U.S. PATENT DOCUMENTS

| | | | | |
|---|---|---|---|---|
| 2014/0020727 | A1 | 1/2014 | Kayser | |
| 2014/0041703 | A1 | 2/2014 | Funston | |
| 2014/0209132 | A1 | 7/2014 | Landry | |
| 2015/0040957 | A1 | 2/2015 | Mallookis et al. | |
| 2015/0108295 | A1 | 4/2015 | Brooks | |
| 2015/0252585 | A1 | 9/2015 | Mallookis et al. | |
| 2015/0354244 | A1 | 12/2015 | Gonzalez | |
| 2016/0017631 | A1 | 1/2016 | Gilmore | |
| 2016/0053508 | A1 | 2/2016 | Gutwenger et al. | |
| 2017/0362849 | A1 | 12/2017 | Munnerlyn | |
| 2018/0106064 | A1 | 4/2018 | Barnes et al. | |
| 2018/0245367 | A1 | 8/2018 | Grieshop | |
| 2020/0221835 | A1* | 7/2020 | Cox | E04H 15/28 |
| 2021/0293046 | A1 | 9/2021 | Barnes et al. | |
| 2022/0024290 | A1 | 1/2022 | Howard | |
| 2023/0096848 | A1 | 3/2023 | Wang | |
| 2023/0126867 | A1 | 4/2023 | Barnes et al. | |
| 2023/0151636 | A1 | 5/2023 | Li et al. | |
| 2023/0235592 | A1* | 7/2023 | Michel | E04H 15/28 135/115 |

FOREIGN PATENT DOCUMENTS

| | | | | |
|---|---|---|---|---|
| BR | 302019005581 | | 12/2019 | |
| CA | 2524310 | | 4/2006 | |
| CH | 130505 | | 5/2004 | |
| CH | 132260 | | 12/2005 | |
| DE | 10 2009 020 795 | | 11/2010 | |
| FR | 2 884 844 | | 4/2005 | |
| KR | 10-1315166 | | 10/2013 | |
| WO | WO 82/03317 | | 10/1982 | |
| WO | WO 02/04768 | | 1/2002 | |
| WO | WO 2011/012969 | A2 | 2/2011 | |
| WO | WO 2020/089599 | | 5/2020 | |
| WO | WO-2020089599 | A1 * | 5/2020 | A45B 23/00 |
| WO | WO 2022/174316 | | 8/2022 | |

OTHER PUBLICATIONS

YouTube video by Robb's Homemade Life: Make $15 Beach Shade tent Easy Quick DIY, Oct. 6, 2015 [site visited Aug. 8, 2017] Available on the internet URL: <www.youtube.com/watch?v+X20b4pLJxlc>.

YouTube video by Beachspirit: Kitent (R)—the Floating beach tent for sun shade, Oct. 8, 2016 [site visited Aug. 8, 2017] Available on the internet URL: <https://m.youtube.com/watch?v=OUaDZeqdTkQ>.

YouTube video by ZiggyShade Beach Sunshade: Ziggy Shade—Beach Sunshade—Set up instructions, Nov. 24, 2016 [site visited Aug. 8, 2017] Available on the internet URL: https://youtu.be/1krQOrlumws>.

YouTube video by bibitedog: How to set up a butterfly arch, May 26, 2012 [site visited Dec. 18, 2018] Available on the internet URL: https://www.youtube.com/watch?v=FOTYtjQAL4s>.

Suniela Beach Portable Shade Cabanas, [site visited Oct. 21, 2021], Available on the internet URL: <https://suniela.com>.

Solbello Shade Training Video, YouTube, Apr. 20, 2023, https://www.youtube.com/watch?v=wd3XV9hADZc.

"No. Wind Kit for Beach Shades," Upgrade Your Shade, https://www.upgradeyourshade.com/product/upgrade-your-shade-kit Retrieved 2023.

Shibumi Shade, posted Oct. 12, 2018 [online], [retrieved Jan. 19, 2023], Retrieved from internet, https://www.facebook.com/shibumishade/ (Year: 2018).

How to Reinforce a Hole in Sunbrella (Registered), webpage <https://www.sailrite.com/How-to-Reinforce-a-Hole-in-Sunbrella>, 1 page, Oct. 16/2023 (Year: 2023).

Kammok Tarp Shelters [retrieved from internet on Aug. 5, 2025] <URL:https://web.archive.org/web/20211018142922mp_/https://www.rei.com/b/kammok/c/tarp-shelters>, published on Oct. 18, 2021 as per Wayback Machine.

* cited by examiner

SUN SHADING SYSTEMS

CROSS-REFERENCE TO RELATED APPLICATIONS

This application claims priority to U.S. Provisional Application No. 63/270,310, filed Oct. 21, 2021, and entitled, "SUN SHADING SYSTEMS," this application being incorporated herein by reference in its entirety.

TECHNOLOGICAL FIELD

The presently disclosed subject matter is directed towards a sun shading system for providing shade from the sun in high wind and no wind situations.

BACKGROUND

Avoiding direct sunlight when outdoors is a ubiquitous problem faced by anyone who spends significant time outdoors. Shading systems of the prior art are typically ineffective or impractical to use for a number of reasons. Some systems include rigid canopy susceptible to being shifted or unanchored by wind. Other systems are cumbersome to transport or assemble, due to the number of parts involved, steps required during setup and/or low shade to weight ratios.

Further, for some systems comprising a canopy supported by a singular frame and an engaged counterweight, at least a 3-4 mile per hour wind is required in order to aerially suspend the canopy from the singular frame. Thus, in conditions where the wind speed is de minimis (i.e., less than about 3 miles per hour) then the canopy may not be sufficiently aerially suspended and the sun shading system may not provide adequate shade. Further, in conditions where the wind speed is high (e.g., about 15 miles per hour or greater), the aerially suspended canopy may be noisy as the wind travels through the fabric.

Accordingly, there remains a need for sun shading systems capable of being used in de minimis wind speed conditions, no wind conditions, and high wind conditions, in addition to moderate wind speeds of about 3 to about 15 miles per hour, and that are capable of being at least partially supported by wind and configured for ease of transport and assembly.

BRIEF SUMMARY

The present disclosure relates to sun shading systems. The present disclosure includes, without limitation, the following example embodiments.

Example Embodiment 1: A system for providing shade onto a surface, the system comprising: at least one frame that includes a plurality of sections configured for engagement in an end-to-end alignment to provide the frame in a supporting configuration with a left end that is engageable with the surface and a right end that is engageable with the surface; a canopy defining a length extending between a first lateral side and a second lateral side and defining a width extending between a first end and an opposing second end, the canopy being supportable by the at least one frame in the supporting configuration such that the frame extends along the length of the canopy or along the width of the canopy; and a plurality of anchors engageable with one or both of the canopy and the frame, at least one of the plurality of anchors being engageable with a corner of the canopy defined at the intersection of the first or second ends with the first or second lateral sides, wherein, in the supporting configuration, the canopy is supported by the frame and the plurality of anchors and is at least partially supportable by wind for providing shade onto the surface.

Example Embodiment 2: The system of Example Embodiment 1, or any combination of preceding example embodiments, further comprising a container for housing and transporting at least one of the components of the system.

Example Embodiment 3: The system of Example Embodiment 2, or any combination of preceding example embodiments, wherein the container, in one configuration, houses and transports the system and, in another configuration, houses weight and acts as at least one of the plurality of anchors.

Example Embodiment 4: The system of Example Embodiment 1, or any combination of preceding example embodiments, further comprising a plurality of cords, each of the cords being engageable between one or both of the canopy and the frame, and the anchors.

Example Embodiment 5: The system of Example Embodiment 1, or any combination of preceding example embodiments, wherein at least one of the plurality of anchors comprises a weight, a corkscrew, a stake, a bungee cord, a tie-down, a magnetic fastener, or any combination thereof.

Example Embodiment 6: The system of Example Embodiment 1, or any combination of preceding example embodiments, wherein the canopy defines at least one channel extending along one or both of the length of the canopy and the width of the canopy, the at least one channel being arranged to receive the frame.

Example Embodiment 7: The system of Example Embodiment 1, or any combination of preceding example embodiments, further comprising a cable extending through at least one of the plurality of the sections of the frame.

Example Embodiment 8: The system of Example Embodiment 1, or any combination of preceding example embodiments, wherein the frame is directly engageable with the surface in the supporting configuration.

Example Embodiment 9: The system of Example Embodiment 1, or any combination of preceding example embodiments, further comprising a fastener coupled to one or both of the canopy and the frame to secure the frame to the canopy in the supporting configuration.

Example Embodiment 10: The system of Example Embodiment 1, or any combination of preceding example embodiments, wherein at least one of the corners of the canopy is elastic.

Example Embodiment 11: The system of Example Embodiment 1, or any combination of preceding example embodiments, further comprising one or more battens or inflatable bladders extending along one or both of the length of the canopy and the width of the canopy.

Example Embodiment 12: A system for providing shade onto a surface, the system comprising: a first frame that includes a plurality of sections configured for engagement in an end-to-end alignment to provide the first frame in a supporting configuration with a left end that is engageable with the surface and a right end that is engageable with the surface; a canopy defining a length extending between a first lateral side and a second lateral side and defining a width extending between a first end and an opposing second end, the canopy being supportable by the first frame in the supporting configuration such that the first frame extends along the length of the canopy or along the width of the canopy; a second vertical frame that includes at least one section configured with a bottom end that is engageable with the surface and a top end that is engageable with the canopy at a midpoint defined between the first end and the second end or at a midpoint defined between the first lateral side and the second lateral side of the canopy; and a plurality of anchors engageable with one or more of the first frame, the second frame, and the canopy, at least one of the plurality of anchors being engageable with a corner of the canopy defined at an intersection of the first or second ends with the first or second lateral sides, wherein, in the supporting configuration, the canopy is supported by the first frame, the second frame, and the plurality of anchors and is at least partially supportable by wind for providing shade onto the surface.

Example Embodiment 13: The system of Example Embodiment 12, or any combination of preceding example embodiments, further comprising a container for housing and transporting at least one of the components of the system.

Example Embodiment 14: The system of Example Embodiment 13, or any combination of preceding example embodiments, wherein the container, in one configuration, houses and transports the system and, in another configuration, houses weight and acts as one of the plurality of anchors.

Example Embodiment 15: The system of Example Embodiment 12, or any combination of preceding example embodiments, further comprising a plurality of cords, each of the cords being engageable between one or more of the canopy, the first frame, and the second frame, and the anchors.

Example Embodiment 16: The system of Example Embodiment 12, or any combination of preceding example embodiments, wherein at least one of the plurality of anchors comprises a weight, a corkscrew, a stake, a bungee cord, a tie-down, a magnetic fastener, or any combination thereof.

Example Embodiment 17: The system of Example Embodiment 12, or any combination of preceding example embodiments, wherein the canopy defines at least one channel extending along one or both of the length of the canopy and the width of the canopy, the at least one channel being arranged to receive the first frame.

Example Embodiment 18: The system of Example Embodiment 12, or any combination of preceding example embodiments, further comprising a first cable extending through at least one of the plurality of the sections of the first frame, and a second cable extending through at least one of the plurality of sections of the second frame.

Example Embodiment 19: The system of Example Embodiment 12, or any combination of preceding example embodiments, wherein one or both of the first frame and the second frame is directly engageable with the surface.

Example Embodiment 20: The system of Example Embodiment 12, or any combination of preceding example embodiments, further comprising a fastener coupled to one or more of the canopy, the first frame, and the second frame to secure the first and second frames to the canopy in the supporting configuration.

Example Embodiment 21: The system of Example Embodiment 12, or any combination of preceding example embodiments, wherein at least one of the corners of the canopy is elastic.

Example Embodiment 22: The system of Example Embodiment 12, or any combination of preceding example embodiments, further comprising one or more battens or inflatable bladders extending along one or both of the length of the canopy and the width of the canopy.

Example Embodiment 23: The system of Example Embodiment 12, or any combination of preceding example embodiments, wherein, in the supporting configuration, the first frame extends along the length of the canopy at the first end and the second vertical frame is engaged with the canopy proximate to the second end of the canopy and at the midpoint defined between the first lateral side and the second lateral side of the canopy, and wherein a first anchor of the plurality of anchors is engaged with one or both of the first frame and the canopy, a second anchor of the plurality of anchors is engaged with a first corner of the canopy defined at the intersection between the second end and the first lateral side of the canopy, a third anchor of the plurality of anchors is engaged with a second corner of the canopy defined at the intersection between the second end and the second lateral side of the canopy, and a fourth anchor is engaged with one or both of the second end of the canopy at the midpoint defined between the first lateral side and the second lateral side of the canopy and the second vertical frame.

Example Embodiment 24: A system for providing shade onto a surface, the system comprising: a first frame and a second frame, each including a plurality of sections configured for engagement in an end-to-end alignment from a left end to a right end to provide the first frame and the second frame each in a supporting configuration, wherein in the supporting configuration, the left ends of the first frame and the second frame are coupleable to one another and engageable with the surface and the right ends of the first frame and the second frame are coupleable to one another and engageable with the surface; a canopy defining a length extending between a first lateral side and a second lateral side, the canopy being supportable by the first frame and the second frame in the supporting configuration such that the first frame extends along the length of the canopy at a first end of the canopy or an opposing second end of the canopy and the second frame extends along the length of the canopy at the other of the first end or the second end of the canopy; a longitudinally-extending support member that includes at least one section configured with opposing first and second ends, the first opposing end being coupleable at the coupled left ends of the first and second frames and the second opposing end being coupleable at the coupled right ends of the first and second frames such that in the supporting configuration the longitudinally-extending support member extends between the respectively coupled left and right ends of the first and second frames; and a plurality of anchors engageable with one or more of the canopy, the first frame, and the second frame, at least one of the plurality of anchors being engageable with one or more of the first frame, the second frame, and the canopy at a midpoint defined between the first end and the second end or at a midpoint defined between the first lateral side and the second lateral side, wherein, in the supporting configuration, the canopy is supported by the first frame, the second frame, and the plurality of anchors and is at least partially supportable by wind for providing shade onto the surface.

Example Embodiment 25: The system of Example Embodiment 24, or any combination of preceding example embodiments, further comprising a container for housing and transporting at least one of the components of the system.

Example Embodiment 26: The system of Example Embodiment 25, or any combination of preceding example embodiments, wherein the container, in one configuration, houses and transports the system and, in another configuration, houses weight and acts as one of the plurality of anchors.

Example Embodiment 27: The system of Example Embodiment 24, or any combination of preceding example embodiments, further comprising a plurality of cords, each of the cords being engageable between one or more of the canopy, the first frame, and the second frame, and the anchor.

Example Embodiment 28: The system of Example Embodiment 24, or any combination of preceding example embodiments, wherein at least one of the plurality of anchors comprises a weight, a corkscrew, a stake, a bungee cord, a tie-down, a magnetic fastener, or any combination thereof.

Example Embodiment 29: The system of Example Embodiment 24, or any combination of preceding example embodiments, wherein the canopy defines a first channel extending along the length of the canopy at the first end of the canopy and a second channel extending along the length of the canopy at the second end of the canopy, the first and second channels being arranged to receive the first frame and the second frame, respectively.

Example Embodiment 30: The system of Example Embodiment 24, or any combination of preceding example embodiments, further comprising a first cable extending through the plurality of the sections of the first frame, and a second cable extending through the plurality of sections of the second frame.

Example Embodiment 31: The system of Example Embodiment 24, or any combination of preceding example embodiments, wherein the coupled left and right ends of the first and second frames are directly engageable with the surface.

Example Embodiment 32: The system of Example Embodiment 24, or any combination of preceding example embodiments, further comprising a fastener coupled to one or more of the canopy, the first frame, and the second frame to secure the first and second frames to the canopy in the supporting configuration.

Example Embodiment 33: The system of Example Embodiment 24, or any combination of preceding example embodiments, further comprising one or more battens or inflatable bladders extending along one or both of the length of the canopy and a width of the canopy between the first end and the second end.

It will be appreciated that the above Summary is provided merely for purposes of summarizing some example aspects so as to provide a basic understanding of some aspects of the disclosure. As such, it will be appreciated that the above described example aspects are merely examples of some aspects and should not be construed to narrow the scope or spirit of the disclosure in any way. It will be appreciated that the scope of the disclosure encompasses many potential aspects, some of which will be further described below, in addition to those here summarized. Further, other features, aspects, and advantages of the disclosure will be apparent from a reading of the following detailed description taken in conjunction with the accompanying drawings which illustrate, by way of example, the principles of the described aspects.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

DETAILED DESCRIPTION

Figure 1:
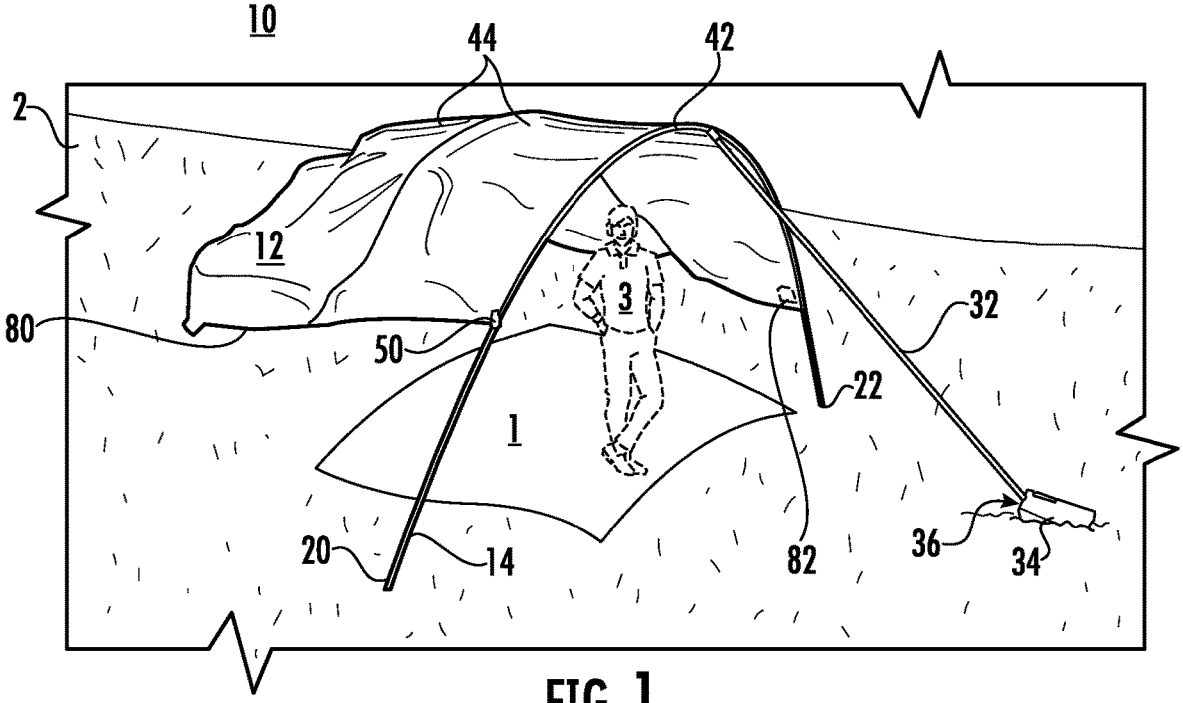
FIG. 1 is a perspective view of a system for providing shade according to one or more embodiments of the presently disclosed subject matter.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure. It is understood that such terms are not used in any absolute sense.

One example embodiment of a sun shading system is illustrated in FIGS. 1-7. The system, designated as 10, is configured for providing shade 1 onto a surface 2. The system 10 may include a canopy 12 configured for engagement with, and aerial suspension by, a frame 14. The canopy 12 may include one or more lightweight materials, the materials including one or more of the following properties: ripstop, polyester, blackout, light diffusion, light modification, and waterproof. The canopy may have a silicone coating, a down proof coating (e.g., with starch), and/or any other type of coating that helps with sun protection, breathability, sound reduction, stain proofing, mold and mildew resistance, fade resistance, light diffusion, light modification, water proofing, wind resistance, and the like. The canopy 12 may also have the ability to reduce penetration of UV radiation therethrough, and may have a Ultraviolet Protection Factor (UPF) of about 30 or higher, and desirably 50 or higher. The canopy 12 may also comprise a solar fabric with embedded solar cells to generate electricity when exposed to light. The solar cells may comprise photovoltaic cells, silicon-based cells, thin-film cells, organic polymer-based cells, any combination thereof, and the like. The canopy 12 may be a LYCRA®/nylon or polyester blend, mesh, polyester, bamboo, cotton, natural fibers, any combination thereof, and/or similar materials that allow the canopy 12 to work with the wind and not against it. In some example embodiments, the canopy 12 is a lightweight elastic fabric (e.g., a LYCRA®/nylon blend), whereas in some other example embodiments, one or more portions of the canopy 12 may comprise a lightweight elastic fabric while the remaining portions of the canopy 12 may comprise other materials or fabrics, such as mesh, a nylon blend, polyester, bamboo, cotton, natural fibers, any combination thereof, and/or similar materials. For example, one or more (e.g., all) of the corners of the canopy 12 may be a lightweight elastic fabric, whereas the remaining portion of the canopy 12 may be a lightweight polyester or nylon. In another example, one or more panels of the canopy 12 may be a lightweight elastic fabric, while one or more other panels of the canopy 12 may be a lightweight polyester or nylon. The panels may be arranged at corners 13 of the canopy 12, or along a length, width, or diagonally across the canopy. The materials of the canopy 12 may be composed of recycled materials and/or other repurposed materials, such as recycled plastics, plant-based fibers (e.g., potato waste, orange fibers, etc.) The canopy 12 may be unitarily constructed or may include a plurality of coupled sections 44 and/or selectively engageable sections 44. Such a system is also described in one example embodiment in U.S. Pat. No. 10,190,330, the entirety of which is incorporated by reference herein.

The canopy 12 may comprise a shape that is rectangular, square, triangular, circular, pentagonal, hexagonal, octagonal, etc. The canopy 12 may also be irregularly shaped. In some instances, the canopy is rectangularly shaped and is 17 feet by 10 feet, or may be larger or smaller (e.g., about 10 feet by 8 feet). A first end 42 of the canopy may be positioned on one longitudinal side and a second end or trailing end 43 may be positioned on an opposing longitudinal side, where the longitudinal sides are longer than first and second lateral sides 80, 82 extending therebetween. The canopy 12 may be configured to suspend or be stored in any number of shapes and sizes.

According to some embodiments, the canopy 12 may define the first end 42 positioned proximal to the frame 14 when the canopy 12 is engaged with the frame 14. The first end 42 may include one or more suspension fasteners 46 (see FIG. 3) for engaging the canopy 12 with the frame 14. Fasteners 46, 52, 54, as used herein, may include any fasteners of the prior art, including but not limited to hooks and loops, male and female buttons, hook and slit or aperture, and/or magnets. FIG. 4 depicts the canopy 12 defining at least one channel 40 on the first end 42 of the canopy, the channel 40 configured for accepting a portion of the frame 14 therethrough. Although the channel 40 of FIG. 4 extends the entire length of the first end 42, the channel 40, or plurality of channels 40, may only extend a smaller distance of the first end 42. In some embodiments, one or more channels 40 may include tie strings for engaging the first end 42 with the frame 14.

Figure 3:
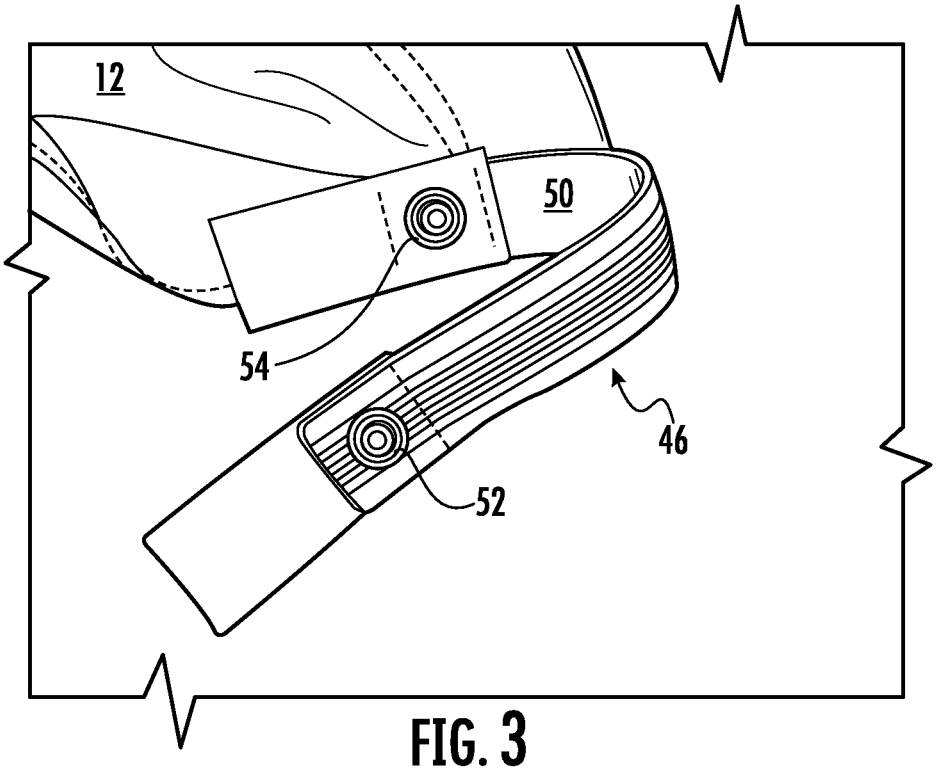
FIG. 3 is a perspective view of at least one strap engageable with a canopy according to one or more embodiments of the presently disclosed subject matter.
Figure 4:
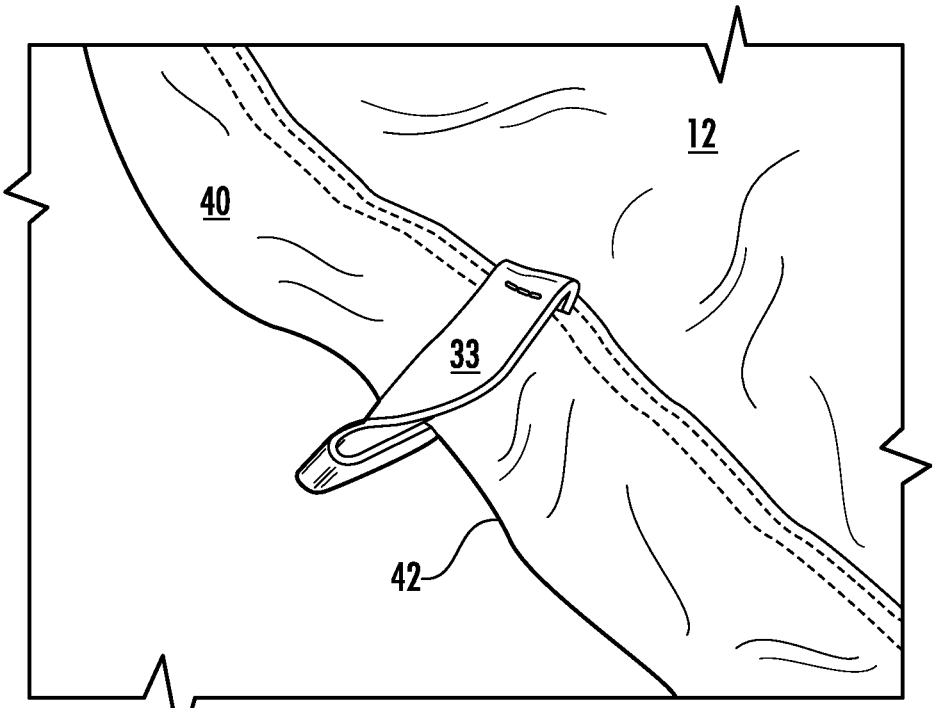
FIG. 4 is a perspective view of a channel coupled to the canopy for engaging a cord according to one or more embodiments of the presently disclosed subject matter.

FIGS. 1 and 3 depict embodiments of the system 10 including at least one fastener 46 in the form of at least one strap 50 engageable with, or coupled to, the canopy 12 for securing the canopy 12 into position relative to the frame 14. The at least one strap 50 may be elastic rubber, gear ties, bungee cord, rope or any other material capable of wrapping about the frame 14 or other component of the system 10. The at least one strap 50 may engage or couple to the canopy 12 on either or both ends of the first end 42 and/or to the channel 40 of the first end 42. Each of the straps 50 may be configured to wrap about the frame 14, or engage the frame 14 using a strap fastener 52 and/or a canopy or frame fastener 54. In some embodiments, the strap 50 may include a canopy fastener 54 for engaging the canopy 12 (e.g., a ball at one end of the strap 50 for engaging a grommeted aperture of the canopy 12), and the strap 50 may be manipulated about the frame 14. Alternatively, the strap 50 may include both a strap fastener 52 on one end and a canopy fastener 54 on the other end for wrapping the strap 50 about the frame 14 and fastening the fasteners 52, 54 together (see, e.g., FIG. 3). In yet another alternative, the strap 50 may include be coupled or engaged to the canopy 12 on one end and include a frame fastener 54 on the other end for engaging the canopy 12 to the frame 14.

The at least one strap 50 may be comprised of any number of materials, including but not limited to one or more of the following: fabric, rubber, plastic, and metal. In some embodiments, the at least one strap 50 may have a higher coefficient of friction with respect to the frame 14 relative to the canopy 12 with respect to the frame 14. For example, if the canopy 12 includes polyester fabric and the at least one strap 50 includes rubber, then the coefficient of friction of a metal or plastic frame 14 would be higher for the strap than for the canopy 12. In some embodiments, the at least one strap 50 may be elastic. Being able to stretch the at least one strap 50 about the frame 14 when engaging the strap 50 thereto can greatly increase the friction between the strap 50 and the frame 14, particularly if the strap 50 is also fastened to itself after wrapping.

Figure 2:
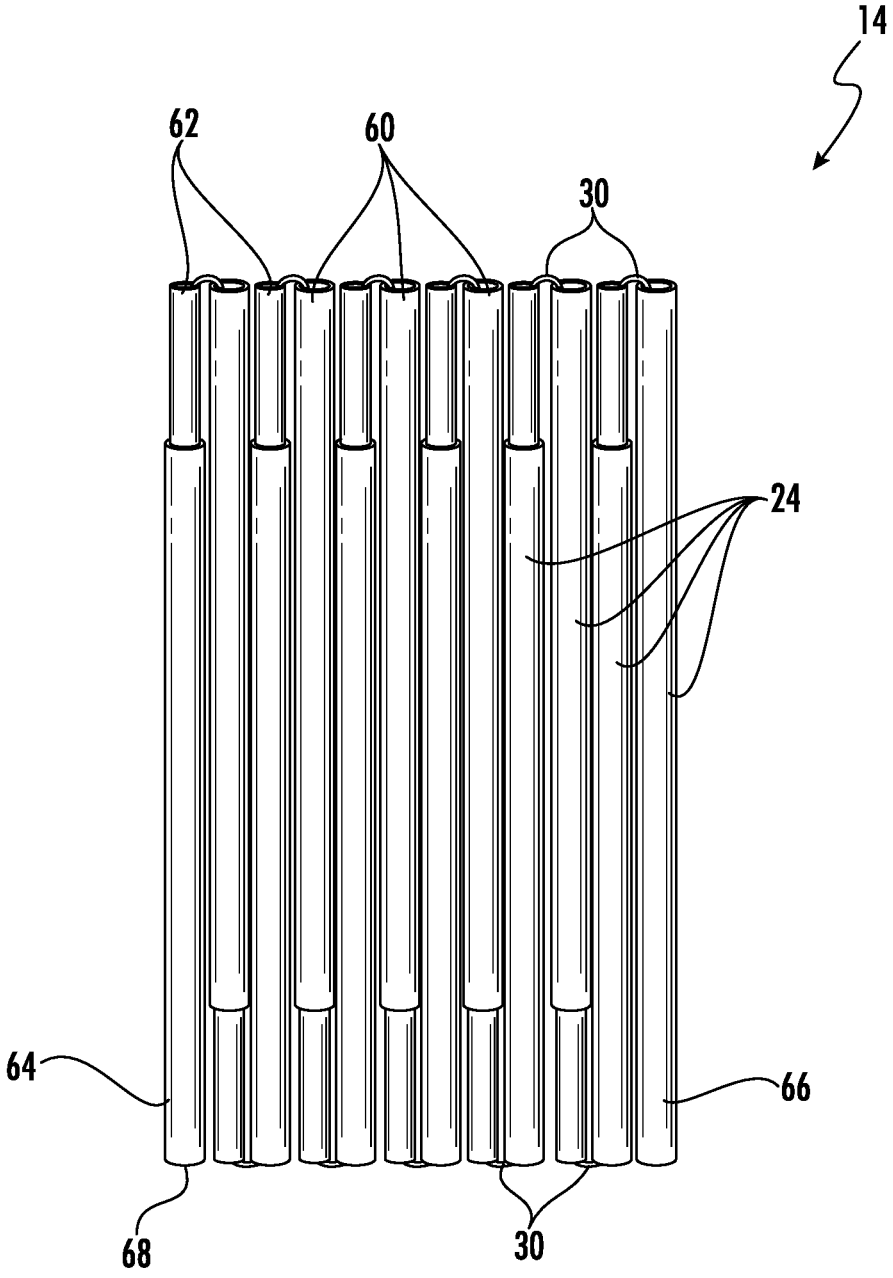
FIG. 2 is a front view of a frame in a transport configuration according to one or more embodiments of the presently disclosed subject matter.

According to some embodiments, and as shown in FIG. 2, the frame 14 of the system 10 may include, or consist essentially of, a plurality of sections 24 configured for end-to-end alignment from a left end 20 of the frame 14 to a right end 22 of the frame 14. The sections 24 may be collapsible, foldable, telescoping, and the like relative to one another such that transport of the system is more compact. Each of the sections 24 may be further configured to engage with any adjacent sections 24. Each of the sections may be the same or may be of a different shape, length, diameter/width, number of segments, materials, rigidity, color, construction, etc. When two or more or all of the sections 24 are aligned end-to-end (i.e., a first end of one section is engaged either directly or indirectly with a second end of an adjacent section) and engaged with adjacent sections 24, the frame 14 may be positioned to receive and support the canopy 12 as a singular frame (i.e., acts as a unitary, supportive structure) and/or within a single plane. In some embodiments, the sections 24 are arranged telescopically, where each adjacent section 24 may be housed within, and extend from each adjacent section 24. In other embodiments, as depicted in FIG. 2, many of the sections include both a male end 62 and a female end 60 for engaging adjacent sections 24 to each other to construct the supporting frame 14. In some embodiments, all but one of the sections 24 includes a female end 60 for accepting a male end 62 of one of the adjacent sections 24 therein. In some other embodiments, the plurality of sections 24 are rigidly formed together. In some other embodiments, the frame 14 consists of a single, monolithic section. In some still further embodiments, the individual sections of the frame 14 are engaged with one another via joints that enable each of the sections of the frame 14 to have a range of motion in one or more planes.

During transport, the sections 24 may be compactly configured as depicted in FIG. 2. A first section 64 may define the left end 20 of the frame 14 and a last section 66 may define the right end 22 of the frame 14. The first section 64 may include a single male end 62 or female end 60, with the other end being the left end 20 and/or cap 68 (FIG. 2 depicts first section 64 having a male end 62 and cap 68). A last section 66 may similarly include a single male end 62 or female end 60, with the other end being the right end 22 and/or cap 68 (FIG. 2 depicts last section 66 having a female end 60 and cap 68). The cap may serve to close off an end of the first and/or last section 64, 66 for preventing sand from entering therein and for securing the cable 30, as described below.

As depicted in FIG. 2, the system 10 may further include a cable 30 extending through the plurality of sections 24 of the frame 12 from the left end 20 to the right end 22. The cable 30 may be elastic so that the sections 24 may be maneuvered between a transport configuration (e.g., FIG. 2) and a supporting configuration (e.g., FIG. 1), yet still remain adjacent and aligned end-to-end, the cable 30 providing supporting tension to the end-to-end alignment of the supporting configuration. The cable 30 may be affixed to an interior and/or cap 68 of the first section 64 and second section 66. The cable 30 may also be affixed to interiors of any of the other sections 24. Instead of or in addition to the cable 30, other alignment components may be utilized such as brackets that engage adjacent sections 24 and allow the sections 24 to be maneuvered between the compact transport configuration and the supporting configuration.

When the frame 14 is in the transport configuration, and a cable 30 extends through the sections 24 of the frame 14, the male and female ends 60, 62, and/or the cable 30 itself, may be configured to prevent degradation or injury to the cable 30. Looking to FIG. 2, any pressure applied to the sections 24 from the top of the figure or the bottom of the figure may create injury to the cable 30 where it is exposed between the male and female ends 60, 62. Therefore, the female ends 60 and/or male ends 62 may define grooves for permitting passage of the cable therebetween such that any objects applying pressure from the top or bottom of the figure would apply that pressure directly to the ends 60, 62 and not onto the cable 30, effectively clipping the cable between the end 60, 62 and the object. The cable 30 may include reinforcements at the exposed sections between the ends 60, 62 when in the transport configuration. The reinforcements may include additional layers of fabric, metal-reinforced cylinders, and/or thicker elastic bands.

In some embodiments of the system 10, the sections 24 of the frame 12 may form an arched shape when in the supporting configuration, and form a flat arch, a round arch, a segmental arch, a horseshoe arch, a pointed horseshoe arch, a three-centered arch, a pseudo three-centered arch, a triangular arch, a rounded horseshoe arch, a three-pointed arch, a pointed segmental arch, a parabolic arch, an inflexed arch, a round rampant arch, a rampant arch, a four-centered arch, a keyhole arch, a reverse ogee arch, an ogee three-centered arch, an ogee four-centered arch, an oriental arch, a round trefoil arch, a shouldered arch, a pointed trefoil arch, a draped arch, a cinquefoil arch, a pointed cinquefoil arch, a multifoil arch, or the like. In other embodiments, the sections 24 may form other shapes or designs when in the supporting configuration. A parabolic arch shape may be formed by the sections 24 when the male and female ends 60, 62 of adjacent sections are co-extensive along a curved axis. To form other designs, the female ends 60 and/or male ends 62 may be shaped for creating non-co-extensive angles with respect to the axis of the remaining portions of the sections 24. For example, a female end 60 engaging two sections may be shaped in a right angle, thereby creating an 'L' shape, a 'T' shape, or an 'I' shape when the two or more adjacent sections are engaged. Other shapes, such as a 'V' shape, an inverted 'V' shape, a 'W' shape, or the like may also be formed by one or more sections 24 of the frame 14. The different sections of the frame 14 may be arranged within one plane in the supporting configuration or may be arranged in different planes. Other female ends 60 may be shaped at other angles, thereby creating a design or pattern when all of the sections 24 are engaged and the frame is in the supporting configuration.

Figure 5:
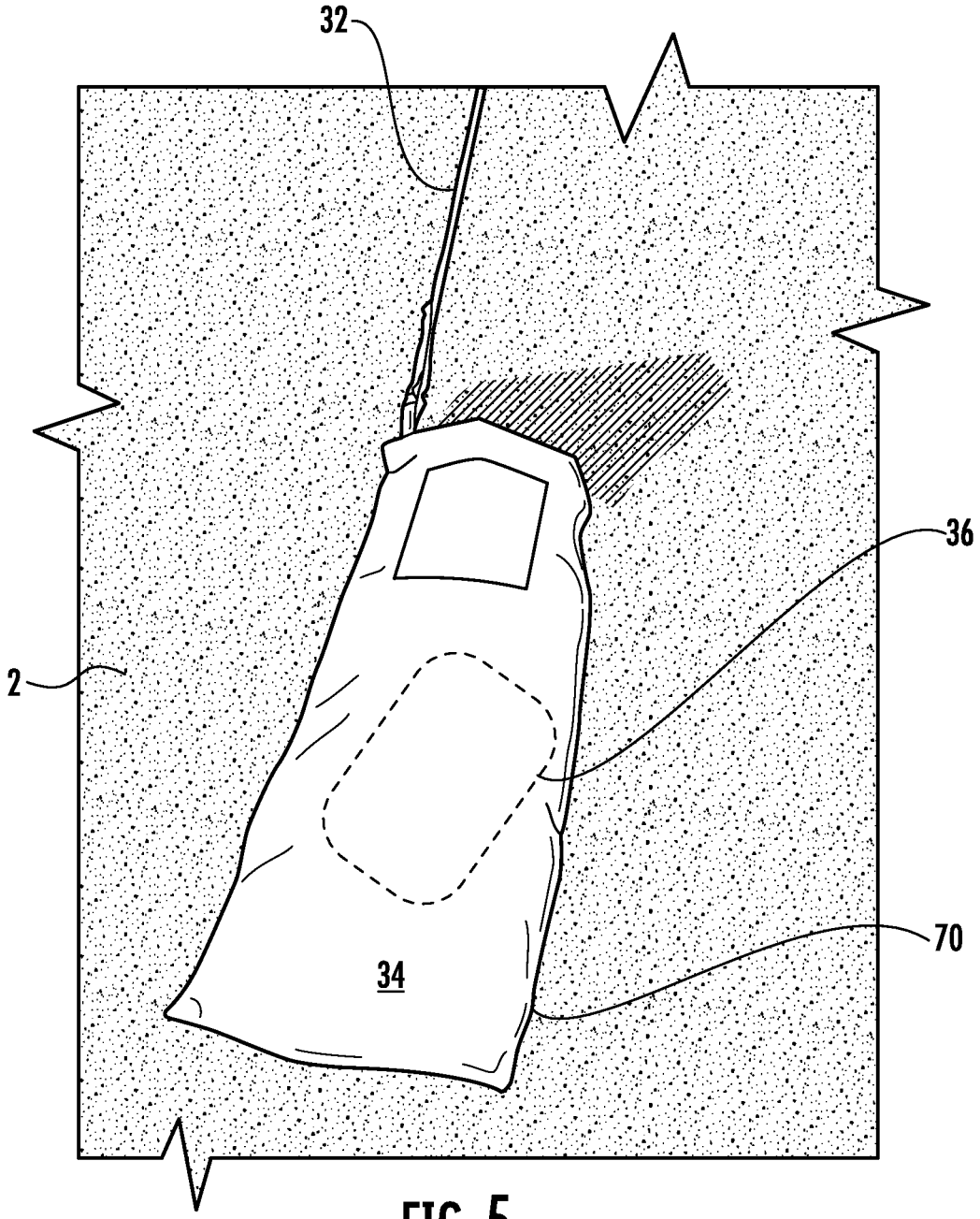
FIG. 5 is a perspective view of a container serving as an anchor according to one or more embodiments of the presently disclosed subject matter.

Referencing FIG. 5, the system 10 may further include a cord 32 engaged with, or coupled to, an anchor 34, the canopy 12, and/or the frame 14 for providing support to the frame 14 when in the supporting configuration. The anchor 34 may be configured for housing weight 36. The cord 32 may be engaged with or coupled to the canopy 12 and/or frame 14 at an apex of the canopy 12 and/or frame 14. For example, if the ends 20, 22 of the frame 14 are secured within sand on a beach, the anchor 34 may be filled with sand acting as the weight 36. The system 10 may further include, as shown in FIG. 4, a hoop 33 or other fastener (e.g., a buttonhole sewn into the canopy 12) such as the fasteners described herein, engaged with, or coupled to, the canopy 12 or frame 14 with which the cord 32 may be engaged or coupled (e.g., see FIG. 4 embodiment where the hoop 33 is coupled to the canopy 12).

Figure 6:
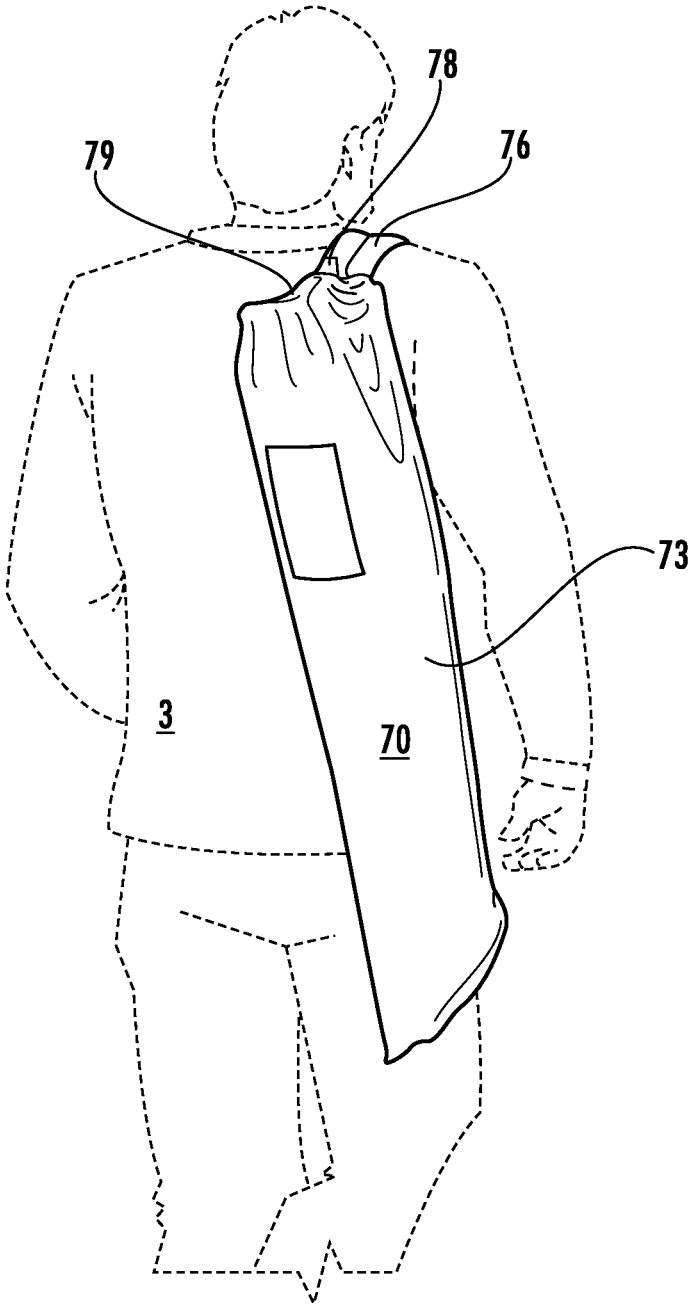
FIG. 6 is a perspective view of the container housing the system for shading according to one or more embodiments of the presently disclosed subject matter.

FIG. 6 depicts an embodiment of the system 10 further including a container 70 for housing and transporting all of the other components of the system 10. The container 70 may include a band 76 for transporting the container 70 about the shoulder or in the palm of a user 3. The band 76 may be configured to be a handle and/or may be selectively engageable with the container 70 for storage therein. The container 70 may include a drawstring 78 or other closing mechanism for securing the contents of the system 10 therewithin. The container 70 may also be carried by hand, may be inverted, and the like.

The container 70 may also be the anchor 34 for housing weight 36 (see, e.g., FIG. 5). In some embodiments, the container 70 may be inverted for housing weight 36 for ensuring that minimal amounts of weight 36 remain in the container once re-inverted so that the contents of the system 10 are not disturbed by any weight 36 during transportation and/or storage of the system 10. The cord 32 may be engaged with or coupled to an interior 72 of the container 70 for inverting the container 70. The cord 32 may be engaged with or coupled to the bottom 74 of the container 70 for permitting full inversion, or at a mid-point 75 of the container 70 for permitting half inversion of the container 70 (see, e.g., FIG. 7). In other embodiments, the cord 32 may be selectively engaged or coupled with an exterior 73 of the container 70.

For example, when the contents of the system 10 are removed from the container 70, the cord 32 may be pulled away from the container 70 while the container 70 is held into position (or pushed away from the cord 32), thereby inverting the container 70 to serve as the anchor 34. When the cord 32 is engaged or coupled to an interior 72 and bottom 74, the pulling of the cord 32 may result in the full inversion of the container 70. When the cord is engaged or coupled to an interior 72 and mid-point 75, the pulling of the cord 32 may result in a half inversion of the container 70. If the container 70 includes a compartment 77 as described herein, then the inversion of the container 70 may result in the compartment 77 being exterior to the anchor 34 and any weight 36.

Figure 7:
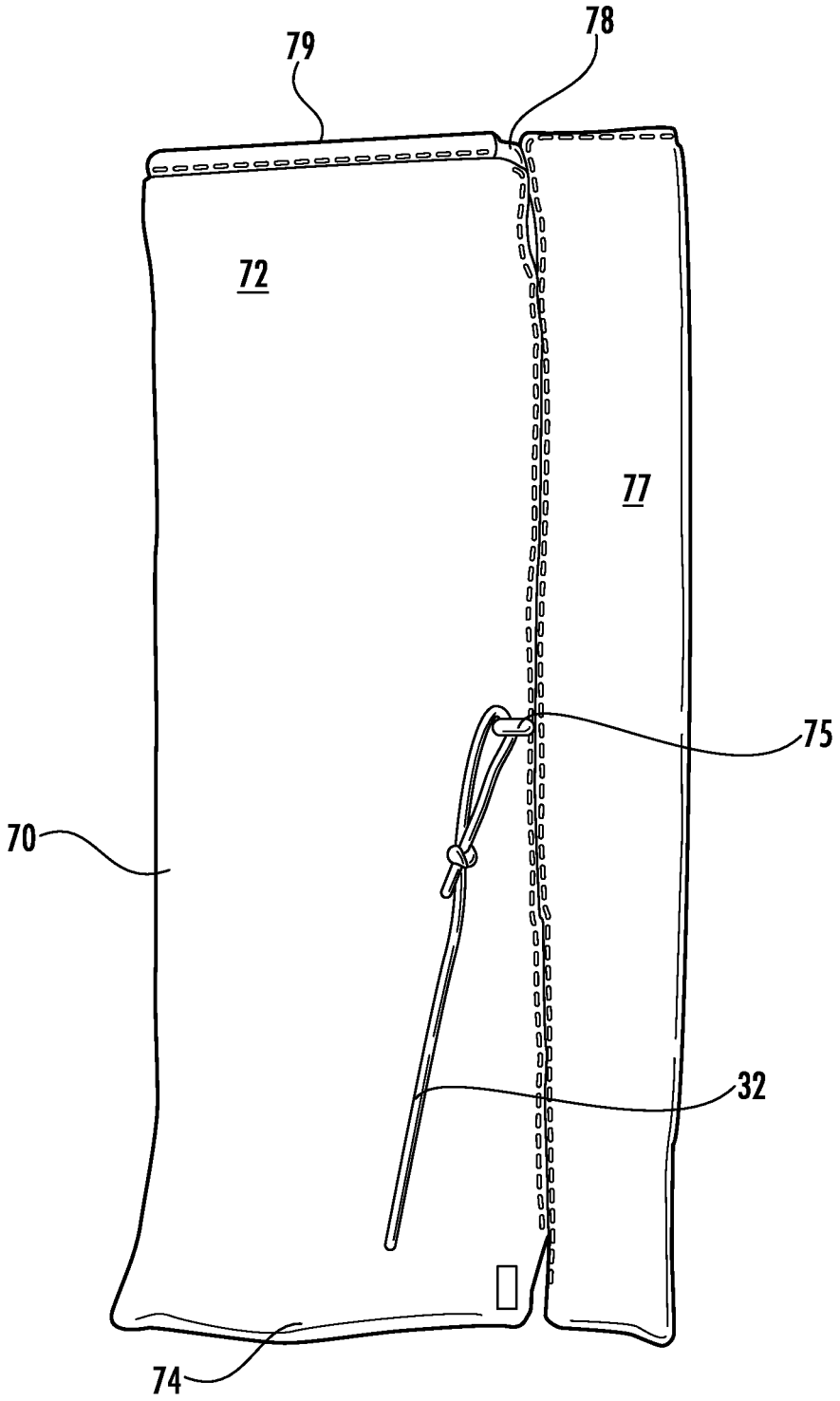
FIG. 7 is a perspective view of the container having a compartment for housing sections of the frame according to one or more embodiments of the presently disclosed subject matter.

FIG. 7 illustrates the container 70 including a compartment 77 positioned on the interior 72 for housing the sections 24 separate from the canopy 12. The compartment 77 may be engageable with or coupled to the interior 72 of the container 70. The compartment 77 may be sewn to the interior 72 of the container 70 along a single seam or multiple seams. A drawstring or other closing mechanism 78 may be included on the container 70 for cinching close an open side 79 of the container. Although FIG. 7 depicts the seam of the compartment 77 only connecting a portion of the compartment length to the container 70, other embodiments may include the entire length of the compartment 77 being sewn to the container 70.

The left end 20 and the right end 22 of the frame 14 may be each be embedded in the surface 2. The ends 20, 22 may define a conical shape or a corkscrew shape for ease of penetration of the surface 2. Additional anchor(s) 35 may be engaged or coupled to the left end 20 and/or right end 22 for further securing the frame 14 into position. In embodiments where a tail is defined by the canopy 12, the tail may be engaged with or coupled to an additional anchor 34 for securing the canopy 12 into position for providing shade 1 to the surface 2.

In addition to the methods of using the system 10 described herein, the following additional methods of using the system 10 are provided. A method of providing shade 1 to a surface 2 may include unpacking or removing the frame 14 and the canopy 12 from the container 70. Adjacent sections 24 of the plurality of sections 24 may be engaged or coupled into end-to-end alignment to configure the frame 14 from a left end 20 to a right end 22 into a supporting configuration. The frame 14 may slide through one or more channels 40 of the canopy 12 and/or may be engaged with the first end 42 of the canopy 12. The ends 20, 22 of the frame 14 may be secured to the surface 2, thereby aerially suspending the canopy 12 and providing shade 1 to the surface 2.

The canopy 12 may be secured into position relative to the frame 14 by wrapping at least one strap 50 about the frame 14 and/or fastening the at least one strap 50 to or about the frame 14. The cord may be engaged with the canopy 12, frame 14 and/or anchor 34. The anchor 34 may be filled with weight 36. Additional anchors 35 may be engaged with the ends 20, 22, additional frame 15 and/or tail of the canopy 12. The additional anchors 35 may be filled with weight 36.

In some example embodiments, and as illustrated in FIGS. 8-12, the second or trailing end 43 may define an additional or second suspension end. The second end 43 may include any of the features and characteristics described herein attributed to the first end 42. For example, the second end 43 may form an additional channel or channel 40 for engaging or coupling an additional frame 15, thereby further suspending the canopy 12 from both the frame 14 and the additional frame 15. Other types of manners for engaging or coupling the frames 14, 15 with the canopy 12 are contemplated herein. The two frames 14, 15 may be similar or different by comprising or having a same shape, length, diameter/width, number of segments, materials, rigidity, color, construction, etc. Alternatively, in some example embodiments, instead of the first and second ends 42, 43, opposing lateral sides 80, 82 of the canopy located between the first and second ends 42, 43 may each include a channel, similar to the channels 40 such that the two frames 14, 15 may be engaged with the lateral sides 80, 82 such that the canopy 12 is suspended by its lateral sides.

Figure 8:
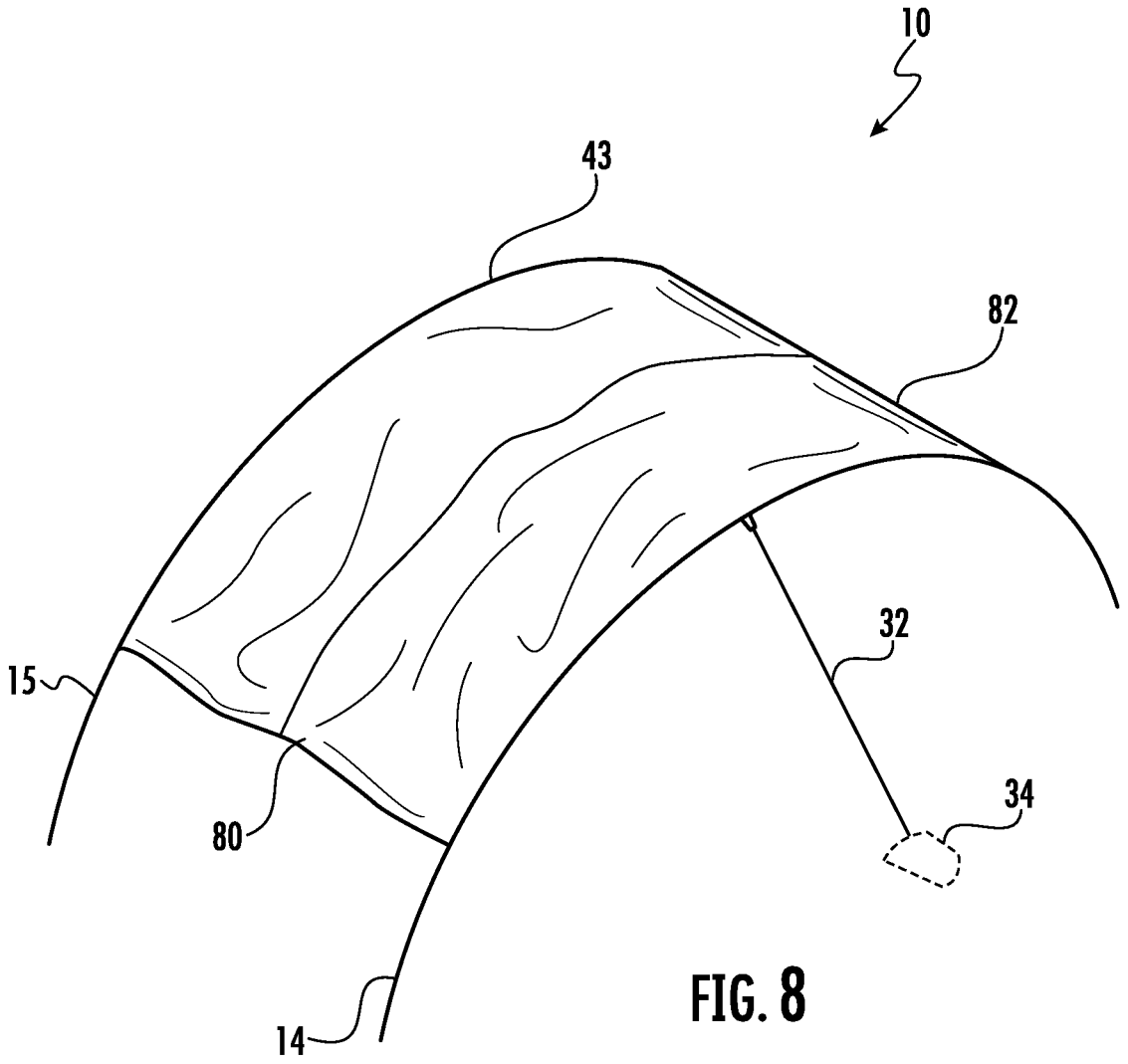
FIG. 8 is a perspective view of a system for providing shade according to one or more embodiments of the presently disclosed subject matter.

As shown in FIG. 8, for example, the frames 14, 15 may be two same or similar types of longitudinally-extending frames, each one being coupled to a respective first and second ends 42, 43. The frames 14, 15 may be comprised of a plurality of individual sections 24 or may be a single section. The frames 14, 15 may be compactly configured in a transport configuration for ease of transport, such as that shown in FIG. 2. An entirety or partial entirety of the first and second ends 42, 43 may be coupled to the respective frame 14, 15, such as, for example, by the channels 40. Other means for coupling the first and second end(s) 42, 43 of the canopy 12 to the frame(s) 14, 15 are also contemplated and may include, for example, hook and loop fasteners, magnets, straps, and the like.

Though shown as being two frames forming a parabolic arch, the two frames may form any similar or different arched shape in the supporting configuration. When the two frames 14, 15 are engaged with the first and second ends 42, 43 of the canopy 12 in the supporting configuration, the two frames may be arranged in two substantially parallel planes. In some example embodiments, the two frames are the same length; though, this is not a necessity. For example, a longer frame may be arranged at the first end 42 of the canopy, while a shorter frame may be arranged at the trailing (suspension) end 43 of the canopy 12, or vice versa.

Figure 9A:
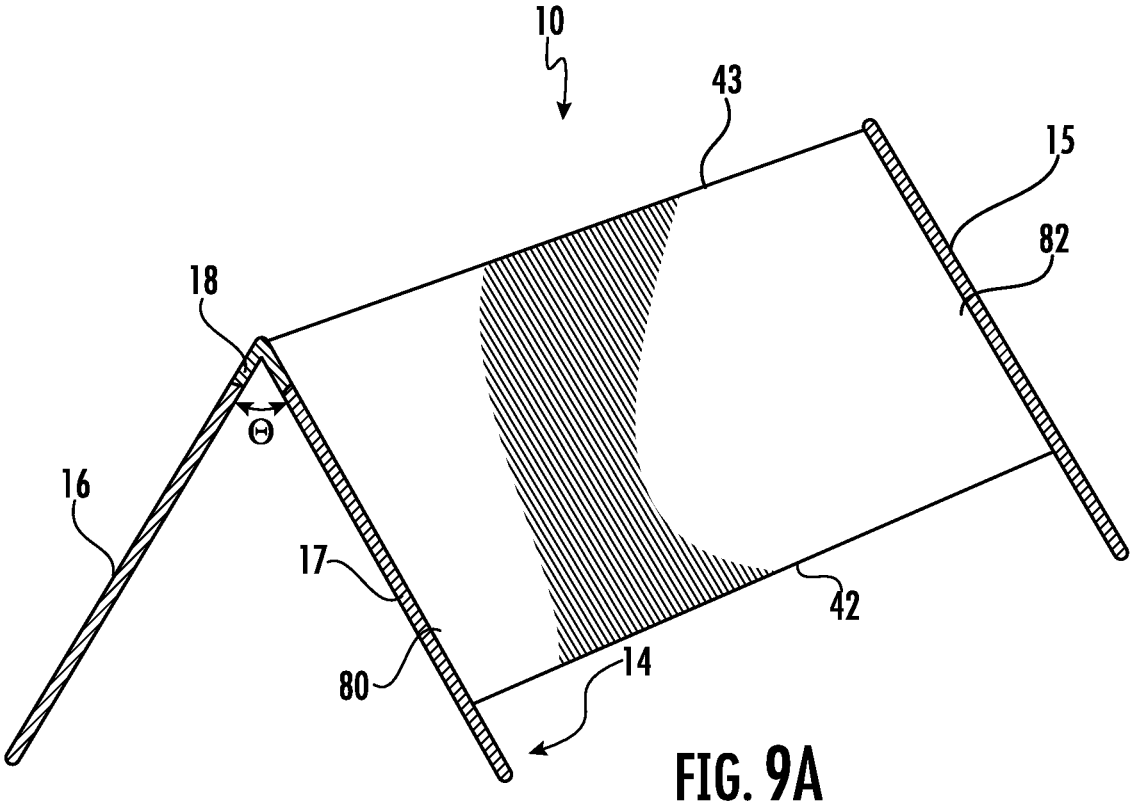
FIG. 9A is a perspective view of a system for providing shade according to one or more embodiments of the presently disclosed subject matter.
Figure 9B:
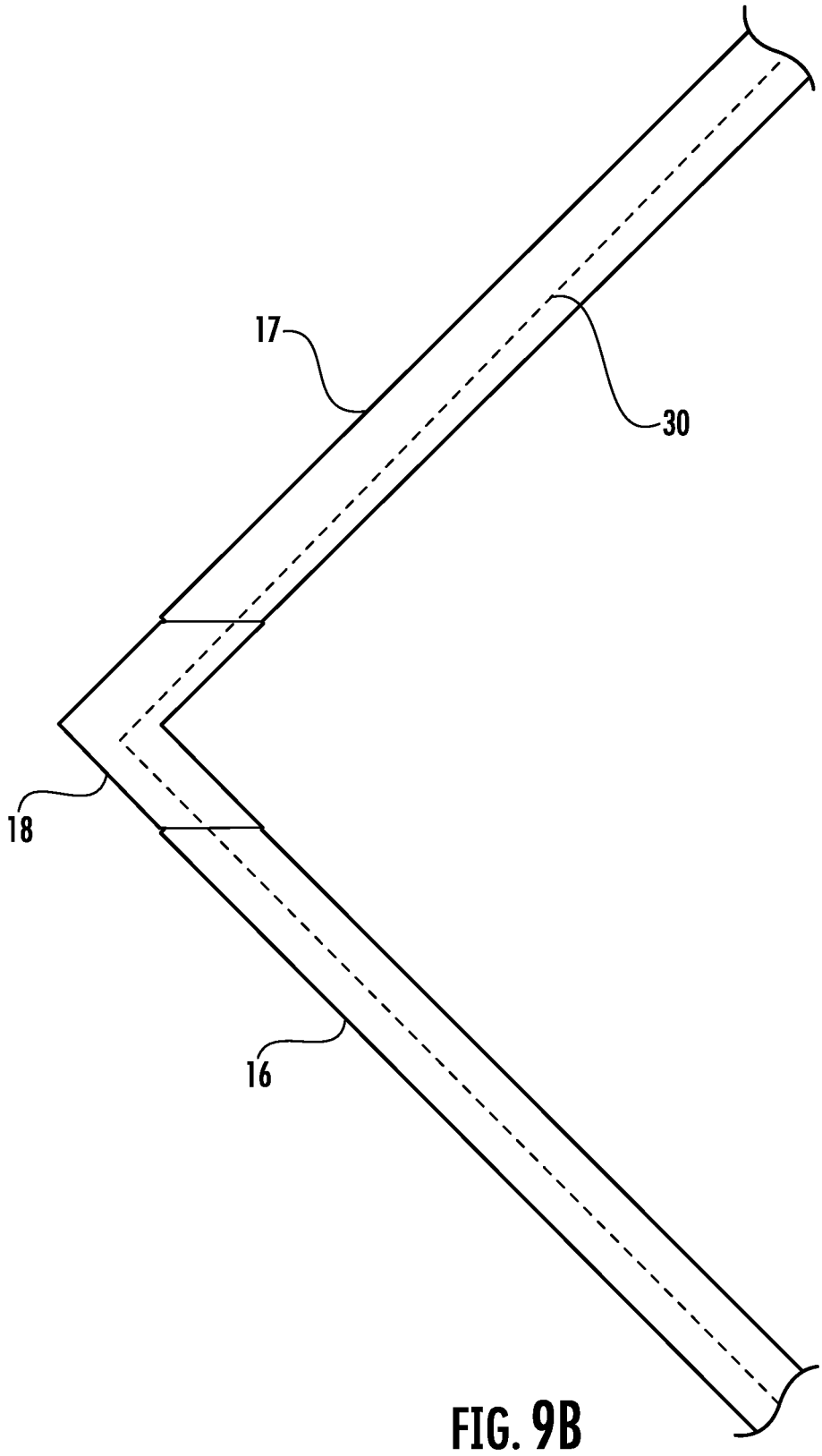
FIG. 9B is detailed front view of an example connecting bracket for the system of FIG. 9A.

In some example embodiments, and as illustrated in FIGS. 9A-9B, the frames 14, 15 may each be shaped to form an inverted 'V' shape. Each of the inverted 'V' shaped frames 14, 15 may have a first end and a second end, which each engage the surface. A vertex may be arranged between the first end and the second end, such that a first portion 16 of the frame extends between a first end and the vertex and a second portion 17 of the frames 14, 15 extends between the second end and the vertex. The first and second portions 16, 17 may thus be angled relative to one another and form an angle θ therebetween of about 25 degrees to about 75 degrees. In the supporting configuration, first and second lateral sides 80, 82 of the canopy 12 are suspended between the frames 14, 15. The canopy 12 may be arranged such that the canopy 12 is substantially evenly distributed or distributed between the two portions 16, 17 of the frames 14, 15, or the first and second lateral sides 80, 82 of the canopy 12 may extend between corresponding first or second portions of each of the two frames 14, 15. As shown in FIG. 9A, for example, the first and second lateral sides 80, 82 of the canopy 12 are coupled to and extend between second portions 17 of the frames 14, 15. In another example embodiment, there may be at least a second canopy (not shown) that is coupled to and extends between the first portions 16 of the frames 14, 15, while the first canopy 12 extends between the second portions 17.

The two portions 16, 17 may be separable portions that may be joined to one another via a connecting bracket 18. In a transport configuration, the first portion 16, connecting bracket 18, and the second portion 17 may be separable or may be connected. In the supporting configuration, each of the first portion 16 and the second portion 17 may be joined to the connecting bracket 18 in an end to end engagement, which is either adjustable to the angle θ or manufactured so that when the sections are joined they extend at the angle θ.

The connecting bracket 18 is illustrated in one example embodiment in greater detail in FIG. 9B. In such an embodiment, the connecting bracket 18 may be provided as an accessory to an existing system 10 to be inserted between two adjacent sections 24 of the frame 14. Upon insertion of the connecting bracket 18, the sections 24 of the frame to the left of the bracket 18 are considered the first portion 16, while the sections 24 of the frame to the right of the bracket 18 are considered the second portion 17. The connecting bracket 18 may be formed in an inverted 'V' shape (or any other desired shape, such as 'T' shape or 'L' shape) and may be able to receive ends of the two adjacent sections 24 therein. The cable 30 may extend through the connecting bracket 18. The connecting bracket 18 may be formed as a clamshell in two halves such that once the connecting bracket 18 is positioned, the halves of the connecting bracket 18 are secured to one another in order to retain the adjacent sections 24 in the angled relationship. The two halves may connect via a snap fit, clasp, magnet, hinge, zipper, bayonet lock, and the like. Alternatively, the connecting bracket 18 may slide onto the frames 14, 15 and be positioned between adjacent sections. The connecting bracket 18 may be movable such that, the angle θ formed by the two portions 16, 17 is adjustable and subsequently securable. Alternatively, the frames 14, 15 in this embodiment may be engaged with the first and second ends 42, 43 of the canopy 12.

Figure 10A:
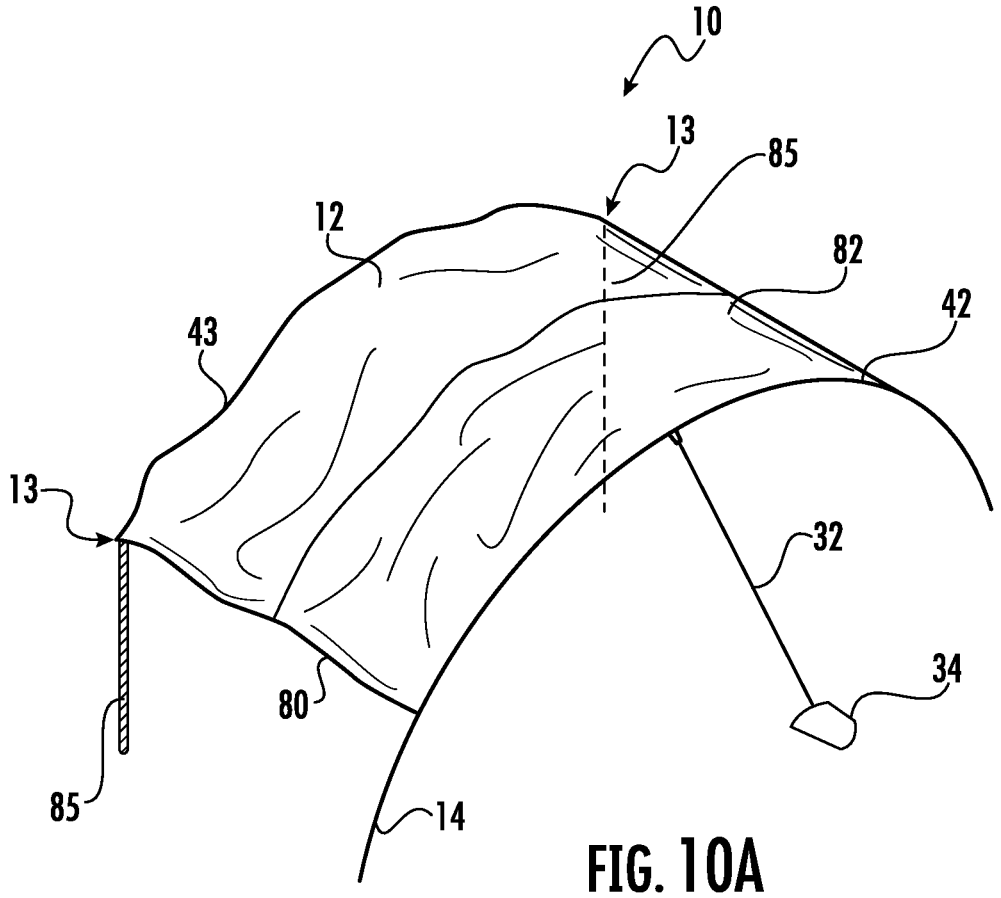
FIG. 10A is a perspective view of a system for providing shade according to one or more embodiments of the presently disclosed subject matter.
Figure 10B:
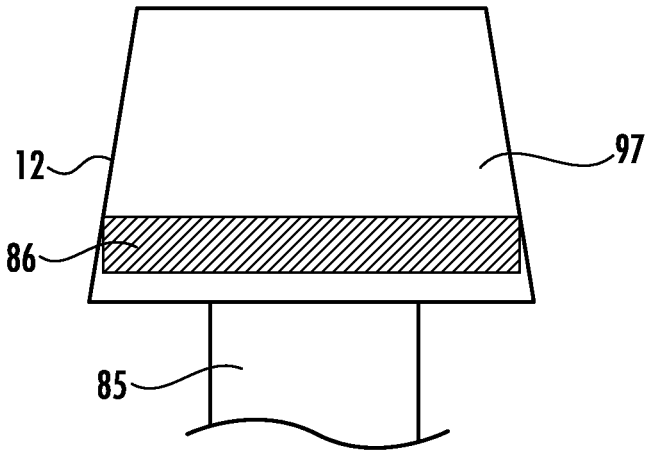
FIG. 10B is a detailed front view of a support member for the system of FIG. 10A.

In some example embodiments, and as illustrated in FIGS. 10A-10B, the second frame may be in the form of two or more support members 85. For example, the first end 42 may comprise the first frame 14 engaged therewith, while the second end 43 of the canopy 12 may comprise two support members 85 engaged at corners 13 therewith. Alternatively, a single support member coupled with a center of the second end 43, or more than two support members arranged along a length of the second end 43 may be provided. Alternatively, the support member(s) 85 may be arranged on the adjacent lateral sides 80, 82 of the canopy 12.

As illustrated in FIGS. 10A, for example, each corner of the second end 43 may be engaged to or coupled with one of the support members 85. The support members 85 may be formed similarly to or differently from the first frame 14. The support members 85 may be rigid, or may be a flexible member with one or more sections 24 or components. The support members 85 may be formed as a vertically-extending member, such as a pole; though other types of support members, such as tethers, bungee cords, ground stakes, anchors, and the like are also contemplated. Where the support members 85 are poles, each of the poles may be joined or otherwise engaged with the canopy 12, such that in the supporting configuration, the support members 85 are engaged with the surface at about a 90 degree angle, although other angles are contemplated, such as about a 45 degree angle. The support members 85 may be engaged with the canopy 12 via elastic fasteners, grommets, magnets, hook and loop fasteners, straps, snaps, clamps, any combination thereof, and any other similar fastening mechanisms. In some example embodiments, portions of the canopy 12 comprise a built-in fastener that is able to receive or otherwise couple to the support members 85.

The support members 85 may be engaged with the canopy 12 either permanently or as needed, such as when the wind speed decreases. For example, the sun shading system 10 may be a modified by a user to engage the one or more support members 85 with the canopy in a no wind situation. In this example, and as shown in FIG. 10B, the support members 85 may comprise a pad or other cap 97 to cover the support members 85. The cap 97 may be a pliable cap that may cover the end of the support members 85 to prevent the canopy 12 from snagging thereon. The cap may snugly cover the end of the support members 85, but be removable for transport. The support members 85 may be engaged with the canopy 12 via an elastic fastener 86 that encircles the fabric of the canopy 12 when a support member 85 and/or cap 97 is arranged underneath. The elastic fastener 86 bands the canopy 12 around a portion of the support member 85 and/or the cap 97 to removably secure the corner of the canopy 12 around the support member 85 and/or the cap 97. The elastic fastener 86 may be a loop of polymeric material (e.g., a rubber band) or other similar elastic-type fastener that is easily removable and transportable. A rigid fastener, such as a clip, may also be used.

Figure 11A:
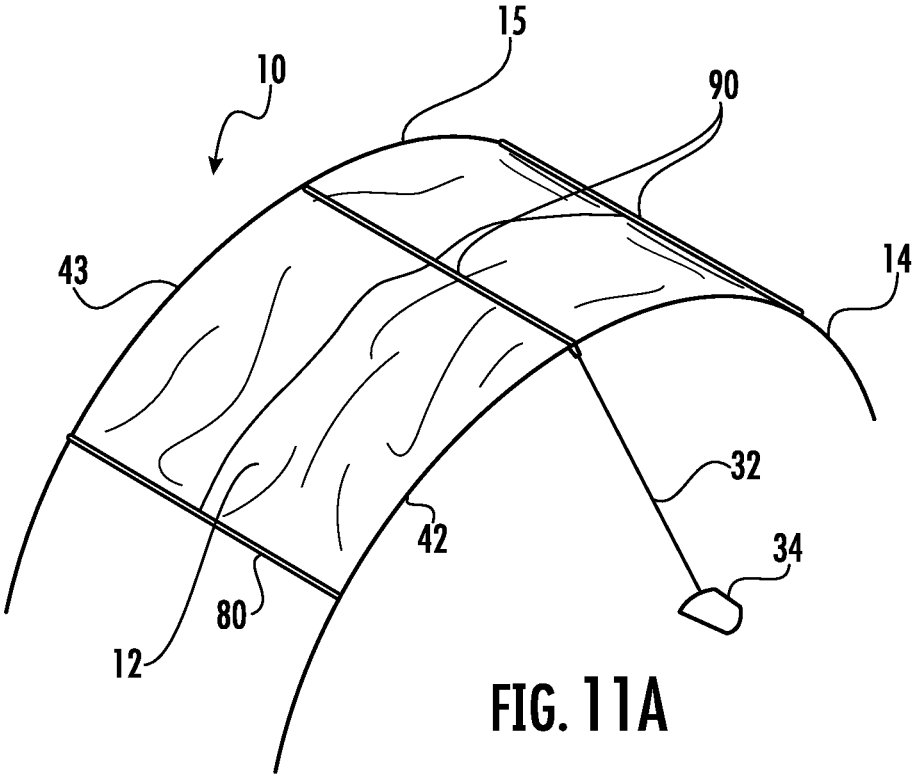
FIG. 11A is a perspective view of a system for providing shade according to one or more embodiments of the presently disclosed subject matter.
Figure 11B:
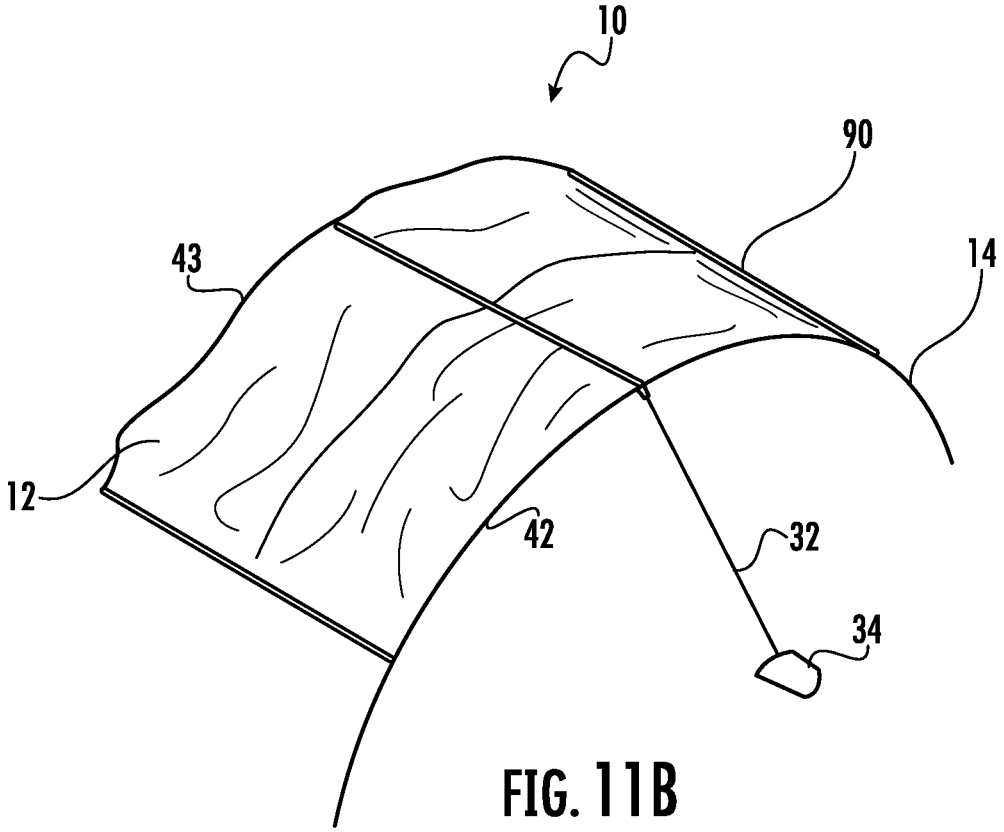
FIG. 11B is a perspective view of a system for providing shade according to one or more embodiments of the presently disclosed subject matter.

In some example embodiments, one or more supports 90 such as the three illustrated in FIGS. 11A-11B may be incorporated into or engaged with the canopy 12 to prevent it from sagging in a no wind situation. The supports 90 may also be utilized in high wind or moderate wind situations, as well, to help mitigate canopy noise. The supports 90 may be formed as ribs, welded plastic, heat crimped material, battens, inflatable bladders, shape-memory alloys, any combination thereof, and the like that can provide a stiffness to the canopy 12. The supports 90 may extend between the first end 42 and the second end 43 either with or without any additional frames and/or tie downs. Alternatively, the supports 90 may also or instead of extend between the lateral sides 80, 82. Regardless of which way the supports 90 extend, the supports may extend along an substantial entirety or only partially of a length and/or width of the canopy 12.

The supports 90 can either be formed in/with the canopy 12 and/or frame(s) 14, 15 or may be separate from the canopy 12 and/or frame (s) 14, 15. Where separate from the canopy and/or frame, the supports 90 may be attached to the canopy and/or frame so that in the supporting configuration the supports 90 act to support the canopy 12. For example, where the supports 90 are incorporated into the material of the canopy 12, the supports may be inserted into channels or pockets formed in the canopy 12, may be sewn to or otherwise secured to the fabric of the canopy 12, or may be otherwise attached (e.g., via hook and loop fasteners) to the fabric of the canopy 12. Where a channel or pocket is formed in the canopy, the channel may be similar to the channels 40, which can receive the frame(s) 14, 15.

In some example embodiments, the supports 90 may comprise one or more ribs formed as sections 24 that comprise longitudinally-extending members that extend between the first and second ends 42, 43. The ribs may be attached to one or both of the frames 14, 15 and/or may be integrated or otherwise coupled to the material of the canopy 12. The ribs may be arranged on top of the canopy, integrated with the canopy 12, on bottom of the canopy 12, or any combination. Alternatively, or in addition to, the ribs may be an integral part of the canopy and may be formed so that they are stiffer, heavier, have a different weight, wave, material, texture, etc., or otherwise different than the rest of the canopy. As shown in FIG. 11A, for example, the ribs extend between the first and second frames 14, 15. In another example, the ribs may be attached to one of the first or second frames 14, 15, such that only a single frame is needed. As shown in FIG. 11B, for example, the ribs extend from the first frame 14 at about a 90 degree angle, though other angles are also contemplated. In some other examples, the ribs could be arranged so that they are parallel to the second end 43 of the frame(s) 14, 15. In some still further examples, the ribs are arranged diagonally across the canopy 12 in an 'X' shape, or in other shape, such as an "I" shape, a "T" shape, a "V" shape, and the like. The canopy 12 may be draped or otherwise engaged with the ribs. In this manner, the ribs may be able to aerially suspend the canopy 12 while being secured to a single frame at about a 90 degree angle. In the transport configuration, the rib(s) may either be disengaged from the frame(s) 14, 15 or may be movably connected therewith (e.g., hingedly) so that they may be compactly transported with the frame(s) 14, 15.

Figure 12:
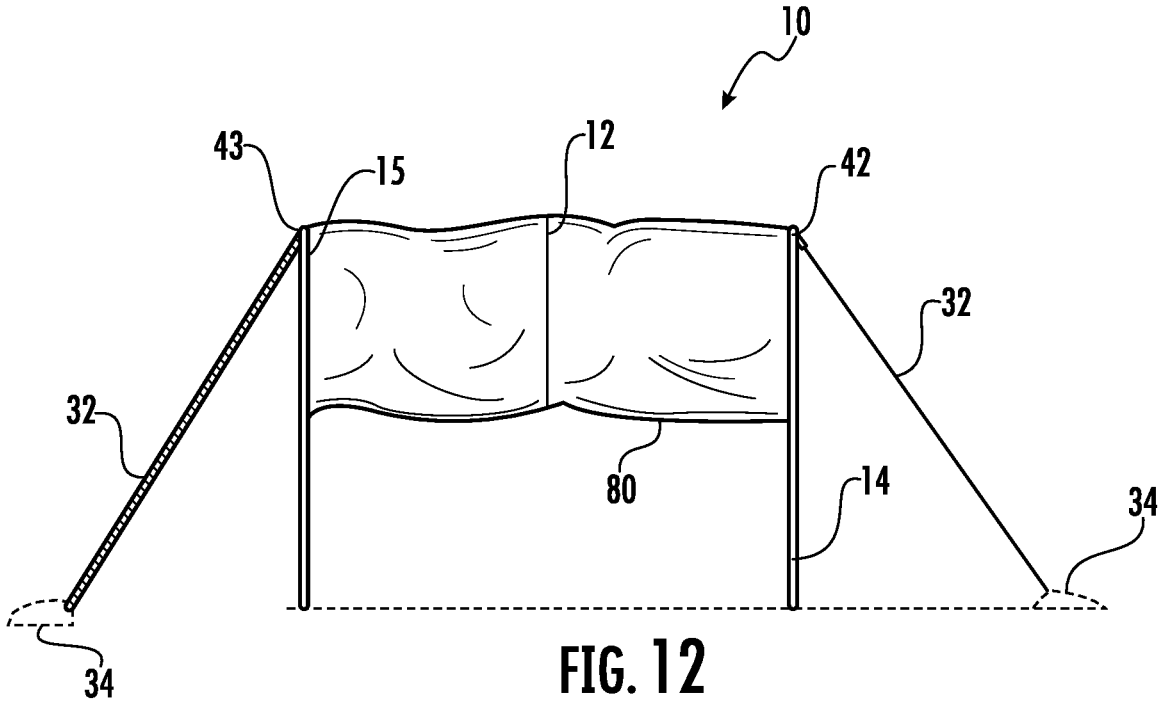
FIG. 12 is a perspective view of a system for providing shade according to one or more embodiments of the presently disclosed subject matter.

In some still further example embodiments where there are two frames 14, 15, an additional anchor 34 may be utilized at the second end 43 (or elsewhere on the system 10) in addition to or instead of the first anchor utilized at the first end 42. As shown in FIG. 12, for example, the additional anchor 34 is utilized at the second end 43 in addition to the second frame 15.

Figure 13:
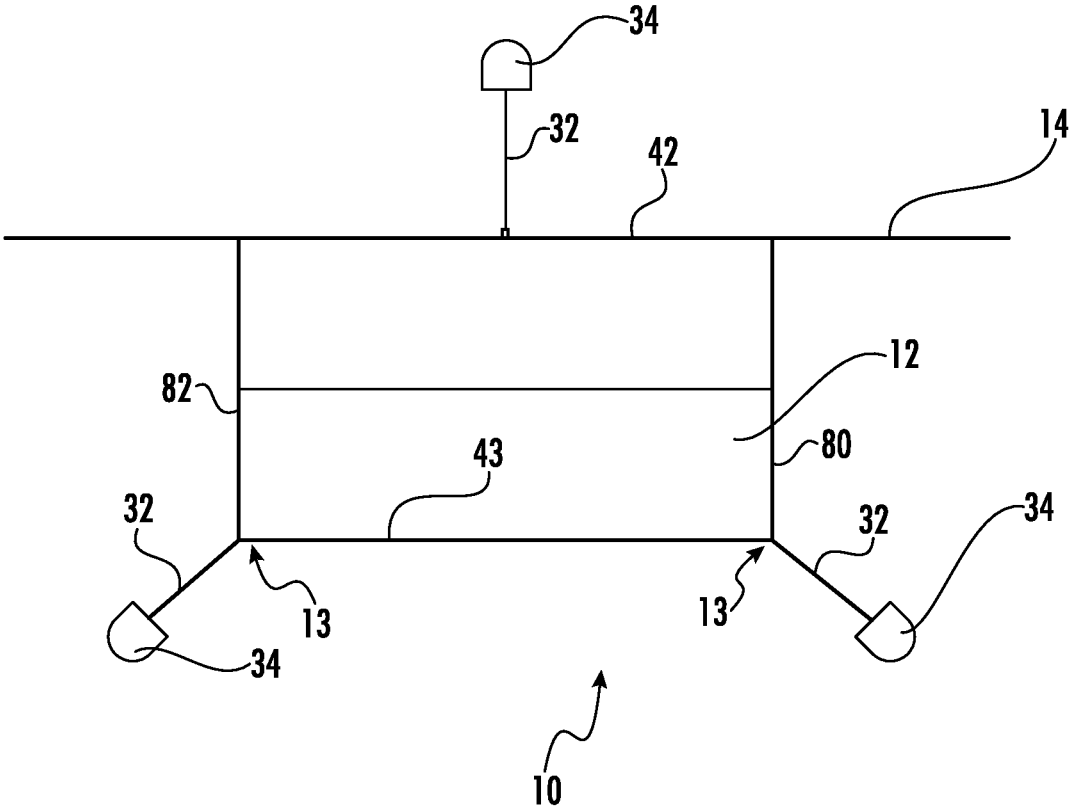
FIG. 13 is a perspective view of a system for providing shade according to one or more embodiments of the presently disclosed subject matter.
Figure 14:
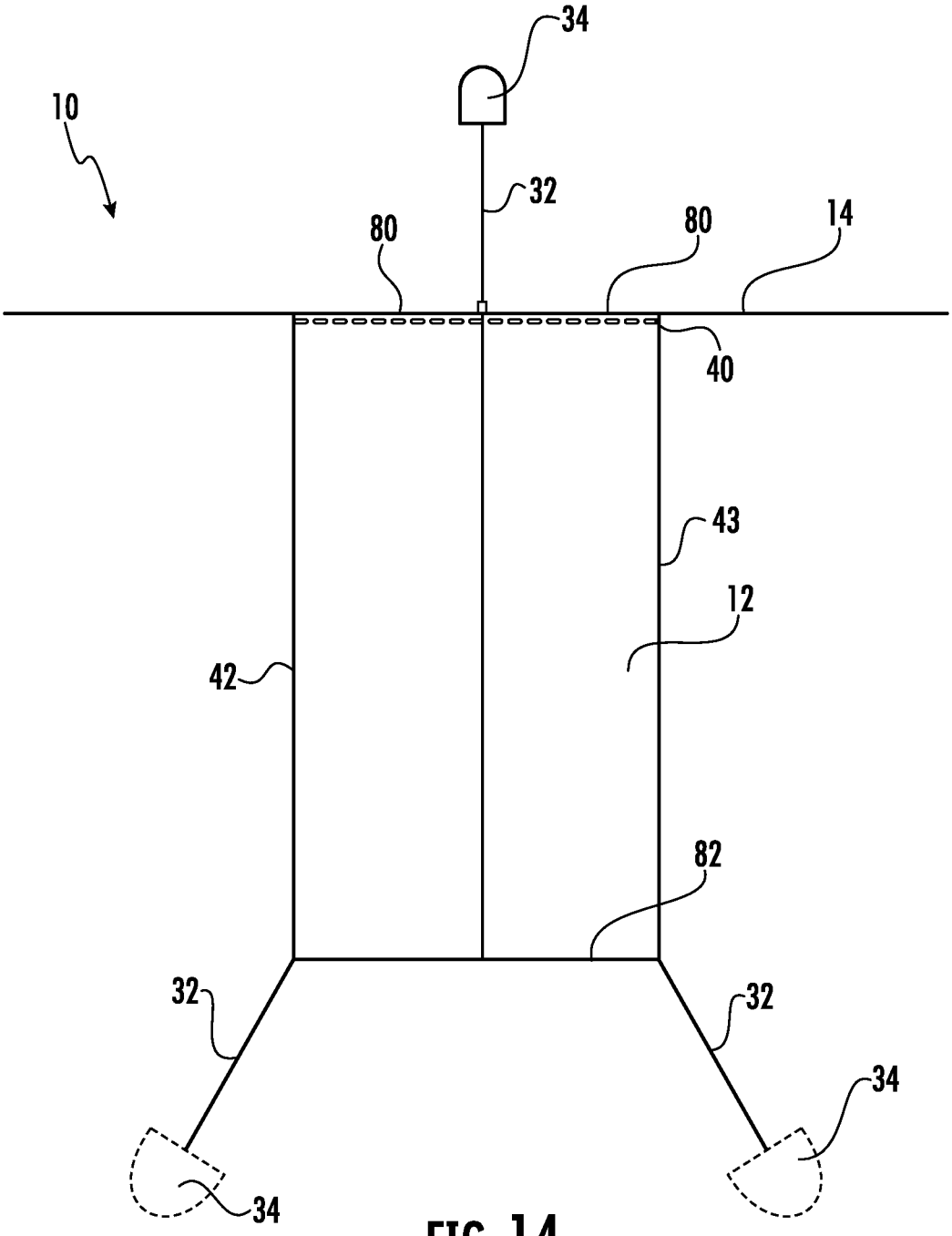
FIG. 14 is a perspective view of a system for providing shade according to one or more embodiments of the presently disclosed subject matter.

In some example embodiments, and as illustrated in FIGS. 13-14, instead of the second frame 15, additional anchors 34 may be utilized. The additional anchors may take the form of sandbags, corkscrews, stakes, bungee cords, tie-downs, magnetic fasteners, any combination thereof, and the like that is capable of acting as a counterweight. The additional anchors 34 may include any of the features and characteristics described herein attributed to the first anchor 34. The additional anchors 34 may be directly or indirectly attached to the canopy(s) 12, and/or the frame(s) 14, 15. The first anchor and the additional anchor(s) 34 may be similar or different, by comprising or having a same shape, length, diameter/width, number of segments, materials, rigidity, color, construction, etc. The first and/or the additional anchor(s) 34 may be engaged with one or both of the first and second ends 42, 43 and/or the opposing lateral sides 80, 82 of the canopy located between the first and second ends 42, 43.

For example, and as shown in FIG. 13, the additional anchor(s) 34 may be in the form of tie-downs at the trailing end 43. The tie-downs may be in the form of a sandbag with a cord 32 that attaches to the canopy 12 and/or the frame 14. However, the tie-downs may be in any other type of format. There may be one, two, three, four, etc., tie-downs. As shown in FIG. 13, there are two tie-downs, one being engaged with each corner 13 of the second end 43. The tie-downs may be engaged or otherwise attached to the canopy 12 via a slit (e.g., a button hole); though other manners of fastening the canopy 12 to the tie-downs are contemplated herein.

Notably, in some example implementations, a mechanism that automatically releases the canopy fabric from the tie down if the wind gusts may be utilized. For example, a sandbag with a cord may attach to the canopy via a magnet/clip/fastener/hook and loop fastener (e.g., VELCRO®) on the second end 43 of the canopy 14. Where a magnet is used, a structure similar to a bifold wallet may include magnets on either half of the structure. One half may comprise a positive magnet while the other comprises a negative magnet. The structure then clamps around the second end 43 (or other portion) of the canopy 12. In this example embodiment, if the wind gusts, then the magnets release the canopy fabric so that the canopy fabric doesn't tear and the system 10 doesn't blow over. Where a clip is used, the clip may be similar in structure to a smooth clip (e.g., a 'chip' clip). The cord 32 would be attached to one portion of the clip, and the clip would then clamp down on a portion of the canopy 12. Where a hook and loop fastener is used, the cord 32 would be attached to either the hook or loop fastener, while the canopy 12 may have the other of the loop or the hook. When the two are engaged, the hook and loop fasteners may interlock to retain the engagement therebetween until a forceful enough gust disconnects the two.

In some still further example embodiments, where a cord 32 is used, the cord may be housed in a sleeve of the canopy fabric and unfurled/connected to anchors 34 when extra support is needed. The sleeves may be channels 40 placed strategically along the canopy, and a cord is run through it to provide tension/connection to tie down as needed.

In some other example embodiments, a channel 40 on one or both of the lateral sides 80, 82 of the canopy 12 is formed. As shown in FIG. 14, in a no-wind situation (i.e., wind less than 2-3 miles per hour), the frame 14 may be received in the channel 40 on one of the lateral sides 80, 82 and the tie downs are arranged on the opposing lateral side 82, 80. In this manner, a greater area of fabric can be available to use to tie it down to create more shade.

Figure 15:
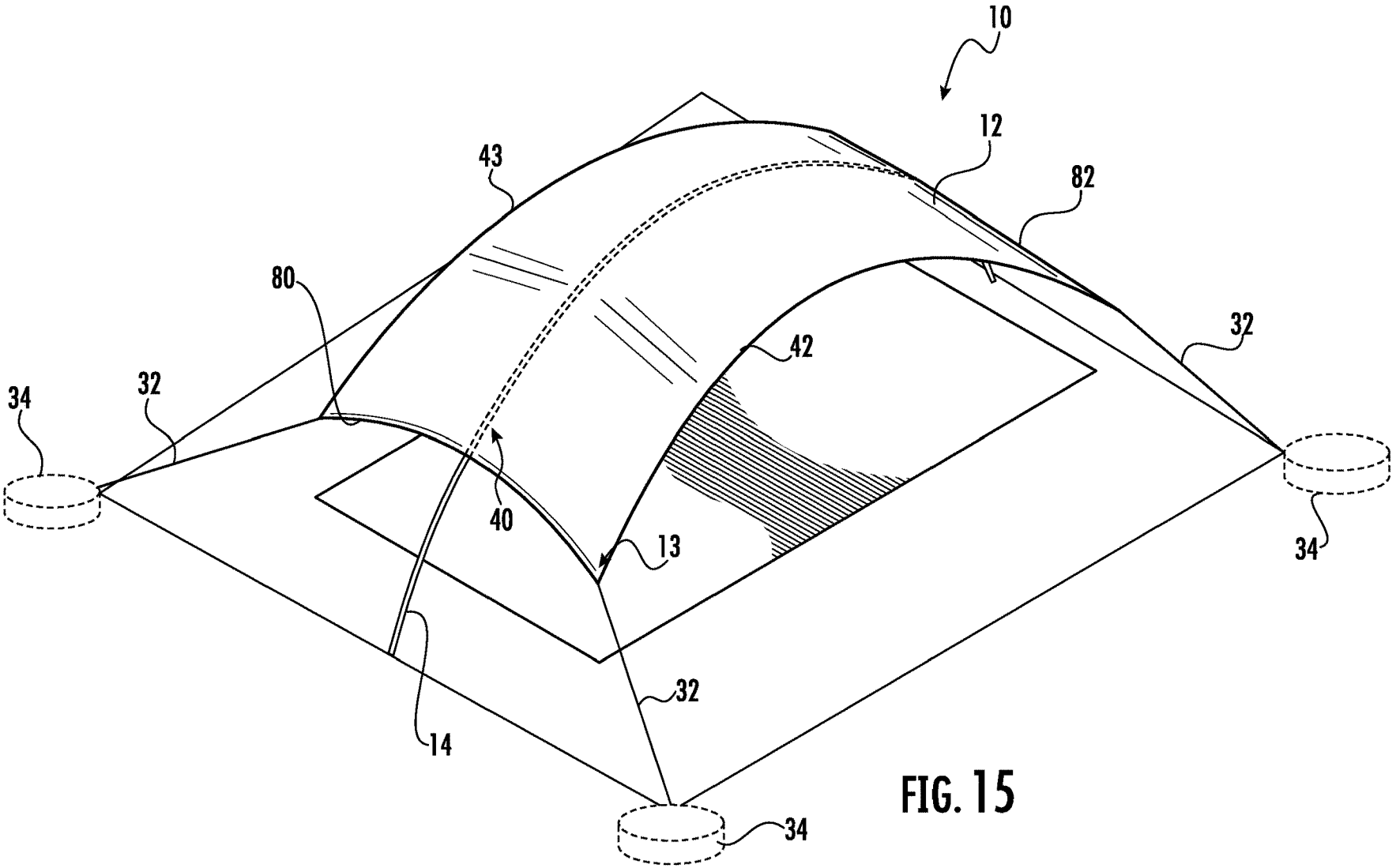
FIG. 15 is a perspective view of a system for providing shade according to one or more embodiments of the presently disclosed subject matter.
Figure 16:
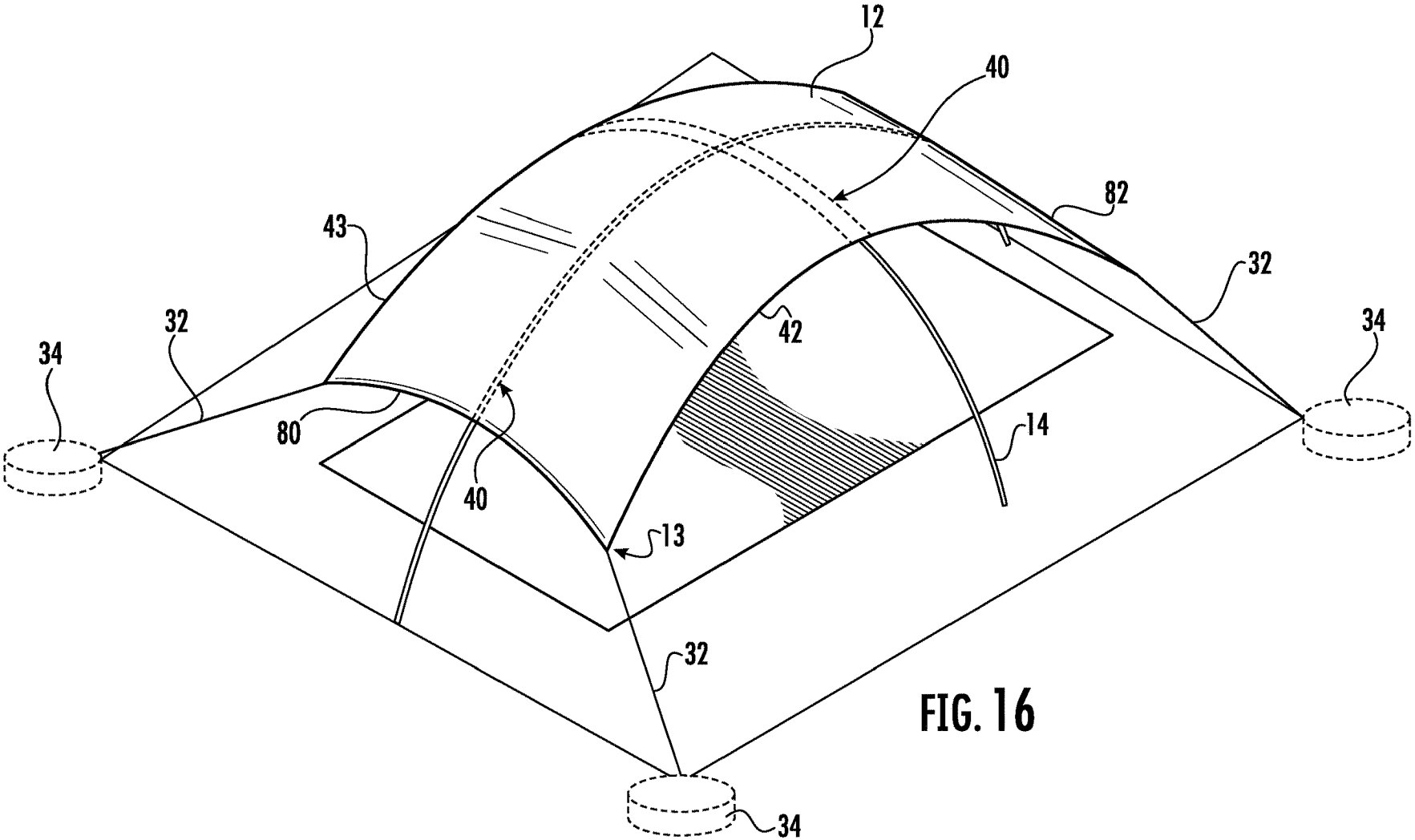
FIG. 16 is a perspective view of a system for providing shade according to one or more embodiments of the presently disclosed subject matter.

As illustrated in FIGS. 15-16, in another example embodiment of the system 10, at least one frame 14 may support the canopy 12 and be engageable therewith at an end other than the first or second ends 42, 43. In particular, the at least one frame 14 may include a plurality of sections, similar to the sections 24 described above in reference to FIGS. 1-7, configured for engagement in an end-to-end alignment to provide the frame 14 in a supporting configuration with a left end that is engageable with the surface and a right end that is engageable with the surface. The frame may be any type of shape, such as, for example, an 'L' shape, a 'T' shape, an 'I' shape, a 'V' shape, an inverted 'V' shape, a 'W' shape, a "U" shape, and the like. As shown in FIGS. 15 and 16, the frame 14 is a curved arch shape. In some example embodiments, the frame 14 is directly engageable with the surface in the supporting configuration. In some embodiments, the frame 14 may be constructed similarly to that described in reference to FIGS. 1-7. For example, the frame 14 may comprise a cable extending through at least one of the plurality of the sections of the frame 14. Alternatively, or in addition to the cable, other alignment components may be utilized such as brackets that engage adjacent sections and allow the sections to be maneuvered between a compact transport configuration and the supporting configuration.

The canopy 12 may define a length extending between a first lateral side 80 and a second lateral side 82 and defining a width extending between a first end 42 and an opposing second end 43, the canopy 12 being supportable by the at least one frame 14 in the supporting configuration such that the frame 14 extends along the length of the canopy 12 or along the width of the canopy 12. In some example embodiments, the canopy 12 is a lightweight elastic fabric (e.g., a LYCRA®/nylon or polyester blend), whereas in some other example embodiments, one or more portions of the canopy 12 may comprise a lightweight elastic fabric while the remaining portions of the canopy 12 may comprise other materials or fabrics, such as mesh, a nylon blend, polyester, bamboo, cotton, natural fibers, any combination thereof, and/or similar materials. For example, one or more (e.g., one, two, three, four, all) of the corners of the canopy 12 may be a lightweight elastic fabric, whereas the remaining portion of the canopy 12 may be a lightweight polyester or nylon. In another example, one or more panels of the canopy 12 may be a lightweight elastic fabric, while one or more other panels of the canopy 12 may be a lightweight polyester or nylon and/or one or more corners 13 of the canopy 12 may be elastic.

The canopy 12, in some example embodiments, defines at least one channel 40 (e.g., an opening, gusset, loop, etc.) extending along one or both of the length of the canopy and the width of the canopy. The at least one channel 40 may extending at least partially or entirely along the length and/or width of the canopy 12, or may be arranged between and extend along one or both of the length of the canopy 12 between the first lateral side 80 and the second lateral side 82 and the width of the canopy 12 between the first end 42 and the second end 43, the at least one channel 40 being arranged to receive the frame 12. In some embodiments, the channel(s) 40 may include tie strings or some other type of fasteners for engaging the canopy 12 with the frame 14. For example, the system may further comprise a fastener coupled to one or both of the canopy 12 and the frame 14 to secure the frame 14 to the canopy 12 in the supporting configuration. FIG. 3 illustrates and describes one example embodiment of such a fastener, such as a strap 50.

For example, and as shown in FIG. 15, the canopy 12 is supportable by the at least one frame 14 in the supporting configuration such that the frame 14 extends along the length of the canopy 12 between the first and second ends 42, 43. The channel 40 may extend at least partially or entirely along the length of the canopy 12. Additional channels 40 may also be provided in different locations on the canopy 12, such as diagonally, widthwise, etc.

In another example, and as shown in FIG. 16, the canopy 12 is supportable by the at least one frame 14 in the supporting configuration such that the frame 14 extends along the width of the canopy 12. The channel 40 may extend at least partially or entirely along the width of the canopy 12 between the first lateral side 80 and the second lateral side 82 to receive the frame 14. Additional channels 40 may also be provided in different locations on the canopy 12, such as diagonally, lengthwise, etc.

As shown in FIGS. 15 and 16, the system 10 may further comprise a plurality of anchors 34 engageable with the canopy 12. Each of the plurality of anchors 34 may be engageable with a corner 13 of the canopy 12 defined at the intersection of the first or second ends 42, 43 with the first or second lateral sides 80, 82. The anchors 34 may be similar or the same as the anchor 34 described in reference to FIGS. 1 and 5. Otherwise, the anchor 34 may be different. For example, one or more of the plurality of anchors 34 may comprise a weight, a corkscrew, a stake, a bungee cord, a tie-down, a magnetic fastener, or any combination thereof. The system 10 may also comprise a plurality of cords 32, each of the cords 32 being engageable between one or both of the canopy 12 and the frame 14, and the anchors 34. For example, and as shown in FIGS. 15 and 16, where the canopy 12 defines four corners, there are four individual cords 32 each engaged with an anchor 34 to pull the corners 13 of the canopy 12 taut. However, there may be more or fewer anchors than the number of corners 13 of the canopy 12, and the anchors 34 and cords 32 may be engageable with the canopy 12 at portions other than or in addition to the corners 13, or there may be multiple anchors 34 and/or cords 32 at each corner 13.

In some embodiments, the system 10 may comprise a container (not shown in FIGS. 15 and 16) for housing and transporting at least one of the components of the system. The container may be the same or similar to the container 70 described in reference to FIGS. 1-7. The container may also be different. The container, in one configuration, may house and transport the system 10 and, in another configuration, houses weight and acts as at least one of the plurality of anchors 34. In some embodiments, the system 10 may comprise one or more supports 90 such as one or more battens or inflatable bladders extending along one or both of the length of the canopy 12 and the width of the canopy 12.

Accordingly, in the supporting configuration of the system 10 illustrated in FIGS. 15 and 16, the canopy 12 is supported by the frame 14 and the plurality of anchors 34 and is at least partially supportable by wind for providing shade onto the surface.

Figure 17:
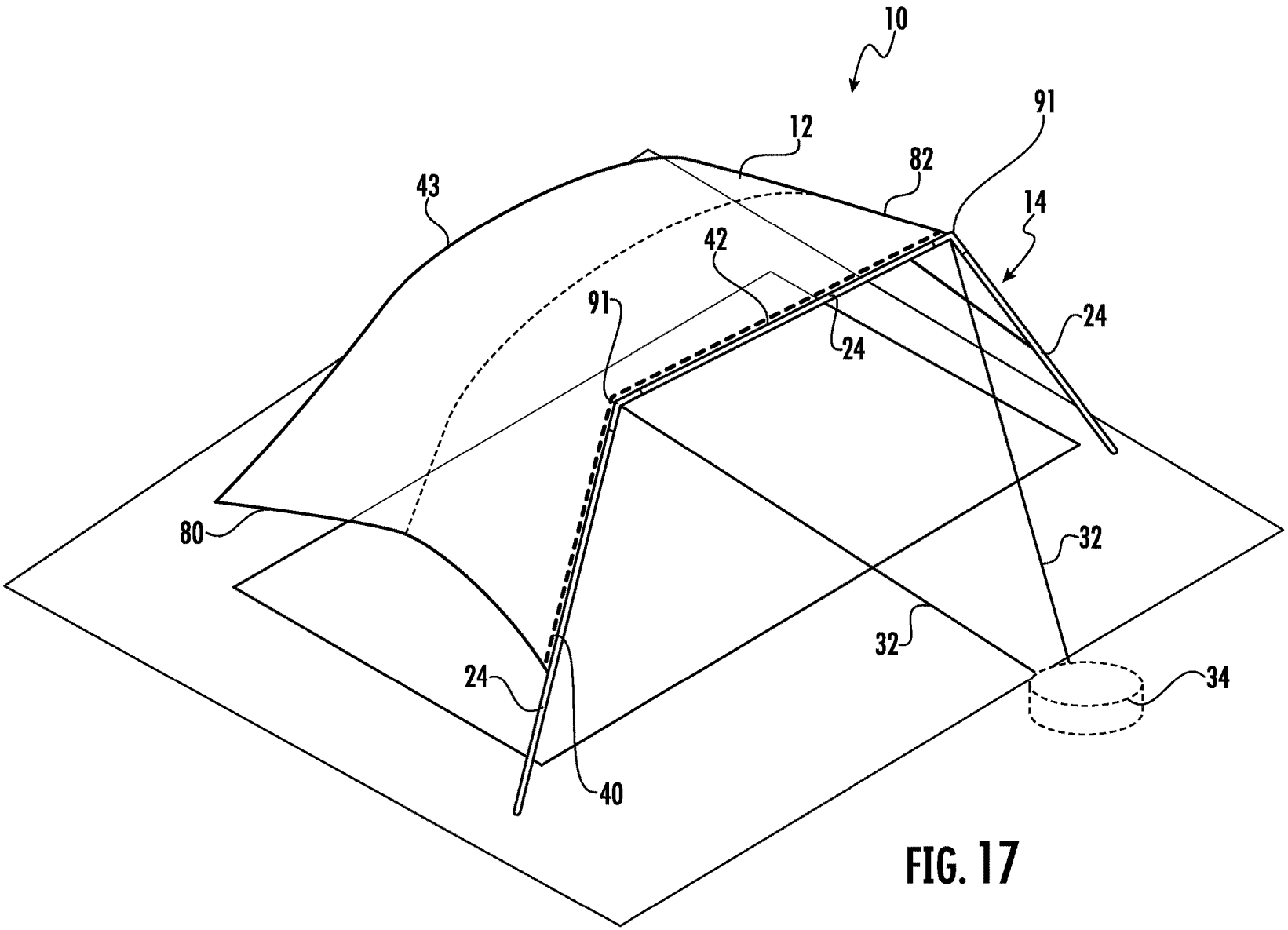
FIG. 17 is a perspective view of a system for providing shade according to one or more embodiments of the presently disclosed subject matter.
Figure 18:
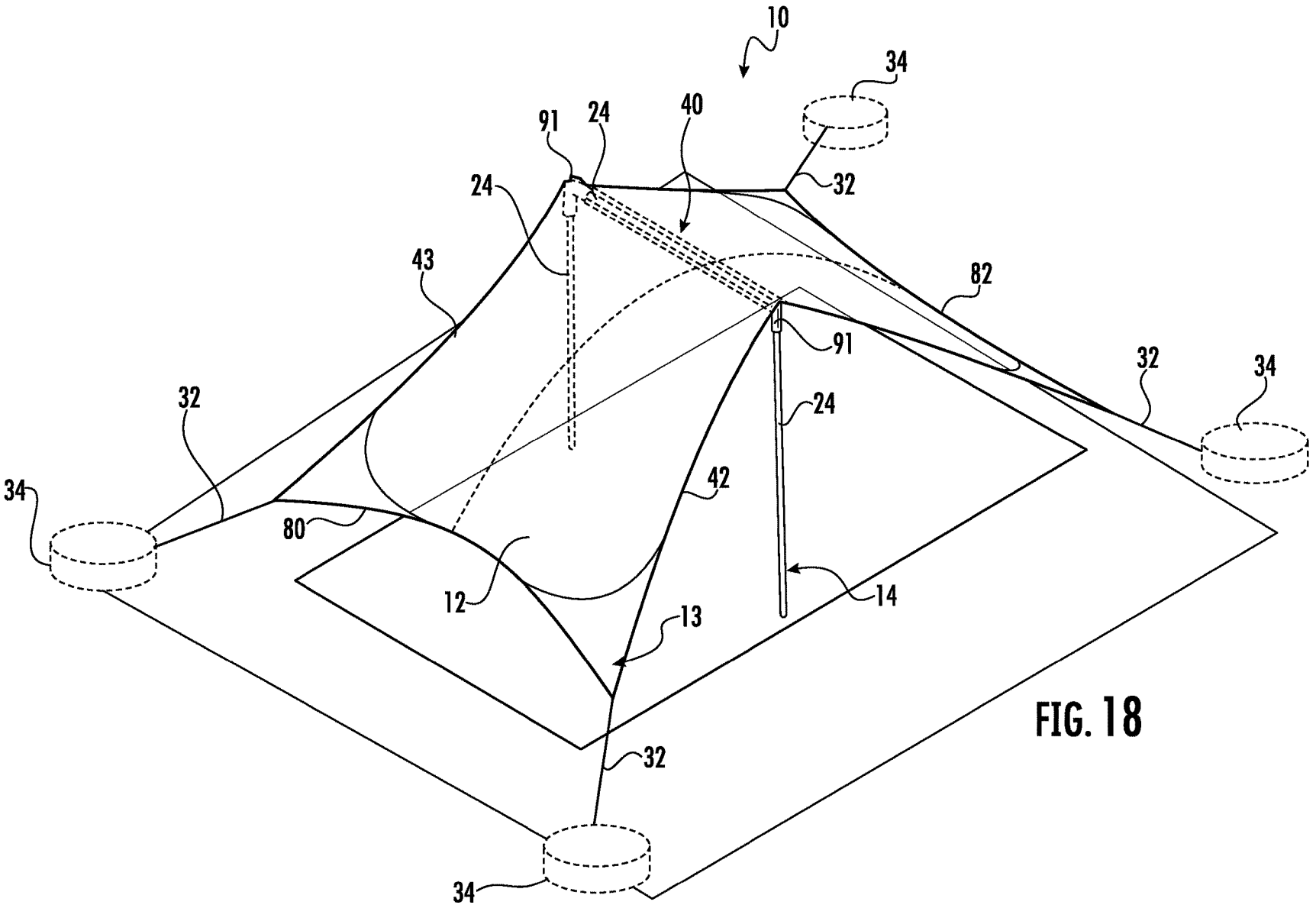
FIG. 18 is a perspective view of a system for providing shade according to one or more embodiments of the presently disclosed subject matter.

FIGS. 17-18 illustrate other example embodiments of the system 10, which include at least one frame 14 that may support the canopy 12 and be engageable therewith. In particular, the at least one frame 14 may include a plurality of sections, similar to the sections 24 described above in reference to FIGS. 1-7, configured for engagement in an end-to-end alignment to provide the frame 14 in a supporting configuration with a left end that is engageable with the surface and a right end that is engageable with the surface. The frame may be any type of shape, such as, for example, an 'L' shape, a 'T' shape, an 'I' shape, a 'V' shape, an inverted 'V' shape, a 'W' shape, a "U" shape, and the like.

In some example embodiments of FIGS. 17-18, the frame 14 is directly engageable with the surface in the supporting configuration. In some embodiments, the frame 14 may be constructed similarly to that described in reference to FIGS. 1-7. For example, the frame 14 may comprise a cable extending through at least one of the plurality of the sections of the frame 14. Alternatively, or in addition to the cable, other alignment components may be utilized such as brackets that engage adjacent sections and allow the sections to be maneuvered between a compact transport configuration and the supporting configuration. The canopy 12 may define a length extending between a first lateral side 80 and a second lateral side 82 and defining a width extending between a first end 42 and an opposing second end 43, the canopy 12 being supportable by the at least one frame 14 in the supporting configuration. The canopy 12 may be similar to or different to the canopy described in reference to FIGS. 1-7. As shown in FIGS. 17-18, the system 10 may further comprise a plurality of anchors 34 engageable with the canopy 12 and/or the at least one frame 14. The system 10 may also comprise a plurality of cords 32 engageable between the canopy 12 and/or at least one frame 14 and the anchors 34.

As shown in FIG. 17, for example, the frame 14 is a flat arched shape with a horizontal section 24 and two angled sections 24 extending from opposing longitudinal ends of the horizontal section to form the left end and the right end of the frame. Each of the two angled sections 24 may extend from the horizontal section at an obtuse angle, such as, for example, a 135 degree angle. A cable may extend through at least one of the sections 24. For example, a single cable may extend through all of the sections 24 of the frame 14, or individual cables may extend through individual sections of the frame 14. Instead of or in addition to the cable 30, other alignment components may also be utilized such as brackets that engage adjacent sections 24 and allow the sections 24 to be maneuvered between the compact transport configuration and the supporting configuration. For example, an alignment component 91 may be arranged at an intersection between the horizontal section 24 and each of the two angled sections 24 in order to retain the angled sections 24 in alignment with the horizontal section 24. The alignment component 91 may be permanently attached to the sections 24, or may be removable and replaceable when the frame 24 is maneuvered between the transport and supporting configurations.

The frame 14 of FIG. 17 may be arranged to extend at least partially through a channel 40 defined along one of the first end 42, the second end 42, the first lateral side 80, and/or the second lateral side 82 of the canopy 12. As shown in FIG. 17, the frame 14 extends through the channel 40 defined along an entirety of the first end 42. In addition, one anchor 34 engageable with one or both of the frame 14 and the canopy 12 is illustrated in FIG. 17. There, the anchor 34 includes two cords 32 that are coupled to the anchor 34 and to a respective one of the alignment components 91, the frame 14, and/or the canopy 12. In this example embodiment, the anchor 34 may comprise a container (similar to the container 70 in FIGS. 1-7) that in one configuration, houses and transports the system 10 and, in the supporting configuration, houses weight and acts as the anchor. Alternatively, the anchor 34 may comprise a stake, a corkscrew, a bungee cord, a tie-down, a magnetic fastener, or any combination thereof.

Turning now to FIG. 18, for example, the frame 14 is a flat arched shape with a horizontal section 24 and two angled sections 24 extending from opposing longitudinal ends of the horizontal section to form the left end and the right end of the frame. Each of the two sections 24 may extend from the horizontal section 24 at a substantially 90 degree angle. A cable may extend through at least one of the sections 24. For example, a single cable may extend through all of the sections 24 of the frame 14, or individual cables may extend through individual sections of the frame 14. Instead of or in addition to the cable, other alignment components may also be utilized such as brackets that engage adjacent sections 24 and allow the sections 24 to be maneuvered between the compact transport configuration and the supporting configuration. For example, an alignment component 91 may be arranged at an intersection between the horizontal section and each of the two angled sections 24 in order to retain the angled sections 24 in alignment with the horizontal section. The alignment component 91 may be permanently attached to the sections 24, or may be removable and replaceable when the frame 24 is maneuvered between the transport and supporting configurations.

The frame 14 of FIG. 18 may be arranged to extend at least partially through a channel 40 extending along one or both of a length of the canopy and a width of the canopy. As shown in FIG. 18, for example, the frame 14 extends through the channel 40 defined along an entirety of the width of the canopy 12 and between the first lateral side 80 and the second lateral side 82. In addition, four anchors 34 are engageable with each of the respective corners 13 of the canopy 12. There, each anchor 34 includes a cord 32 that is coupled between the anchor 34 and the respective corner 13. In this example embodiment, one of the anchors 34 may comprise a container (similar to the container 70 in FIGS. 1-7) that in one configuration, houses and transports the system 10 and, in the supporting configuration, houses weight and acts as the anchor. Alternatively, the anchors 34 may comprise a stake, a corkscrew, a bungee cord, a tie-down, a magnetic fastener, or any combination thereof.

Other example embodiments of a system 10 are illustrated in FIGS. 19-22. In FIGS. 19-22, two or more frames 14, 15 may support the canopy 12 and be engageable therewith, and may even be directly engageable with the surface. In particular, a first frame 14 may include a plurality of sections, similar to the sections 24 described above in reference to FIGS. 1-7, configured for engagement in an end-to-end alignment to provide the first frame 14 in a supporting configuration with a left end that is engageable with the surface and a right end that is engageable with the surface. The first frame may be any type of shape, such as, for example, an 'L' shape, a 'T' shape, an 'I' shape, a 'V' shape, an inverted 'V' shape, a 'W' shape, a "U" shape, and the like. The two or more frames 14, 15 may comprise separate frames, which may be the same or different shapes.

In some example embodiments, the first frame 14 may be constructed similarly to that described in reference to FIGS. 1-7. For example, a first cable may extend through at least one of the plurality of the sections of the first frame 14. Alternatively, or in addition to the cable, other alignment components, such as brackets, may engage adjacent sections and allow the sections to be maneuvered between a compact transport configuration and the supporting configuration.

The canopy 12 may define a length extending between a first lateral side 80 and a second lateral side 82 and defining a width extending between a first end 42 and an opposing second end 43, the canopy 12 being supportable by the first frame 14 in the supporting configuration such that the first frame 14 extends along the length of the canopy 12 or along the width of the canopy 12. The canopy may be similar to or different to the canopy 12 described herein in reference to FIGS. 1-7. The canopy 12 may define at least one channel 40 extending along one or both of the length of the canopy and the width of the canopy 12, the at least one channel 40 being arranged to receive the first frame 14.

The system 10 shown in FIGS. 19-22 may further comprise a second vertical frame 15 that includes at least one section configured with a bottom end that is engageable with the surface and a top end that is engageable with the canopy 12 at a midpoint defined between the first end 42 and the second end 43 or at a midpoint defined between the first lateral side 80 and the second lateral side 82 of the canopy 12. A fastener (like the fastener 50 illustrated in FIG. 3) may also be coupled to one or more of the canopy 12, the first frame 14, and the second frame 15 to secure the first and second frames 14, 15 to the canopy 12 in the supporting configuration.

As shown in FIGS. 19-22, the system 10 may further comprise a plurality of anchors 34 engageable with one or more of the first frame 14, the second frame 15, and the canopy 12. At least one of the plurality of anchors 34 may be engageable with a corner 13 of the canopy defined at an intersection of the first or second end 42, 43 with the first or second lateral sides 80, 82. At least one of the corners 13 of the canopy 12 may be elastic in order to stretch with the anchors 34. The system 10 may also comprise a plurality of cords 32, each of the cords being engageable between one or more of the canopy 12, the first or second frames 14, 15 (including the alignment components 91), and the anchors 34. The system 10 may further comprise a container (similar to the container 70 in FIGS. 1-7) for housing and transporting at least one of the components of the system 10. In some embodiments, the container, in one configuration, houses and transports the system 10 and, in another configuration, houses weight and acts as one of the plurality of anchors 34. In some embodiments, the system 10 illustrated in FIGS. 19-22 may comprise one or more supports 90 such as one or more battens or inflatable bladders extending along one or both of the length of the canopy 12 and the width of the canopy 12.

As such, and as shown by FIGS. 19-22, in the supporting configuration, the canopy 12 is supported by the first frame 14, the second frame 15, and the plurality of anchors 34 and is at least partially supportable by wind for providing shade onto the surface.

Figure 19:
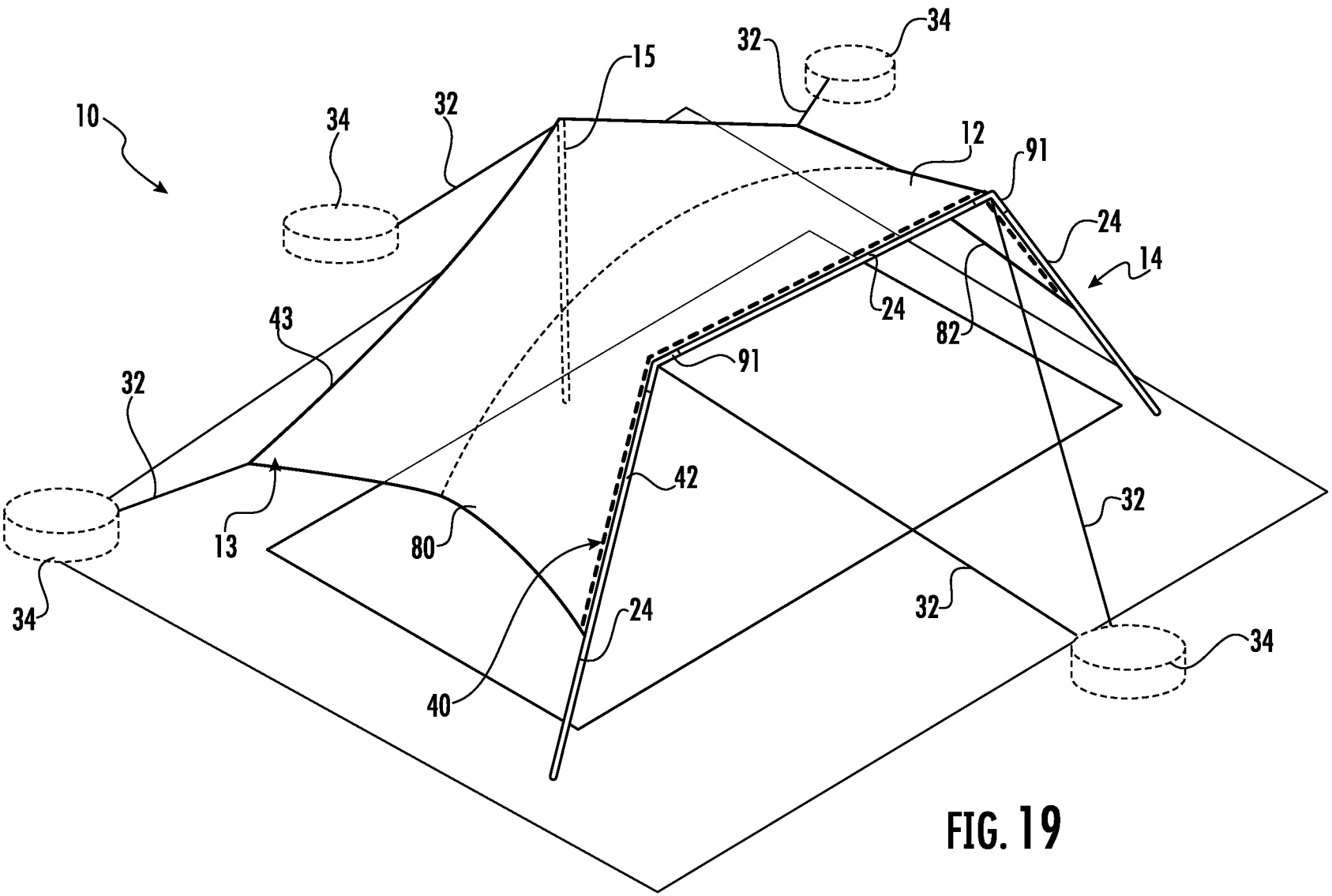
FIG. 19 is a perspective view of a system for providing shade according to one or more embodiments of the presently disclosed subject matter.

In particular, and as shown in FIG. 19, for example, two frames are shown. A first frame 14 is a flat arched shape with a horizontal section 24 and two angled sections 24 extending from opposing longitudinal ends of the horizontal section to form the left end and the right end of the frame. Each of the two angled sections 24 may extend from the horizontal section at an obtuse angle, such as, for example, a 135 degree angle. A cable may extend through at least one of the sections 24. For example, a single cable may extend through all of the sections 24 of the first frame 14, or individual cables may extend through individual sections of the first frame 14. Instead of or in addition to the cable, other alignment components may also be utilized such as brackets that engage adjacent sections 24 and allow the sections 24 to be maneuvered between the compact transport configuration and the supporting configuration. For example, an alignment component 91 may be arranged at an intersection between the horizontal section and each of the two angled sections 24 in order to retain the angled sections 24 in alignment with the horizontal section. The alignment component 91 may be permanently attached to the sections 24, or may be removable and replaceable when the frame 24 is maneuvered between the transport and supporting configurations.

The first frame 14 of FIG. 19 may be arranged to extend at least partially through a channel 40 defined along one of the first end 42, the second end 42, the first lateral side 80, and/or the second lateral side 82. As shown in FIG. 19, the frame 14 extends entirely through the channel 40 defined along the first end 42. A second frame 15 may be a substantially vertical frame that includes at least one section configured with a bottom end that is engageable with the surface and a top end that is engageable with the canopy 12 proximate the second end 42 and at a midpoint on the second end 42 between the first lateral side 80 and the second lateral side 82. To engage the canopy 12 and the second frame 15, a support member, such as support member 85 shown and described in reference to FIG. 10B, may be used.

In addition, there may be a plurality of anchors 34 in the system 10 illustrated in FIG. 19. For example, a first anchor 34 may be engageable with one or both of the frame 14, the alignment component 91, and the canopy 12 as illustrated in FIG. 19. There, the first anchor 34 includes two cords 32 that are coupled to the first anchor 34 and to a respective one of the alignment components 91, the first frame 14, and/or the canopy 12. Additional anchors 34 are also utilized in the embodiment illustrated in FIG. 19. There, second and third anchors 34 are engageable with each of the respective back corners 13 of the canopy 12 defined between the intersection of the second end 42 with the first lateral side 80 and the second lateral side 82. There, the second and third anchors 34 each include a cord 32 that is coupled between the respective one of the second or third anchor 34 and the respective corner 13. A fourth anchor 34 may be engageable with the second frame 15 and/or the canopy 12. The fourth anchor 34 may include a cord 32 that is coupled between the fourth anchor 34 and the second frame 15 and/or the canopy 12. In this example embodiment, one of the plurality of anchors 34 may comprise a container (similar to the container 70 in FIGS. 1-7) that in one configuration, houses and transports the system 10 and, in the supporting configuration, houses weight and acts as one of the plurality of anchors. Alternatively, the plurality of anchors 34 may comprise a stake, a corkscrew, a bungee cord, a tie-down, a magnetic fastener, or any combination thereof.

Figure 20:
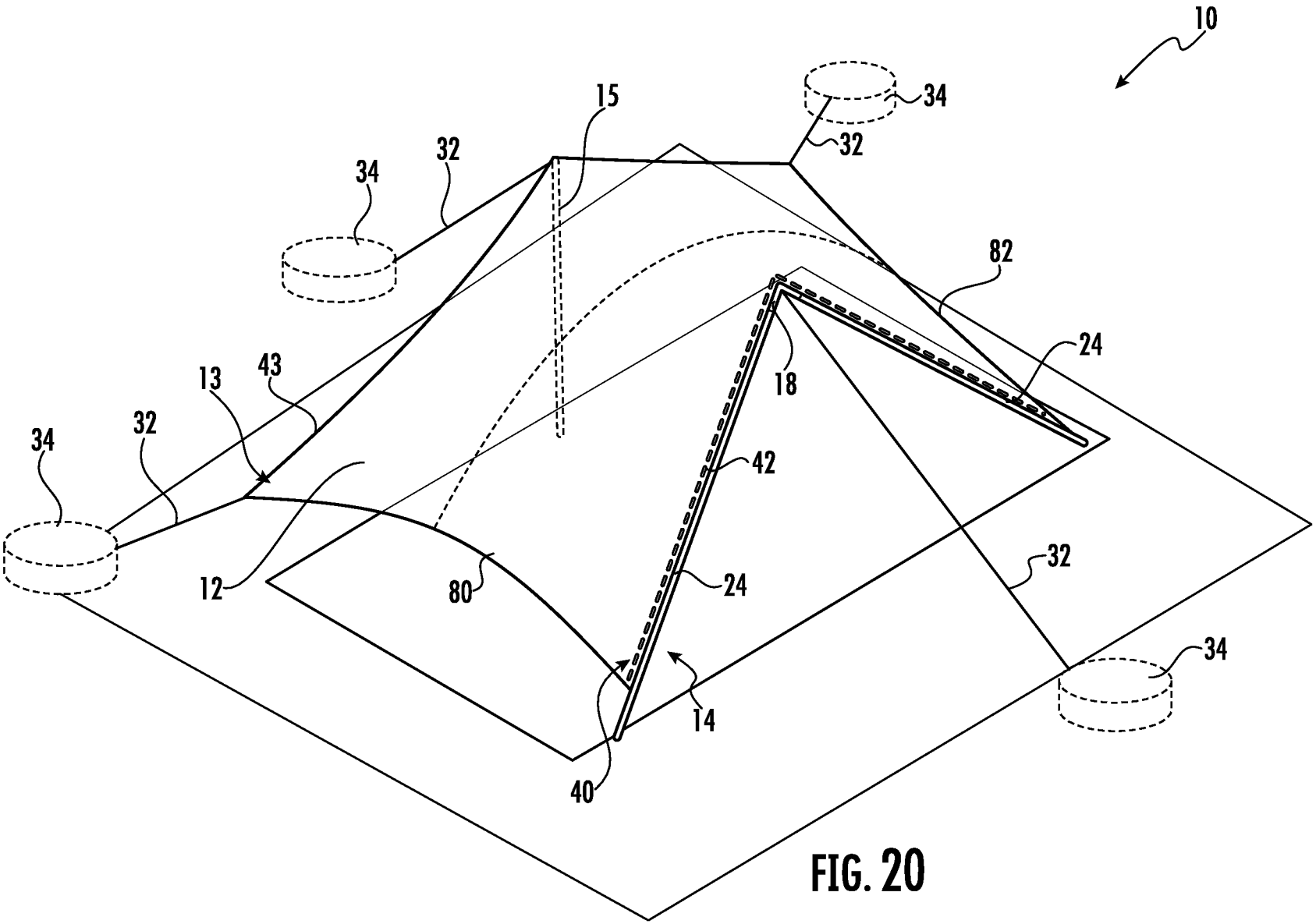
FIG. 20 is a perspective view of a system for providing shade according to one or more embodiments of the presently disclosed subject matter.

As shown in FIG. 20, for example, two frames are shown. A first frame 14 is an inverted V-shape with two angled sections 24 extending from a common vertex to form the left end and the right end of the frame. The vertex may define an acute angle, such as, for example, a 60 degree angle. A cable may extend through at least one of the sections 24. For example, a single cable may extend through all of the sections 24 of the first frame 14, or individual cables may extend through individual sections of the first frame 14. Instead of or in addition to the cable, other alignment components may also be utilized, such as connecting bracket 18 described and illustrated in reference to FIG. 9B. The connecting bracket 18 may be arranged to engage the two angled sections 24 and allow the sections 24 to be maneuvered between the compact transport configuration and the supporting configuration. For example, the connecting bracket 18 may be arranged at the vertex in order to retain the angled sections 24 in alignment. The connecting bracket 18 may be permanently attached to the sections 24, or may be removable and replaceable when the frame 24 is maneuvered between the transport and supporting configurations.

The first frame 14 of FIG. 20 may be arranged to extend at least partially through a channel 40 defined along one of the first end 42, the second end 43, the first lateral side 80, and/or the second lateral side 82. As shown in FIG. 20, the frame 14 extends through the channel 40 defined along an entirety of the first end 42. A second frame 15 may be a substantially vertical frame that includes at least one section configured with a bottom end that is engageable with the surface and a top end that is engageable with the canopy 12 proximate the second end 43 and at a midpoint on the second end 43 defined between the first lateral side 80 and the second lateral side 82. To engage the canopy 12 and the second frame 15, a support member such as the support member 85 shown and described in reference to FIG. 10B may be used.

In addition, there may be a plurality of anchors 34 in the system 10 illustrated in FIG. 20. For example, a first anchor 34 may be engageable with one or both of the frame 14 (including the connecting bracket 18) and the canopy 12 as illustrated in FIG. 20. There, the first anchor 34 includes a cord 32 that is coupled to the first anchor 34 and to a respective one of the connecting bracket 18, the first frame 14, and/or the canopy 12. Additional anchors 34 are also utilized in the embodiment illustrated in FIG. 20. There, second and third anchors 34 are engageable with each of the respective back corners 13 of the canopy 12 defined between the intersection of the second end 43 with the first lateral side 80 and the second lateral side 82. There, the second and third anchors 34 each include a cord 32 that is coupled between the respective one of the second or third anchor 34 and the respective corner 13. A fourth anchor 34 may be engageable with the second frame 15 and/or the canopy 12. The fourth anchor 34 may include a cord 32 that is coupled between the fourth anchor 34 and the second frame 15 and/or the canopy 12. In this example embodiment, one of the plurality of anchors 34 may comprise a container (similar to the container 70 in FIGS. 1-7) that in one configuration, houses and transports the system 10 and, in the supporting configuration, houses weight and acts as one of the plurality of anchors. Alternatively, the plurality of anchors 34 may comprise a stake, a corkscrew, a bungee cord, a tie-down, a magnetic fastener, or any combination thereof.

Figure 21:
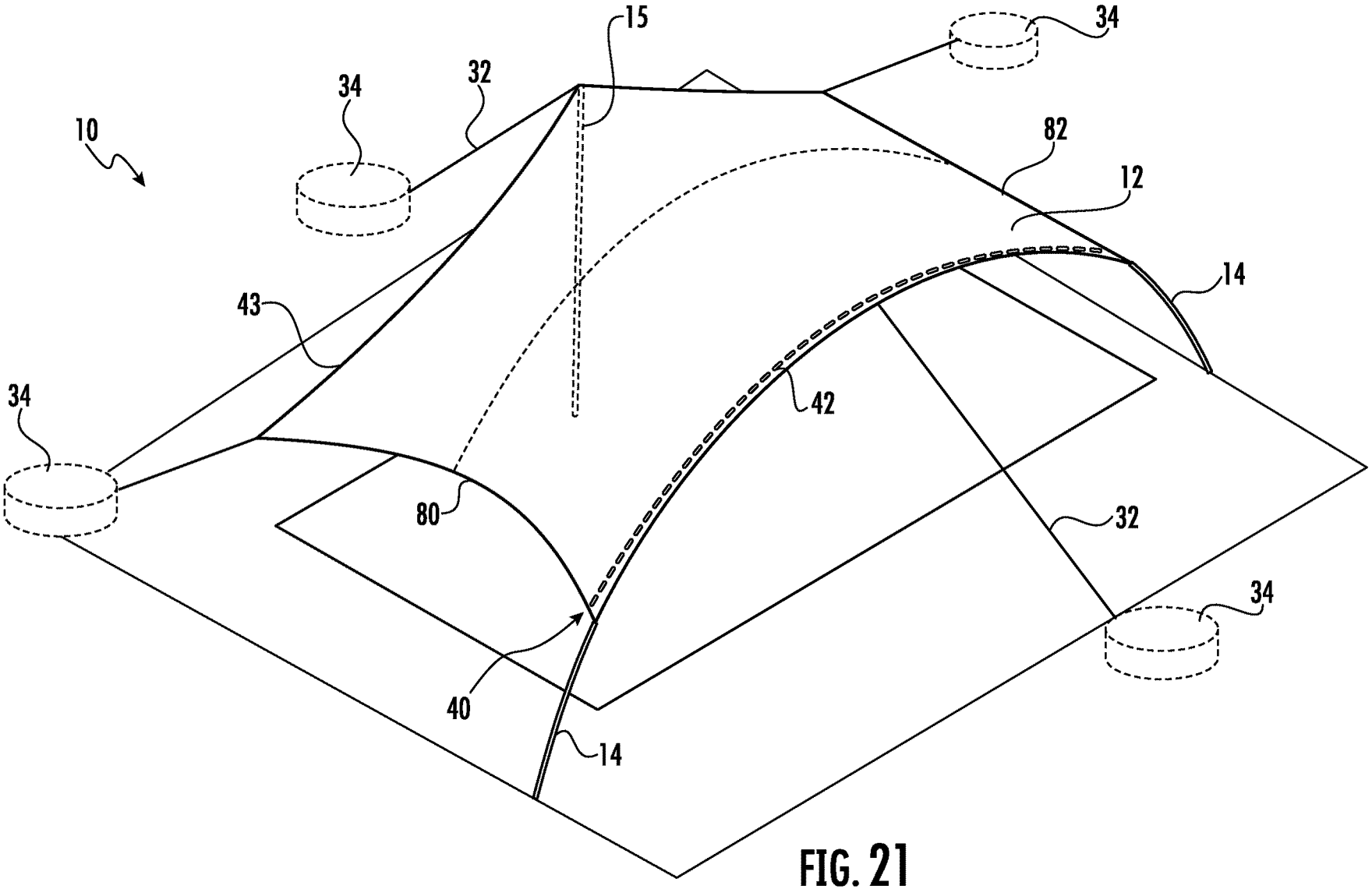
FIG. 21 is a perspective view of a system for providing shade according to one or more embodiments of the presently disclosed subject matter.

As shown in FIG. 21, for example, two frames are shown. A first frame 14 is a curved arch shape, similar to that illustrated in FIG. 1. A cable may extend through at least one of the sections of the first frame 14. For example, a single cable may extend through all of the sections of the first frame 14, or individual cables may extend through individual sections of the first frame 14. Instead of or in addition to the cable, other alignment components may also be utilized to maneuver the individual sections of the first frame 14 between the compact transport configuration and the supporting configuration. For example, a connecting bracket may be arranged at a vertex of the frame 14 and in between two adjacent sections 24 in order to retain the sections 24 in alignment. The connecting bracket may be permanently attached to the sections 24, or may be removable and replaceable when the frame 14 is maneuvered between the transport and supporting configurations.

In the supporting configuration, the first frame 14 of FIG. 21 extends along the length of the canopy at the first end 42. A second vertical frame 15 that includes at least one section configured with a bottom end that is engageable with the surface and a top end that is engageable with the canopy 12 is engaged with the canopy 12 proximate to the second end 43 of the canopy 12 and at a midpoint at the second end 43 defined between the first lateral side 80 and the second lateral side 82 of the canopy. To engage the canopy 12 and the second frame 15, a support member 85 such as that shown and described in reference to FIG. 10B may be used.

In addition, there may be a plurality of anchors 34 in the system 10 illustrated in FIG. 21. For example, a first anchor 34 may be engageable with one or both of the first frame 14 and the canopy 12 as illustrated in FIG. 21. There, the first anchor 34 includes a cord 32 that is coupled to the first anchor 34 and to a respective one of a connecting bracket, the first frame 14, and/or the canopy 12. Additional anchors 34 are also utilized in the embodiment illustrated in FIG. 21. There, a second anchor 34 of the plurality of anchors is engaged with a first corner 13 of the canopy 12 defined at the intersection between the second end 43 and the first lateral side 80 of the canopy 12, and a third anchor 34 of the plurality of anchors is engaged with a second corner 13 of the canopy 12 defined at the intersection between the second end 43 and the second lateral side 82 of the canopy 12. There, the second and third anchors 34 each include a cord 32 that is coupled between the respective one of the second or third anchor 34 and the respective corner 13. A fourth anchor 34 may be engaged with one or both of the second end 43 of the canopy 12 at the midpoint defined between the first lateral side 80 and the second lateral side 82 of the canopy 12 and the second vertical frame. The fourth anchor 34 may include a cord 32 that is coupled between the fourth anchor 34 and the second frame 14 and/or the canopy 12. In this example embodiment, one of the plurality of anchors 34 may comprise a container (similar to the container 70 in FIGS. 1-7) that in one configuration, houses and transports the system 10 and, in the supporting configuration, houses weight and acts as one of the plurality of anchors. Alternatively, the plurality of anchors 34 may comprise a stake, a corkscrew, a stake, a bungee cord, a tie-down, a magnetic fastener, or any combination thereof.

Figure 22:
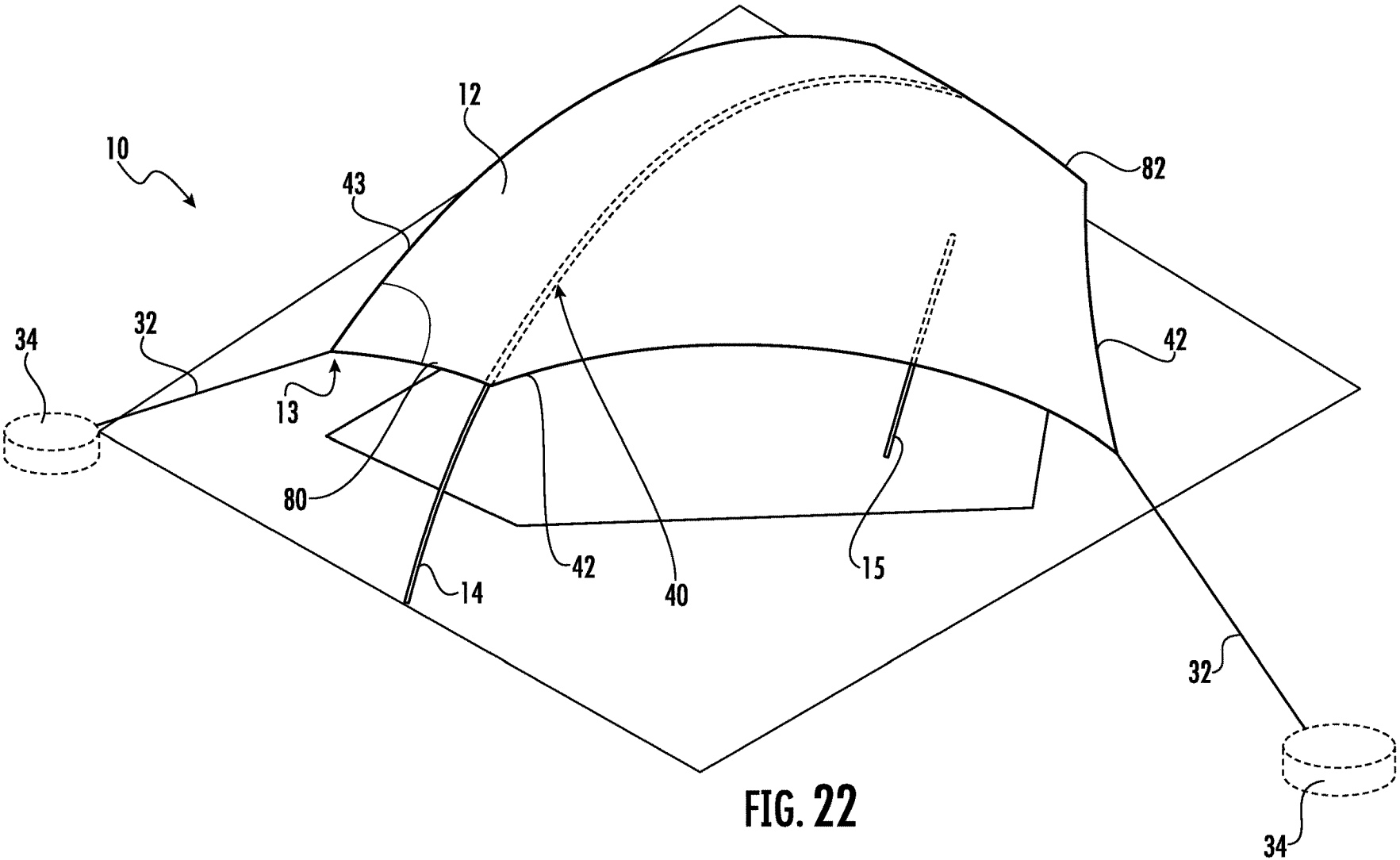
FIG. 22 is a perspective view of a system for providing shade according to one or more embodiments of the presently disclosed subject matter.

As shown in FIG. 22, for example, two frames are shown. A first frame 14 is a curved arch shape, similar to that illustrated in FIG. 1. A cable may extend through at least one of the sections of the first frame 14. For example, a single cable may extend through all of the sections of the first frame 14, or individual cables may extend through individual sections of the first frame 14. Instead of or in addition to the cable, other alignment components may also be utilized to maneuver the individual sections of the first frame between the compact transport configuration and the supporting configuration. For example, a connecting bracket may be arranged at a vertex of the first frame 14 and in between two adjacent sections in order to retain the sections in alignment. The connecting bracket may be permanently attached to the sections, or may be removable and replaceable when the frame 14 is maneuvered between the transport and supporting configurations.

The first frame 14 of FIG. 22 may be arranged to extend through a channel 40 defined between one of the first end 42 and the second end 43 and/or between the first lateral side 80 and the second lateral side 82. As shown in FIG. 22, the frame 14 extends through the channel 40 defined between the first end 42 and the second end 43. A second frame 15 may be a substantially vertical frame that includes at least one section configured with a bottom end that is engageable with the surface and a top end that is engageable with the canopy 12. As shown in FIG. 22, the top end of the second frame 15 is arranged between the first frame 14 and the first ends 42 of the canopy. To engage the canopy 12 and the second frame 15, a support member such as the support member 85 shown and described in reference to FIG. 10B may be used.

In addition, there may be a plurality of anchors 34 in the system 10 illustrated in FIG. 22. For example, a first anchor 34 may be engageable with one or more of the first frame 14, the second frame 15, and the canopy 12. As shown in FIG. 22, the first anchor 34 is engaged with the first ends 42 of the canopy 12, where the first ends 42 of the canopy 12 are defined as two angled sections that meet at a point, the point forming an acute angle. There, the first anchor 34 includes a cord 32 that is coupled to the first anchor 34 and to the point formed at the first ends 42 of the canopy 12. Additional anchors 34 are also utilized in the embodiment illustrated in FIG. 22. There, second and third anchors 34 are engageable with each of the respective back corners 13 of the canopy 12 defined between the intersection of the second end 43 with the first lateral side 80 and the second lateral side 82. There, the second and third anchors 34 each include a cord 32 that is coupled between the respective one of the second or third anchor 34 and the respective corner 13. In this example embodiment, one of the plurality of anchors 34 may comprise a container (similar to the container 70 in FIGS. 1-7) that in one configuration, houses and transports the system 10 and, in the supporting configuration, houses weight and acts as one of the plurality of anchors. Alternatively, the plurality of anchors 34 may comprise a stake, a corkscrew, a stake, a bungee cord, a tie-down, a magnetic fastener, or any combination thereof.

Figure 23:
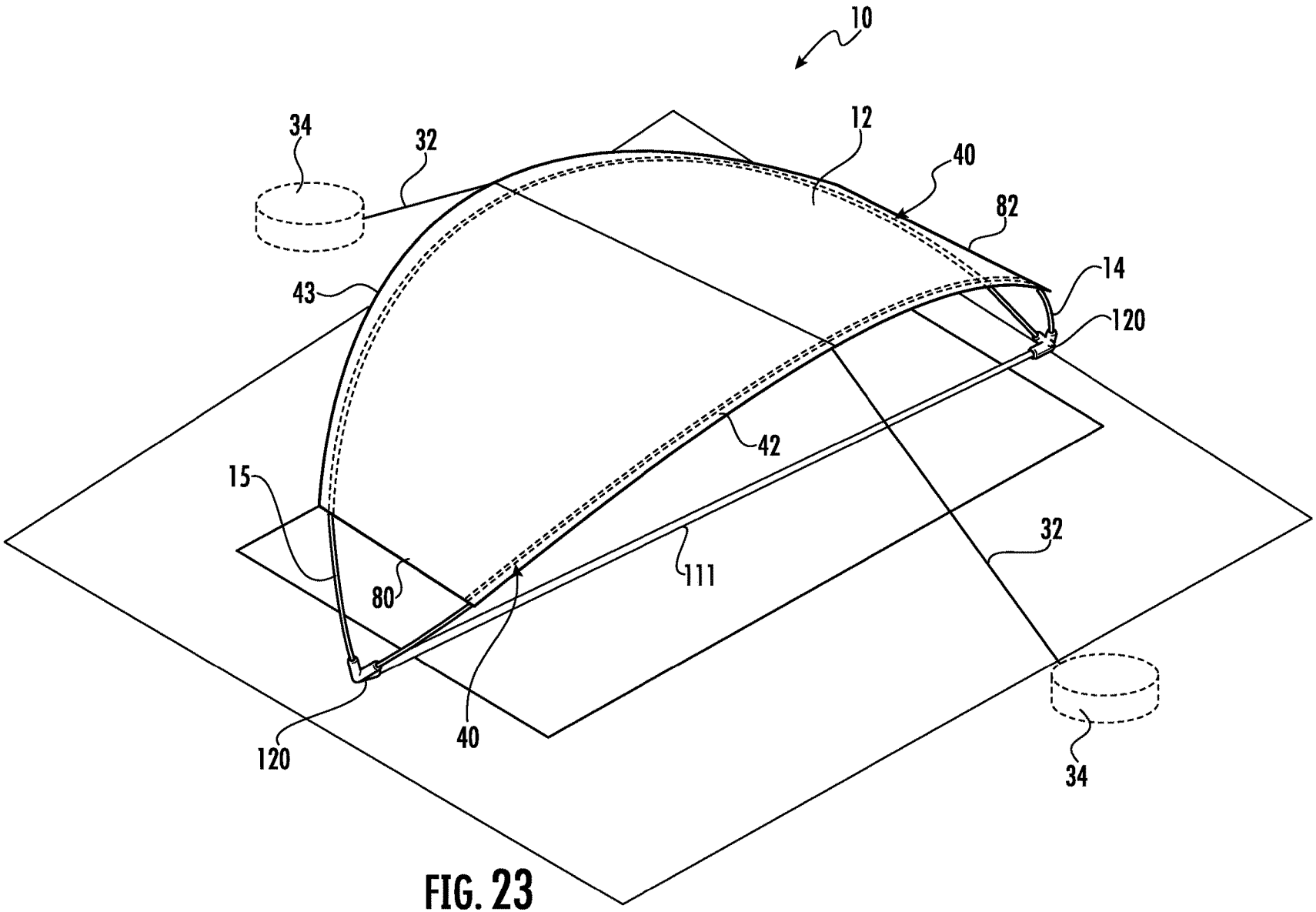
FIG. 23 is a perspective view of a system for providing shade according to one or more embodiments of the presently disclosed subject matter.

Another example embodiment of the system 10 is illustrated in FIG. 23. There, the system 10 comprises a first frame 14 and a second frame 15, each including a plurality of sections 24 configured for engagement in an end-to-end alignment from a left end to a right end to provide the first frame 14 and the second frame 15 each in a supporting configuration. In the supporting configuration, the left ends of the first frame 14 and the second frame 15 are coupleable to one another and engageable with the surface and the right ends of the first frame 14 and the second frame 15 are coupleable to one another and engageable with the surface. The coupled left and right ends of the first and second frames 14, 15 may be directly engageable with the surface.

The first frame 14 and the second frame 15 may be any type of shape, such as, for example, an 'L' shape, a 'T' shape, an 'I' shape, a 'V' shape, an inverted 'V' shape, a 'W' shape, a "U" shape, and the like. The first and second frames 14, 15 may comprise separate frames, which may be the same or different shapes. In some example embodiments, the first and second frames 14, 15 may be constructed similarly to that described in reference to FIGS. 1-7. For example, at least one cable may extend through the plurality of the sections of the first frame 14 and through the plurality of sections 24 of the second frame 15. In another example, a first cable extends through the plurality of sections of the first frame 14, and a second cable extends through the plurality of sections of the second frame 15. Alternatively, or in addition to the cable(s), other alignment components may be utilized such as brackets that engage adjacent sections and allow the sections to be maneuvered between a compact transport configuration and the supporting configuration. The brackets or alignment components may also be used to couple the first and second frames 14, 15 together at the respective left ends and right ends. For example, brackets 120 are illustrated in FIG. 23 that act to couple the first and second frames 14, 15 together, and may also aid in engaging the coupled ends of the frames to the surface.

The canopy 12 may define a length extending between a first lateral side 80 and a second lateral side 82, and may be supportable by the first frame 14 and the second frame 15 in the supporting configuration such that the first frame 14 extends along the length of the canopy 12 at a first end 42 of the canopy or an opposing second end 43 of the canopy 12 and the second frame 15 extends along the length of the canopy 12 at the other of the first end 42 or the second end 43 of the canopy 12. The canopy may be similar to or different to the canopy 12 described herein in reference to FIGS. 1-7. For example, the canopy 12 in FIG. 23 may differ from that in FIGS. 1-7 as the canopy may have a different shape, material, etc. The canopy 12 may define a first channel 40 extending along the length of the canopy 12 at the first end 42 of the canopy 12 and a second channel 40 extending along the length of the canopy 12 at the second end 43 of the canopy 12, the first and second channels 40 being arranged to receive the first frame 14 and the second frame 15, respectively. A fastener, such as the fastener illustrated in FIG. 3, may be coupled to the canopy 12 or one or both of the first frame 14 and the second frame 15 to secure the first and second frames 14, 15 to the canopy 12 in the supporting configuration.

The system 10 shown in FIG. 23 may further comprise a longitudinally-extending support member 111 that includes at least one section configured with opposing first and second ends, the first opposing end being coupleable at the coupled left ends of the first and second frames 14, 15 and the second opposing end being coupleable at the coupled right ends of the first and second frames 14, 15 such that in the supporting configuration the longitudinally-extending support member 111 extends between the respectively coupled left and right ends of the first and second frames 14, 15. Like the first and second frames 14, 15, at least one cable may extend through the plurality of the sections of the longitudinally-extending support member 111. Alternatively, or in addition to the cable, brackets or alignment components may also be used to couple the first and second frames 14, 15 with the longitudinally-extending support member 111 together at the respective left ends and right ends. For example, the brackets 120 may be arranged to couple the first and second frames 14, 15 together along with coupling them at the left and right ends to the longitudinally-extending support member 111.

As shown in FIG. 23, the system 10 may further comprise a plurality of anchors 34 engageable with one or more of the canopy 12, the first frame 14, and the second frame 15. At least one of the plurality of anchors may be engageable with one or more of the first frame 14, the second frame 15, and the canopy 12 at a midpoint defined between the first end 42 and the second end 43 or at a midpoint defined between the first lateral side 80 and the second lateral side 82. One or more portions of the canopy 12 may be elastic in order to stretch with the anchors 34. The system 10 may also comprise a plurality of cords 32, each of the cords being engageable between one or more of the canopy 12, the first frame 14, and the second frame, and the anchor 34. The system 10 may further comprise a container (similar to the container 70 described in reference to FIGS. 1-7) for housing and transporting at least one of the components of the system 10. In some embodiments, the container, in one configuration, houses and transports the system 10 and, in another configuration, houses weight and acts as one of the plurality of anchors 34. In some embodiments, at least one of the plurality of anchors 34 comprises a weight, a corkscrew, a stake, a bungee cord, a tie-down, a magnetic fastener, or any combination thereof. In some embodiments, the system 10 illustrated in FIG. 23 may comprise one or more supports such as one or more battens or inflatable bladders extending along one or both of the length of the canopy 12 and a width of the canopy 12 between the first end 42 and the second end 43.

As such, and as shown by FIG. 23, in the supporting configuration, the canopy 12 is supported by the first frame 14, the second frame 15, and the plurality of anchors 34 and is at least partially supportable by wind for providing shade onto the surface.

The system 10 may additionally comprise sun tracking capabilities. For example, in some example embodiments shown in FIGS. 24 and 25, the system 10 may be configured with an adjustment mechanism 107 that enables adjustment of one or more components of the system 10 in order to track the location of the sun. The adjustment mechanism 107 or something similar may be used with regard to any of the embodiments described herein to enable the system 10 to adjust in order to track the location of the sun and provide shade onto the surface.

Figure 24:
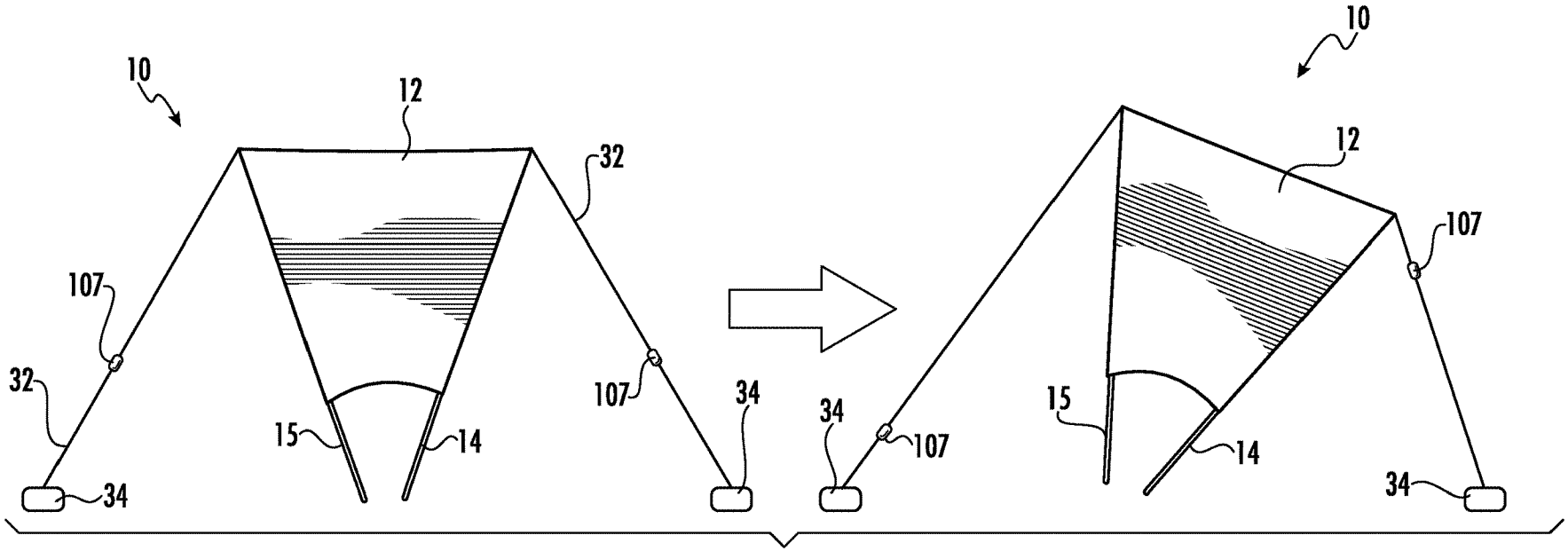
FIG. 24 is a perspective view of a system for providing shade according to one or more embodiments of the presently disclosed subject matter.

In FIG. 24, for example, the system 10 comprises the same or similar components as those illustrated in FIG. 23, though some components may differ. In FIG. 24, for example, each of the plurality of cords 32 may include an adjustment mechanism 107 that, upon manipulation thereof, may lengthen or shorten a length of the respective cord 32 to allow the first and second frames 14, 15 to tilt in the direction of the sun so that the canopy 12 blocks out the sun. The adjustment mechanisms 107 may be a carabiner, a cord adaptor/adjuster, a pulley, or the like. The adjustment mechanisms 107 may be temporarily locked into place when the desired location on the cords 32 is found, so that the adjustment mechanism can be easily adjusted again in order to further tilt the first and second frames 14, 15 in the desired direction.

Figure 25:
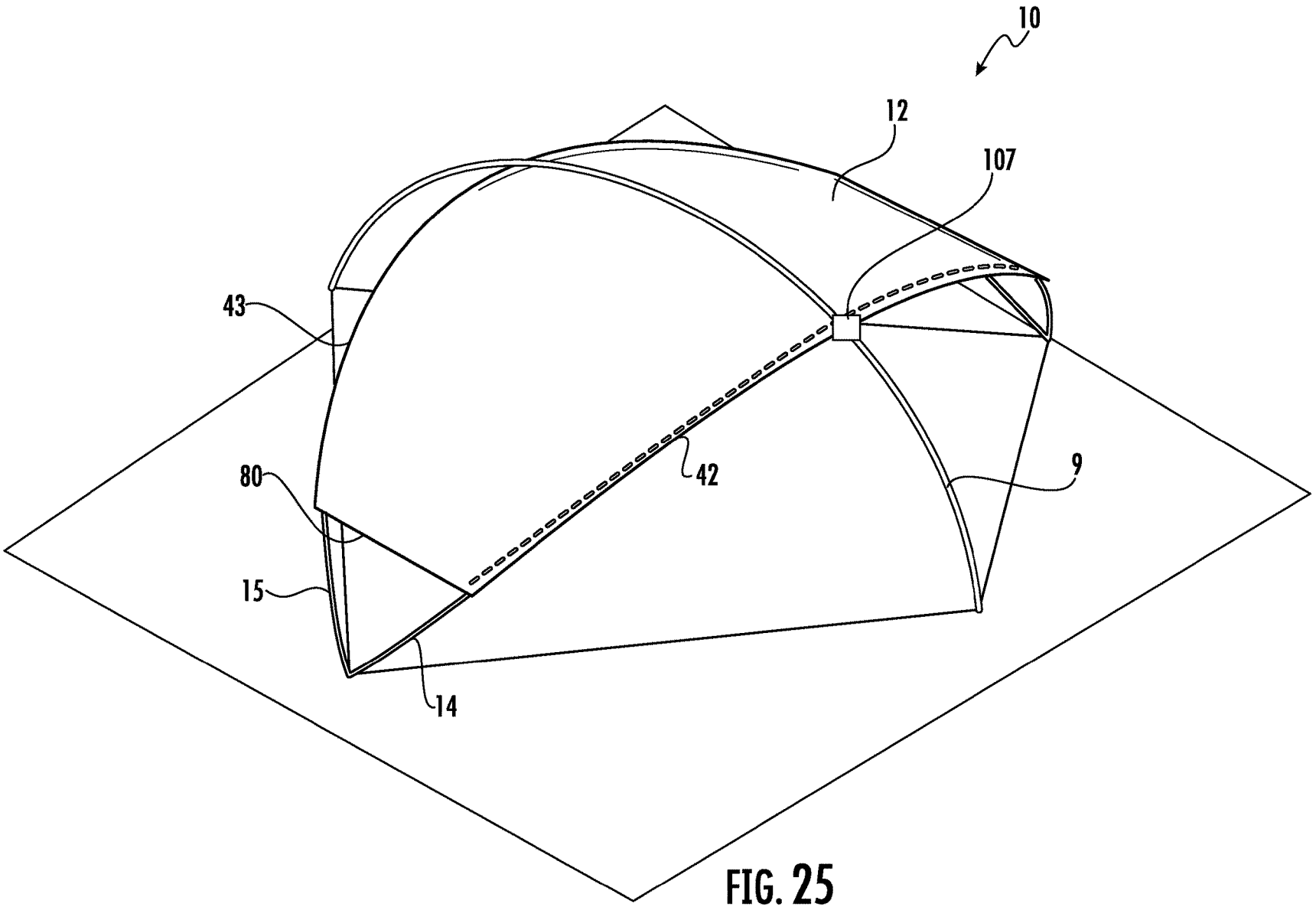
FIG. 25 is a perspective view of a system for providing shade according to one or more embodiments of the presently disclosed subject matter.

Similarly in FIG. 25, for example, the system comprises the same or similar components as those illustrated in FIG. 23, though some components may differ. In FIG. 25, for example, a third frame 9 may be included with the system 10, where the third frame 9 includes plurality of sections configured for engagement in an end-to-end alignment from a left end to a right end to provide the third frame 9 in a supporting configuration. The third frame 9 may extend over the canopy 12 in the supporting configuration and may be coupled to one or both of the first end 42 and the second end 43 of the canopy 12 using one or more adjustment mechanism 107. In some aspects, the adjustment mechanism 107 may be attached to one or more of the third frame 9, the canopy 12, and one or both of the first frame 14 and the second frame 15. As shown in FIG. 25, a single adjustment mechanism 107 is attached to the third frame 9 and to the canopy 12 and/or the first frame 14. However, a second adjustment mechanism (not shown) may also be used to attach to the third frame 9 and to the canopy 12 and/or the second frame 15. The adjustment mechanism 107 may be, for example, a locating clip that, upon manipulation thereof, may slide up and down a length of the third frame 9. The sliding action of the locating clip along the length of the third frame 9 may in turn pull the first and second frames 14, 15 in the direction of the sliding action so as to allow the first and second frames 14, 15 to tilt in the direction of the sun so that the canopy 12 blocks out the sun. The adjustment mechanism 107 may be temporarily locked into place when the desired location on the third frame 9 is found, so that the adjustment mechanism can be easily adjusted again in order to further tilt the first and second frames 14, 15 in the desired direction.

In some other example embodiments, the canopy 12 may define one or more air pockets such as baffles, inflatable bladders, and the like for supporting the canopy 12. Further, the canopy 12 may define vent holes and/or wind socks for permitting wind to pass therethrough in high wind situations. In other example embodiments, the canopy 12 may define tails extending from a side opposite the first end 42, i.e., the second end 43.

Figure 26A:
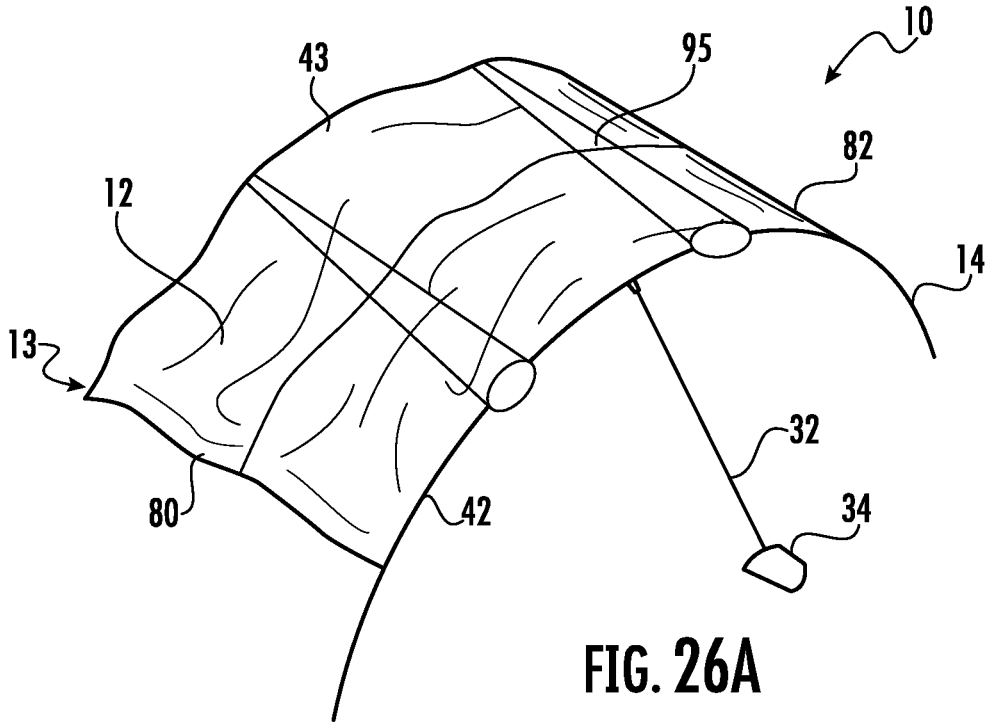
FIG. 26A is a perspective view of a system for providing shade according to one or more embodiments of the presently disclosed subject matter.
Figure 26B:
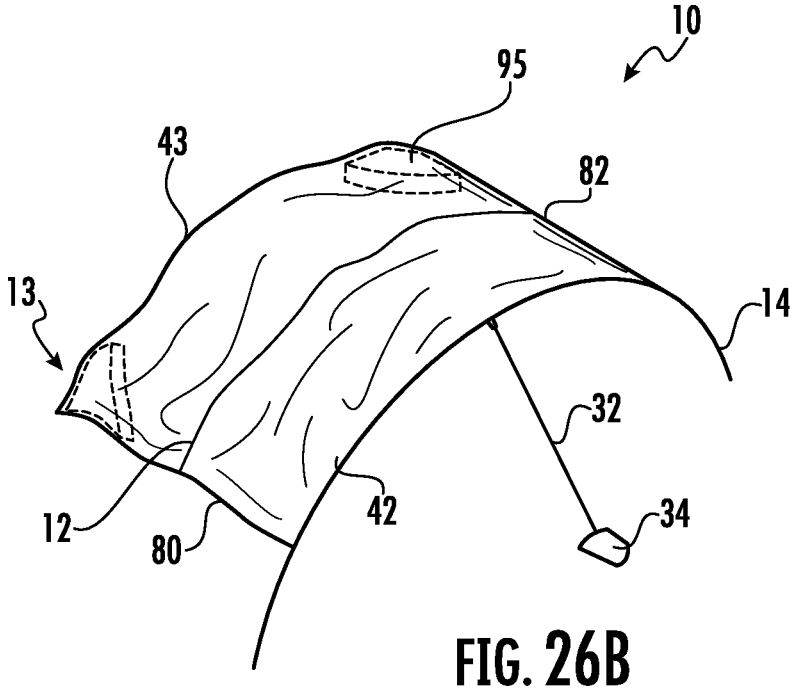
FIG. 26B is a perspective view of a system for providing shade according to one or more embodiments of the presently disclosed subject matter.

For example, and as shown in FIG. 26A, one or more wind socks 95 may be sewn into the canopy (or attached to the canopy). For example, there may be one, two, three, four, five, six, seven, etc., one or more wind socks. The one or more wind socks 95 may be arranged on top of the canopy 12, integrated with the canopy 12, on bottom of the canopy 12, or both. The one or more wind socks 95 may extend at least partially or totally from the first end 42 to the second end 43, from the first lateral side 80 to the second lateral side 82, diagonally across the corners 13 of the canopy, any combination thereof, to force air passing through from a wider opening through a more narrow opening to give the canopy some rigidity to reduce noise from excessive flapping in high wind. In another example, and as shown in FIG. 26B, the wind socks 95 may be arranged on the corners 13 of the second end 43 without any additional wind socks or with other wind socks arranged in the configuration described above. Other arrangements of the wind socks 95 separately or in conjunction with other elements are also contemplated herein.

In some example embodiments, air pockets may be formed in the canopy. The air pockets may comprise inflatable bladders or battens that may be pumped with air using a manual or powered pump, or via mouth blown. Bladders formed within or attached to the material of the canopy 12 may include valves that can be attached to the pump. Alternatively, the canopy itself may comprise a series of channels or a single channel such that an entirety or a substantial entirety of the canopy acts as a bladder that can be inflated. The channels may be formed by crimping, stamping, etc., portions of the canopy. As the bladders fill with air through the valves, the material of the canopy becomes tauter. In some other example embodiments, the air pockets may be formed as elongated strips and/or panels in the canopy 12 that comprise a shape memory alloy. As the shape memory alloy is heated by the sun, or other heat source, the shape memory alloy may change from a first shape to a second stiffened shape that holds the canopy taut. Thus, regardless of the type of air pockets utilized, when the first and second end(s) 42, 43 of the canopy are engaged with the frame(s) 14, 15, the material of the canopy 12 does not sag therebetween.

Figure 27:
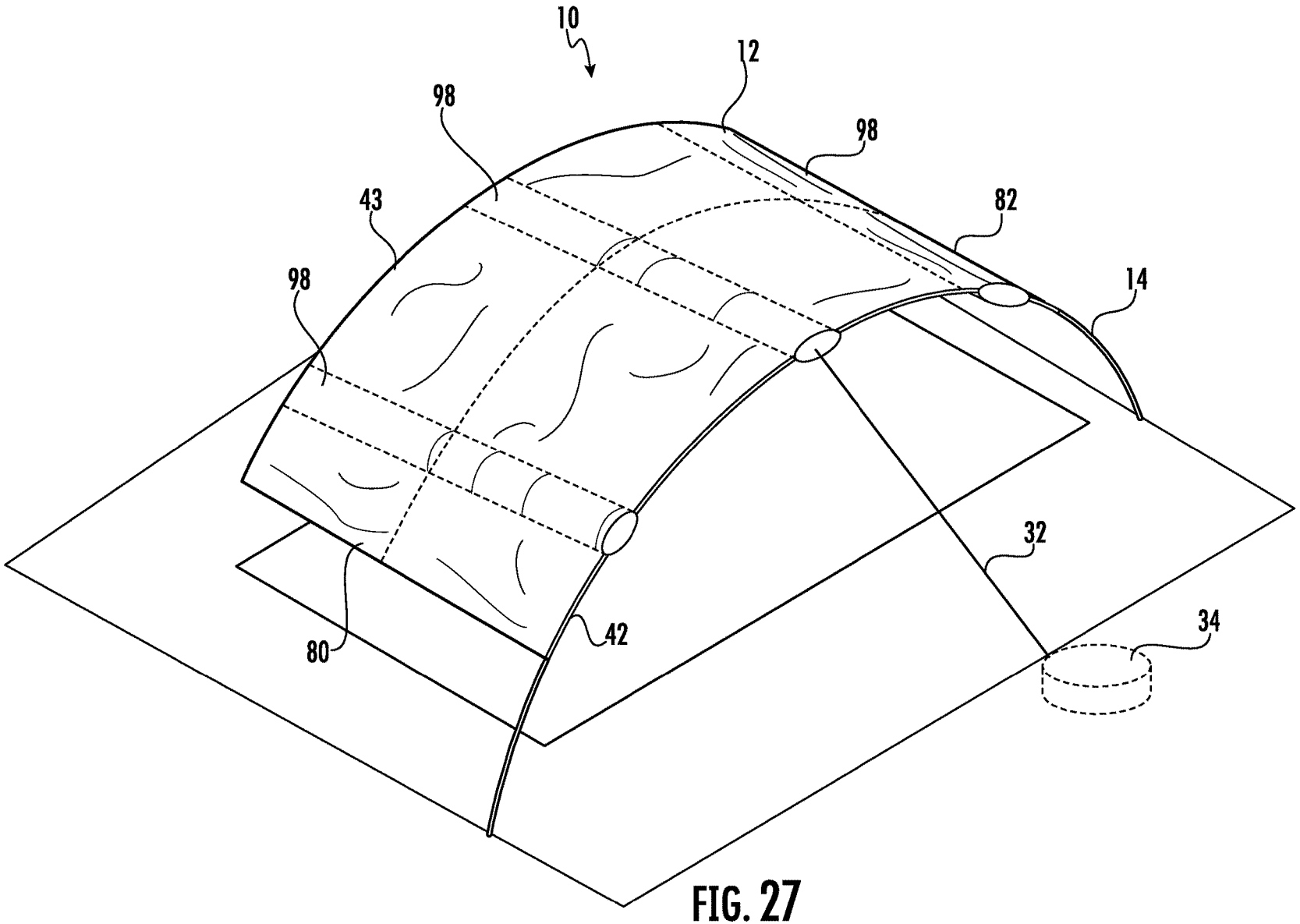
FIG. 27 is a perspective view of a system for providing shade according to one or more embodiments of the presently disclosed subject matter.
Figure 28:
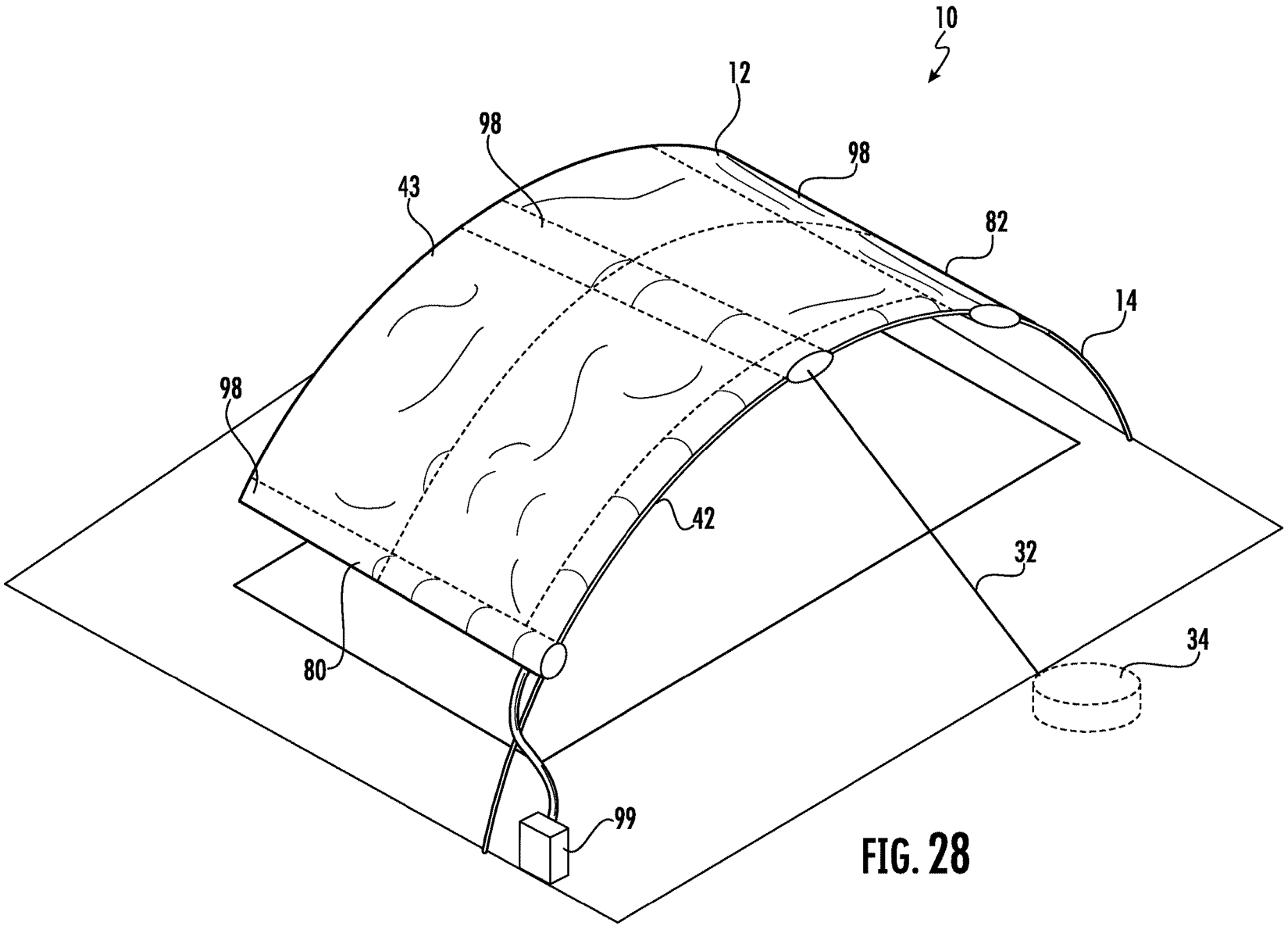
FIG. 28 is a perspective view of a system for providing shade according to one or more embodiments of the presently disclosed subject matter.
Figure 29:
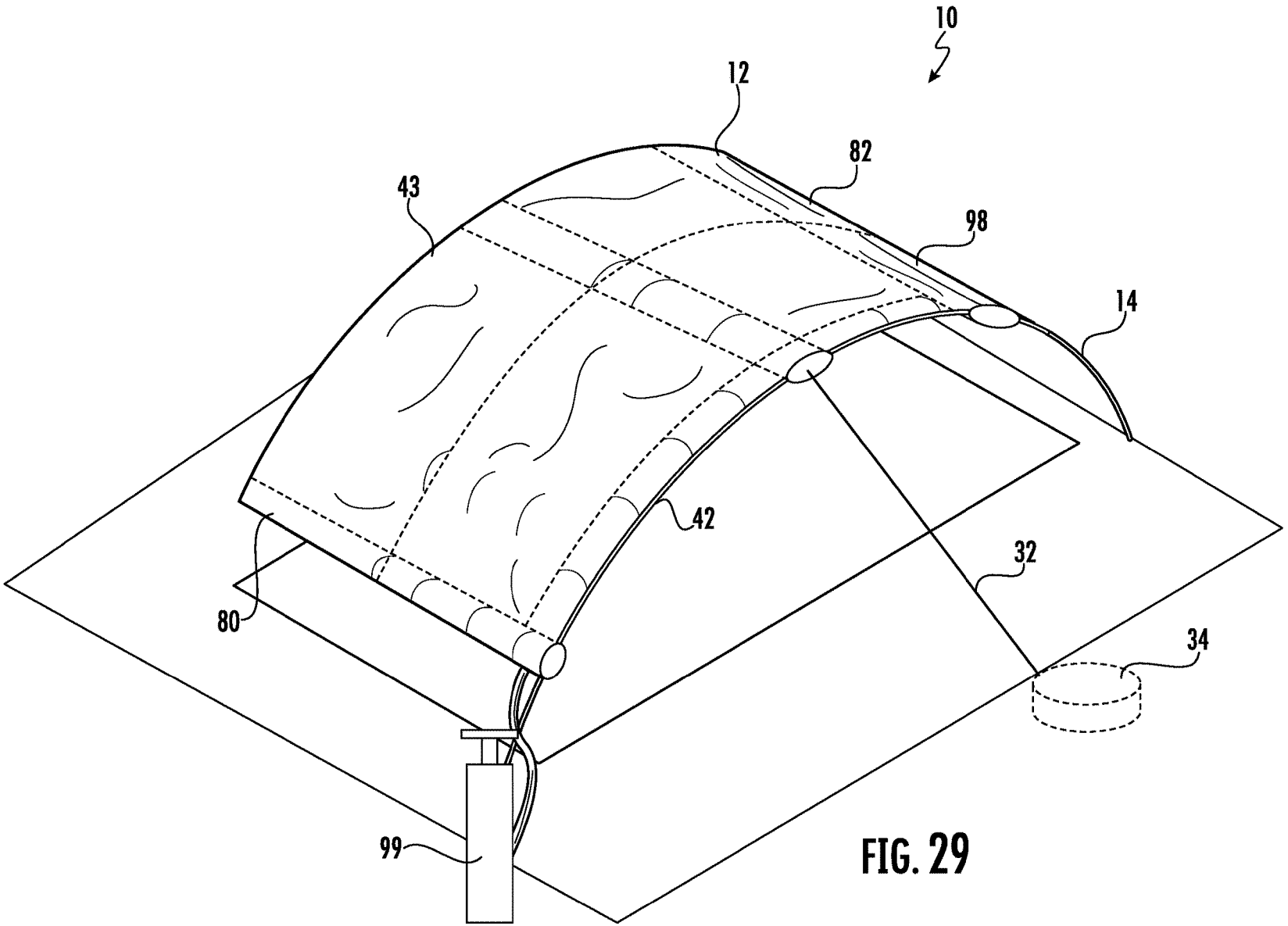
FIG. 29 is a perspective view of a system for providing shade according to one or more embodiments of the presently disclosed subject matter.

FIGS. 27, 28, and 29 illustrate one or more examples of air pockets 98 that may be sewn into the canopy (or attached to the canopy). For example, there may be one, two, three, four, five, six, seven, etc., one or more air pockets 98. The one or more air pockets 98 may be arranged on top of the canopy 12, integrated with the canopy 12, on bottom of the canopy 12, or both. The one or more air pockets 98 may extend at least partially or totally from the first end 42 to the second end 43, from the first lateral side 80 to the second lateral side 82, diagonally across the corners 13 of the canopy, and any combination thereof. The one or more air pockets 98 may be arranged at the first end 42, the second end 43, the first lateral side 80, and/or the second lateral side 82, or may be arranged between the first end 42 and the second end 43 and/or between the first lateral side 80 and the second lateral side 82.

For example, and as illustrated in FIG. 27, there may be three air pockets 98, a first air pocket 98 arranged proximate to the first lateral side 80, a second air pocket 98 arranged proximate to the second lateral side 82, and a third air pocket 98 arranged between the first and second air pockets 98. One or more of the air pockets may extending from the first end 42 to the second end 43. The air pockets 98 may be baffles and may be wind driven. In another example, and as illustrated in FIG. 28, there may be four air pockets 98, a first air pocket 98 arranged at and extending along the first end 42, a second air pocket 98 arranged at the first lateral side 80, a third air pocket 98 arranged at the second lateral side 82, and a fourth air pocket 98 arranged between the second and third air pockets 98. One or more of the second-fourth air pockets 98 may extend from the first air pocket 98 to the second end 43. The air pockets 98 in FIG. 28 may be baffles and may be inflated by a pump or other mechanism 99 capable of inflating the baffles.

In still another example, and as illustrated in FIG. 29, there may be four air pockets 98, a first air pocket 98 arranged at and extending along the first end 42, a second air pocket 98 arranged at the first lateral side 80, a third air pocket 98 arranged at the second lateral side 82, and a fourth air pocket 98 arranged between the second and third air pockets 98 and extending from the first air pocket 98 to the second end 43. The air pockets 98 in FIG. 29 may be air bladders and may be inflated by a pump or other mechanism 99 capable of inflating the air bladders.

In another example, weight may be added to the second end 43 of the canopy 12 to make it more difficult for the canopy to flap and thereby reduce noise from excessive flapping in high wind. The added weight may be variously configured, such as (a) small pockets configured to fill with a weight, such as sand or (b) heavier pieces or sections of fabric that can be connected to the canopy fabric.

Figure 30:
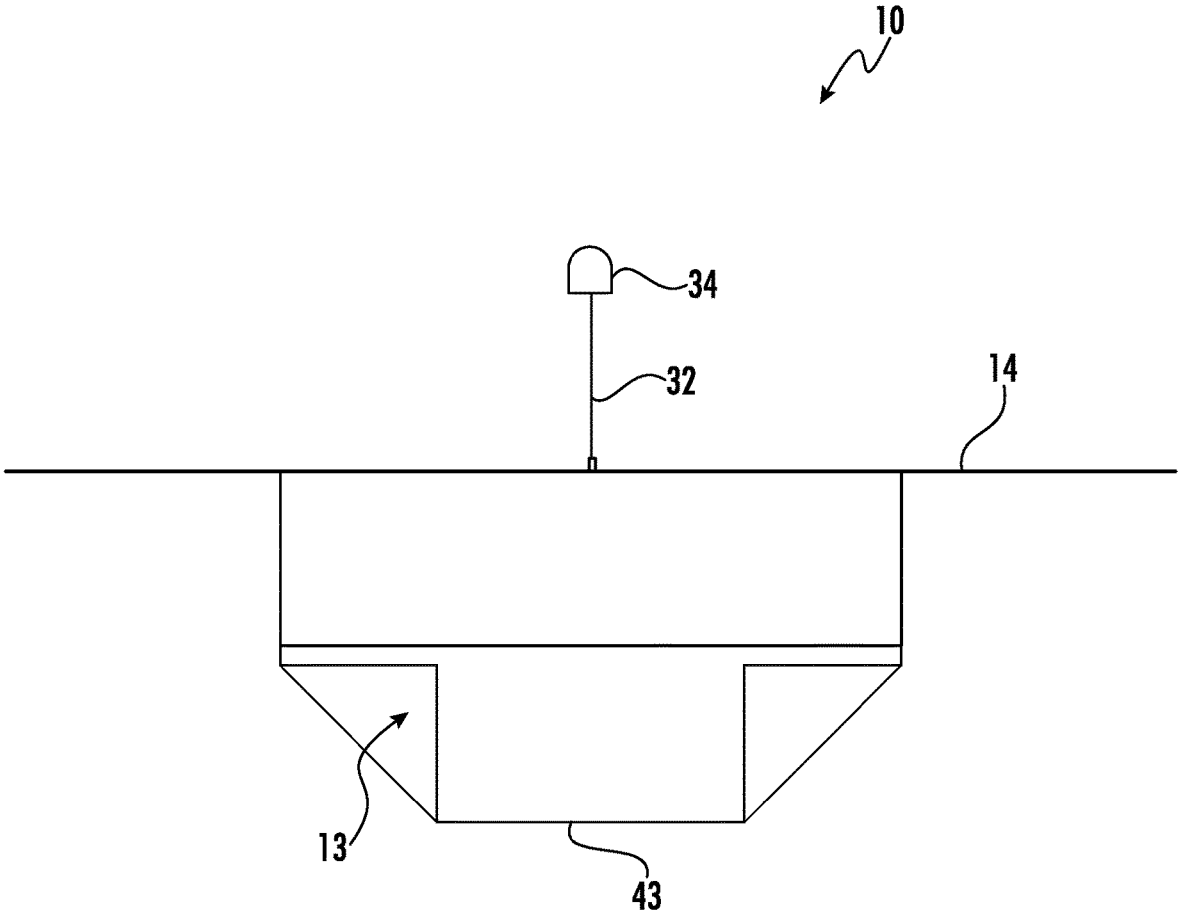
FIG. 30 is a perspective view of a system for providing shade according to one or more embodiments of the presently disclosed subject matter.

In another example, and as shown in FIG. 30, the trailing end 43 of the canopy may be folded back and fastened. For example, corners of the trailing end 43 may be folded and fastened to an interior portion of the canopy to prevent the loud flapping that occurs at the trailing corners of the fabric.

Figure 31:
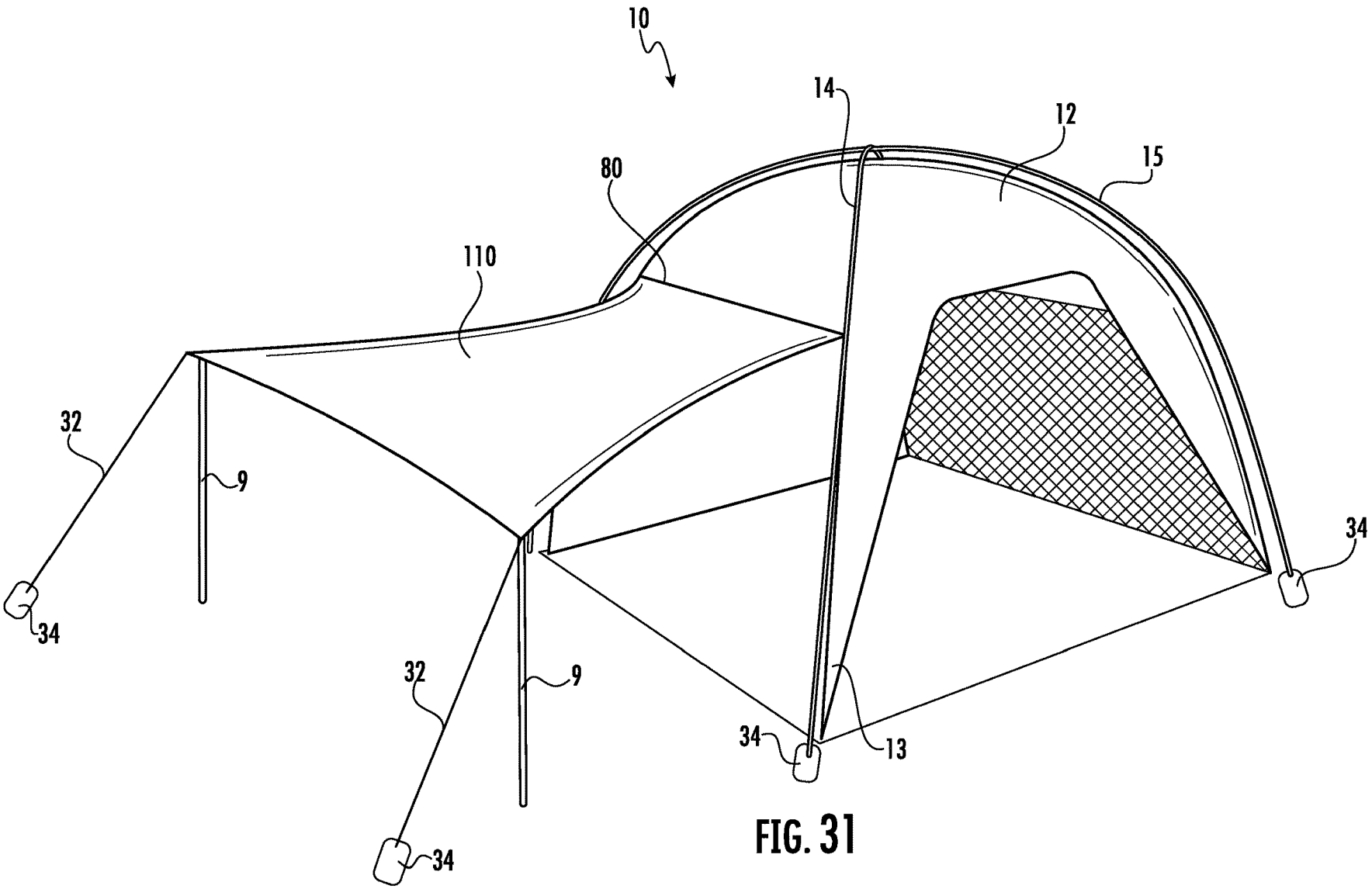
FIG. 31 is a perspective view of a system for providing shade according to one or more embodiments of the presently disclosed subject matter.

In some example embodiments, a system 10 may utilize more than three frames in order to support the canopy 12. For example, and as illustrated in FIG. 31, a system 10 may include a first frame 14 and a second frame 15 that are formed to create an X-shape when viewed from above. The first frame 14 and the second frame 15 may be any of the shapes described herein in reference to various frames. As shown in FIG. 31, the first and second frames 14, 15 are parabolic arch shapes. A canopy 12 may be attached to or otherwise extend under the first and second frames 14, 15 so that the canopy 12 also forms an X-shape when laid flat and viewed from above. Corners 13 of the canopy 12 may be anchored to the surface using one or more anchors 34. A secondary canopy 110 may attach to one side or end of the canopy 12, such as a first lateral side 80 and/or to the first and second frames 14, 15. The secondary canopy 110 may be supported by additional frames, such as third and fourth frames 9, which are substantially vertical. The third and fourth frames 9 may couple to the secondary canopy 110 at corners thereof, and may also include cords 32 that extend from the corners of the secondary canopy 110 to anchors 34. Each of the frames 9, 14, and 15 may comprise one or more sections configured for engagement in an end-to-end alignment, similar to the sections 24 described in reference to FIGS. 1-7. One or more cables or alignment components may be utilized with the various frames in FIG. 31, similar to those described in reference to FIGS. 1-7. The fabric of the canopy may include a mesh panel, or other type of fabric that allows air to pass through.

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A system for providing shade onto a surface, the system comprising:

a canopy defining a length extending between a first lateral side and a second lateral side and defining a width extending between a first end and an opposing second end;

an air pocket formed as a channel having a closed side extending along an entirety of the first end of the canopy from the first lateral side to the second lateral side to support the canopy in a supporting configuration such that the air pocket extends along the length of the canopy;

one or more anchors engageable with one or both of the canopy and the air pocket, wherein, in the supporting configuration, the canopy is supported by the air pocket and is at least partially supportable by wind for providing shade onto the surface, and wherein the canopy comprises an air pocket integrated with the canopy and extending from the first end to the second end, the air pocket being wind driven.

2. The system of claim 1, further comprising a container for housing and transporting at least one of the components of the system.

3. The system of claim 2, wherein the container, in one configuration, houses and transports the system and, in another configuration, houses weight and acts as at least one of the one or more anchors.

4. The system of claim 1, further comprising one or more cords, the cord being engageable between one or both of the canopy and the air pocket, and the anchor.

5. The system of claim 1, wherein the anchor comprises a weight, a corkscrew, a stake, a bungee cord, a tie-down, a magnetic fastener, or any combination thereof.

6. The system of claim 1, wherein at least one of the corners of the canopy is elastic.

7. The system of claim 1, wherein the anchor is engageable with a corner of the canopy defined at the intersection of the first or second ends with the first or second lateral sides.

8. The system of claim 7, wherein the one or more anchor comprises two anchors, the first anchor being arrangeable in the supporting configuration at a first corner of the canopy defined at the intersection of the second end with the first lateral side and a second anchor being arrangeable in the supporting configuration at a second corner of the canopy defined at the intersection of the second end with the second lateral side.

9. The system of claim 1, wherein the air pocket is formed as a single channel extending along the entirety of the first end of the canopy from the first lateral side to the second lateral side.

10. The system of claim 1, wherein the channel defines an axially extending opening that extends from a first opening proximate the first lateral side to a second opening proximate the second lateral side.

11. A system for providing shade onto a surface, the system comprising:

at least one frame that includes a plurality of sections configured for engagement in an end-to-end alignment to provide the frame in a supporting configuration with a first end that is engageable with the surface;

a canopy defining a length extending between a first lateral side and a second lateral side and defining a width extending between a first end and an opposing second end;

an air pocket being wind driven to support the canopy in a supporting configuration and formed as at least three channels extending along an entirety of the width of the canopy from the first end to the second end of the canopy and along an entirety of the length of the canopy from the first lateral side to the second lateral side of the canopy and separated from one another by canopy material such that air flow between the at least three channels is not comingled, wherein, in the supporting configuration, the canopy is supported by the air pocket and is at least partially supportable by wind for providing shade onto the surface.

12. The system of claim 11, further comprising a container for housing and transporting at least one of the components of the system.

13. The system of claim 12, wherein the container, in one configuration, houses and transports the system and, in another configuration, houses weight and acts as an anchor.

14. The system of claim 11, further comprising an anchor and one or more cords, the cord being engageable between one or more of the canopy, the frame, and the air pocket, and the anchor.

15. The system of claim 14, wherein the anchor comprises a weight, a corkscrew, a stake, a bungee cord, a tie-down, a magnetic fastener, or any combination thereof.

16. The system of claim 11, wherein a shape of the canopy is substantially rectangular.

17. The system of claim 11, wherein the canopy material separating the channels is uninterrupted.

18. A system for providing shade onto a surface, the system comprising:

a canopy defining a length extending between a first lateral side and a second lateral side and defining a width extending between a first end and an opposing second end;

an air pocket formed as a channel having a closed side extending along an entirety of the first end of the canopy from the first lateral side to the second lateral side to support the canopy in a supporting configuration such that the air pocket extends along the length of the canopy;

one or more anchors engageable with one or both of the canopy and the air pocket, wherein, in the supporting configuration, the canopy is supported by the air pocket and is at least partially supportable by wind for providing shade onto the surface, and wherein the channel defines an axially extending opening that extends from a first opening proximate the first lateral side to a second opening proximate the second lateral side.

19. The system of claim 18, further comprising one or more cords, the cord being engageable between one or both of the canopy and the air pocket, and the anchor.

20. The system of claim 18, wherein the anchor is engageable with a corner of the canopy defined at the intersection of the first or second ends with the first or second lateral sides, and wherein the one or more anchor comprises two anchors, the first anchor being arrangeable in the supporting configuration at a first corner of the canopy defined at the intersection of the second end with the first lateral side and a second anchor being arrangeable in the supporting configuration at a second corner of the canopy defined at the intersection of the second end with the second lateral side.

* * * * *